US008872608B2

(12) United States Patent
Fullerton et al.

(10) Patent No.: US 8,872,608 B2
(45) Date of Patent: Oct. 28, 2014

(54) MAGNETIC STRUCTURES AND METHODS FOR DEFINING MAGNETIC STRUCTURES USING ONE-DIMENSIONAL CODES

(71) Applicant: Correlated Magnetics Research, LLC., New Hope, AL (US)

(72) Inventors: Larry W. Fullerton, New Hope, AL (US); Mark D. Roberts, Huntsville, AL (US); James L. Richards, Fayetteville, TN (US)

(73) Assignee: Correlated Magnetics Reserach LLC, Huntsville, AL (US)

( * ) Notice: Subject to any disclaimer, the term of this patent is extended or adjusted under 35 U.S.C. 154(b) by 0 days.

(21) Appl. No.: 14/035,818

(22) Filed: Sep. 24, 2013

(65) Prior Publication Data

US 2014/0022730 A1 Jan. 23, 2014

Related U.S. Application Data

(63) Continuation-in-part of application No. 13/959,649, filed on Aug. 5, 2013, now Pat. No. 8,692,637, and a continuation-in-part of application No. 13/759,695, filed on Feb. 5, 2013, now Pat. No. 8,502,630, which is a continuation-in-part of application No. 13/481,554, filed on May 25, 2012, now Pat. No. 8,368,495, which is a continuation-in-part of application No. 13/351,203, filed on Jan. 16, 2012, now Pat. No. 8,314,671, which is a continuation of application No. 13/157,975, filed on Jun. 10, 2011, now Pat. No. 8,098,122, which is a continuation of application No. 12/952,391, filed on Nov. 23, 2010, now Pat. No. 7,961,069, which is a continuation of application No. 12/478,911, filed on Jun. 5, 2009, now Pat. No. 7,843,295, which is a continuation of application No. 12/478,950, filed on Jun. 5, 2009, now Pat. No. 7,843,296, which is a continuation of application No.

(Continued)

(51) Int. Cl.

| | |
|---|---|
| ***H01F 7/20*** | (2006.01) |
| ***H01F 7/02*** | (2006.01) |
| ***G09F 7/04*** | (2006.01) |
| ***B42F 1/06*** | (2006.01) |
| ***H01F 7/00*** | (2006.01) |
| ***B42F 1/00*** | (2006.01) |

(52) U.S. Cl.

CPC ..... *H01F 7/02* (2013.01); *H01F 7/0252* (2013.01); *G09F 7/04* (2013.01); *H01F 7/0242* (2013.01); *B42F 1/06* (2013.01); *H01F 7/00* (2013.01); *H01F 7/0263* (2013.01); *B42F 1/00* (2013.01)

USPC ..... 335/285; 335/306

(58) Field of Classification Search

CPC ..... H01F 7/021; H01F 7/0252

USPC ..... 335/285, 306

See application file for complete search history.

(56) References Cited

U.S. PATENT DOCUMENTS

| | | | |
|---|---|---|---|
| 381,968 | A | 5/1888 | Tesla |
| 493,858 | A | 3/1893 | Edison |

(Continued)

FOREIGN PATENT DOCUMENTS

| | | | |
|---|---|---|---|
| CN | 1615573 | A | 5/2005 |
| DE | 2938782 | A1 | 4/1981 |

(Continued)

OTHER PUBLICATIONS

Atallah, K., Calverley, S.D., D. Howe, 2004, "Design, analysis and realisation of a high-performance magnetic gear", IEE Proc.-Electr. Power Appl., vol. 151, No. 2, Mar. 2004.

(Continued)

*Primary Examiner* — Ramon Barrera

(74) *Attorney, Agent, or Firm* — Vector IP Law Group; Robert S. Babayi

(57) ABSTRACT

An improved field emission system and method is provided that involves field emission structures having irregular polarity patterns defined in accordance with one-dimensional codes, where an irregular polarity pattern is at least one of an asymmetrical polarity pattern or an uneven polarity pattern. Such one-dimensional codes define at least one peak force and a plurality of off peak spatial forces corresponding to a plurality of alignments of said first and second field emission structures per code modulo, where a peak force is a spatial force produced when all aligned field emission sources produce an attractive force or all aligned field emission sources produce a repellant force and an off peak spatial force is a spatial force resulting from cancellation of at least one attractive force by at least one repellant force.

20 Claims, 43 Drawing Sheets

Peak to maximum off peak ratio is 3/1 because coding causes cancellation of attract and repel forces at off-alignment positions.

Related U.S. Application Data

12/479,013, filed on Jun. 5, 2009, now Pat. No. 7,839,247, which is a continuation-in-part of application No. 12/322,561, filed on Feb. 4, 2009, now Pat. No. 8,115,581, which is a continuation-in-part of application No. 12/358,423, filed on Jan. 23, 2009, now Pat. No. 7,868,721, which is a continuation-in-part of application No. 12/123,718, filed on May 20, 2008, now Pat. No. 7,800,471, said application No. 12/478,950 is a continuation-in-part of application No. 12/476,952, filed on Jun. 2, 2009, now Pat. No. 8,179,219, which is a continuation-in-part of application No. 12/322,561, which is a continuation-in-part of application No. 12/358,423, which is a continuation-in-part of application No. 12/123,718, said application No. 12/478,950 is a continuation-in-part of application No. 12/478,969, filed on Jun. 5, 2009, now Pat. No. 7,843,297, which is a continuation-in-part of application No. 12/475,952, filed on Jun. 1, 2009, which is a continuation-in-part of application No. 12/322,561, which is a continuation-in-part of application No. 12/358,423, which is a continuation-in-part of application No. 12/123,718, said application No. 12/479,013 is a continuation-in-part of application No. 12/476,952, which is a continuation-in-part of application No. 12/322,561, which is a continuation-in-part of application No. 12/358,423, which is a continuation-in-part of application No. 12/123,718.

(60) Provisional application No. 61/851,614, filed on Mar. 11, 2013, provisional application No. 61/744,342, filed on Sep. 24, 2012, provisional application No. 61/519,664, filed on May 25, 2011, provisional application No. 61/123,019, filed on Apr. 4, 2008.

(56) References Cited

U.S. PATENT DOCUMENTS

| | | | |
|---|---|---|---|
| 687,292 | A | 11/1901 | Armstrong |
| 996,933 | A | 7/1911 | Lindquist |
| 1,171,351 | A | 2/1916 | Neuland |
| 1,236,234 | A | 8/1917 | Troje |
| 2,243,555 | A | 5/1941 | Faus |
| 2,389,298 | A | 11/1945 | Ellis |
| 2,438,231 | A | 3/1948 | Schultz |
| 2,471,634 | A | 5/1949 | Vennice |
| 2,570,625 | A | 10/1951 | Zimmerman et al. |
| 2,722,617 | A | 11/1955 | Cluwen et al. |
| 2,932,545 | A | 4/1960 | Foley |
| 3,055,999 | A | 9/1962 | Lucas |
| 3,102,314 | A | 9/1963 | Alderfer |
| 3,208,296 | A | 9/1965 | Baermann |
| 3,238,399 | A | 3/1966 | Johanees et al. |
| 3,288,511 | A | 11/1966 | Tavano |
| 3,301,091 | A | 1/1967 | Reese |
| 3,382,386 | A | 5/1968 | Schlaeppi |
| 3,408,104 | A | 10/1968 | Raynes |
| 3,468,576 | A | 9/1969 | Beyer et al. |
| 3,474,366 | A | 10/1969 | Barney |
| 3,521,216 | A | 7/1970 | Tolegian |
| 3,645,650 | A | 2/1972 | Laing |
| 3,668,670 | A | 6/1972 | Andersen |
| 3,684,992 | A | 8/1972 | Huguet et al. |
| 3,696,258 | A | 10/1972 | Anderson et al. |
| 3,790,197 | A | 2/1974 | Parker |
| 3,791,309 | A | 2/1974 | Baermann |
| 3,802,034 | A | 4/1974 | Bookless |
| 3,803,433 | A | 4/1974 | Ingenito |
| 3,808,577 | A | 4/1974 | Mathauser |
| 3,845,430 | A | 10/1974 | Petkewicz et al. |
| 3,893,059 | A | 7/1975 | Nowak |
| 4,079,558 | A | 3/1978 | Gorham |
| 4,117,431 | A | 9/1978 | Eicher |
| 4,129,846 | A | 12/1978 | Yablochnikov |
| 4,209,905 | A | 7/1980 | Gillings |
| 4,222,489 | A | 9/1980 | Hutter |
| 4,296,394 | A | 10/1981 | Ragheb |
| 4,352,960 | A | 10/1982 | Dormer et al. |
| 4,355,236 | A | 10/1982 | Holsinger |
| 4,399,595 | A | 8/1983 | Yoon et al. |
| 4,416,127 | A | 11/1983 | Gomez-Olea Naveda |
| 4,453,294 | A | 6/1984 | Morita |
| 4,535,278 | A | 8/1985 | Asakawa |
| 4,547,756 | A | 10/1985 | Miller et al. |
| 4,629,131 | A | 12/1986 | Podell |
| 4,645,283 | A | 2/1987 | MacDonald et al. |
| 4,680,494 | A | 7/1987 | Grosjean |
| 4,764,743 | A | 8/1988 | Leupold et al. |
| 4,837,539 | A | 6/1989 | Baker |
| 4,849,749 | A | 7/1989 | Fukamachi et al. |
| 4,862,128 | A | 8/1989 | Leupold |
| H693 | H | 10/1989 | Leupold |
| 4,893,103 | A | 1/1990 | Leupold |
| 4,912,727 | A | 3/1990 | Schubert |
| 4,941,236 | A | 7/1990 | Sherman et al. |
| 4,956,625 | A | 9/1990 | Cardone et al. |
| 4,993,950 | A | 2/1991 | Mensor, Jr. |
| 4,994,778 | A | 2/1991 | Leupold |
| 4,996,457 | A | 2/1991 | Hawsey et al. |
| 5,013,949 | A | 5/1991 | Mabe, Jr. |
| 5,020,625 | A | 6/1991 | Yamauchi et al. |
| 5,050,276 | A | 9/1991 | Pemberton |
| 5,062,855 | A | 11/1991 | Rincoe |
| 5,123,843 | A | 6/1992 | Van der Zel et al. |
| 5,179,307 | A | 1/1993 | Porter |
| 5,213,307 | A | 5/1993 | Perrillat-Amede |
| 5,302,929 | A | 4/1994 | Kovacs |
| 5,309,680 | A | 5/1994 | Kiel |
| 5,345,207 | A | 9/1994 | Gebele |
| 5,367,891 | A | 11/1994 | Furuyama |
| 5,383,049 | A | 1/1995 | Carr |
| 5,394,132 | A | 2/1995 | Poil |
| 5,399,933 | A | 3/1995 | Tsai |
| 5,425,763 | A | 6/1995 | Stemmann |
| 5,440,997 | A | 8/1995 | Crowley |
| 5,461,386 | A | 10/1995 | Knebelkamp |
| 5,492,572 | A | 2/1996 | Schroeder et al. |
| 5,495,221 | A | 2/1996 | Post |
| 5,512,732 | A | 4/1996 | Yagnik et al. |
| 5,570,084 | A | 10/1996 | Ritter et al. |
| 5,582,522 | A | 12/1996 | Johnson |
| 5,604,960 | A | 2/1997 | Good |
| 5,631,093 | A | 5/1997 | Perry et al. |
| 5,631,618 | A | 5/1997 | Trumper et al. |
| 5,633,555 | A | 5/1997 | Ackermann et al. |
| 5,635,889 | A | 6/1997 | Stelter |
| 5,637,972 | A | 6/1997 | Randall et al. |
| 5,730,155 | A | 3/1998 | Allen |
| 5,742,036 | A | 4/1998 | Schramm, Jr. et al. |
| 5,759,054 | A | 6/1998 | Spadafore |
| 5,788,493 | A | 8/1998 | Tanaka et al. |
| 5,838,304 | A | 11/1998 | Hall |
| 5,852,393 | A | 12/1998 | Reznik et al. |
| 5,935,155 | A | 8/1999 | Humayun et al. |
| 5,956,778 | A | 9/1999 | Godoy |
| 5,983,406 | A | 11/1999 | Meyerrose |
| 6,039,759 | A | 3/2000 | Carpentier et al. |
| 6,047,456 | A | 4/2000 | Yao et al. |
| 6,072,251 | A | 6/2000 | Markle |
| 6,074,420 | A | 6/2000 | Eaton |
| 6,115,849 | A | 9/2000 | Meyerrose |
| 6,118,271 | A | 9/2000 | Ely et al. |
| 6,120,283 | A | 9/2000 | Cousins |
| 6,142,779 | A | 11/2000 | Siegel et al. |
| 6,170,131 | B1 | 1/2001 | Shin |
| 6,187,041 | B1 | 2/2001 | Garonzik |
| 6,205,012 | B1 | 3/2001 | Lear |
| 6,210,033 | B1 | 4/2001 | Karkos, Jr. et al. |

(56) References Cited

U.S. PATENT DOCUMENTS

| | | | |
|---|---|---|---|
| 6,224,374 | B1 | 5/2001 | Mayo |
| 6,234,833 | B1 | 5/2001 | Tsai et al. |
| 6,241,069 | B1 | 6/2001 | Mazur et al. |
| 6,273,918 | B1 | 8/2001 | Yuhasz et al. |
| 6,275,778 | B1 | 8/2001 | Shimada et al. |
| 6,285,097 | B1 | 9/2001 | Hazelton et al. |
| 6,387,096 | B1 | 5/2002 | Hyde, Jr. |
| 6,457,179 | B1 | 10/2002 | Prendergast |
| 6,467,326 | B1 | 10/2002 | Garrigus |
| 6,535,092 | B1 | 3/2003 | Hurley et al. |
| 6,540,515 | B1 | 4/2003 | Tanaka |
| 6,599,321 | B2 | 7/2003 | Hyde, Jr. |
| 6,607,304 | B1 | 8/2003 | Lake et al. |
| 6,652,278 | B2 | 11/2003 | Honkura et al. |
| 6,653,919 | B2 | 11/2003 | Shih-Chung et al. |
| 6,720,698 | B2 | 4/2004 | Galbraith |
| 6,747,537 | B1 | 6/2004 | Mosteller |
| 6,842,332 | B1 | 1/2005 | Rubenson et al. |
| 6,847,134 | B2 | 1/2005 | Frissen et al. |
| 6,850,139 | B1 | 2/2005 | Dettmann et al. |
| 6,862,748 | B2 | 3/2005 | Prendergast |
| 6,864,773 | B2 | 3/2005 | Perrin |
| 6,913,471 | B2 | 7/2005 | Smith |
| 6,927,657 | B1 | 8/2005 | Wu |
| 6,954,968 | B1 | 10/2005 | Sitbon |
| 6,971,147 | B2 | 12/2005 | Halstead |
| 7,016,492 | B2 | 3/2006 | Pan et al. |
| 7,031,160 | B2 | 4/2006 | Tillotson |
| 7,033,400 | B2 | 4/2006 | Currier |
| 7,038,565 | B1 | 5/2006 | Chell |
| 7,065,860 | B2 | 6/2006 | Aoki et al. |
| 7,066,739 | B2 | 6/2006 | McLeish |
| 7,066,778 | B2 | 6/2006 | Kretzschmar |
| 7,101,374 | B2 | 9/2006 | Hyde, Jr. |
| 7,137,727 | B2 | 11/2006 | Joseph et al. |
| 7,186,265 | B2 | 3/2007 | Sharkawy et al. |
| 7,224,252 | B2 | 5/2007 | Meadow, Jr. et al. |
| 7,264,479 | B1 | 9/2007 | Lee |
| 7,276,025 | B2 | 10/2007 | Roberts et al. |
| 7,339,790 | B2 | 3/2008 | Baker et al. |
| 7,362,018 | B1 | 4/2008 | Kulogo et al. |
| 7,381,181 | B2 | 6/2008 | Lau et al. |
| 7,402,175 | B2 | 7/2008 | Azar |
| 7,438,726 | B2 | 10/2008 | Erb |
| 7,444,683 | B2 | 11/2008 | Prendergast et al. |
| 7,453,341 | B1 | 11/2008 | Hildenbrand |
| 7,498,914 | B2 | 3/2009 | Miyashita et al. |
| 7,583,500 | B2 | 9/2009 | Ligtenberg et al. |
| 7,715,890 | B2 | 5/2010 | Kim et al. |
| 7,775,567 | B2 | 8/2010 | Ligtenberg et al. |
| 7,796,002 | B2 | 9/2010 | Hashimoto et al. |
| 7,808,349 | B2 | 10/2010 | Fullerton et al. |
| 7,812,697 | B2 | 10/2010 | Fullerton et al. |
| 7,817,004 | B2 | 10/2010 | Fullerton et al. |
| 7,832,897 | B2 | 11/2010 | Ku |
| 7,837,032 | B2 | 11/2010 | Smeltzer |
| 7,839,246 | B2 | 11/2010 | Fullerton et al. |
| 7,843,297 | B2 | 11/2010 | Fullerton et al. |
| 7,868,721 | B2 | 1/2011 | Fullerton et al. |
| 7,874,856 | B1 | 1/2011 | Schriefer et al. |
| 7,889,037 | B2 | 2/2011 | Cho |
| 7,903,397 | B2 | 3/2011 | McCoy |
| 7,905,626 | B2 | 3/2011 | Shantha et al. |
| 8,002,585 | B2 | 8/2011 | Zhou |
| 8,099,964 | B2 | 1/2012 | Saito et al. |
| 2002/0125977 | A1 | 9/2002 | VanZoest |
| 2003/0136837 | A1 | 7/2003 | Amon et al. |
| 2003/0170976 | A1 | 9/2003 | Molla et al. |
| 2003/0179880 | A1 | 9/2003 | Pan et al. |
| 2003/0187510 | A1 | 10/2003 | Hyde |
| 2004/0003487 | A1 | 1/2004 | Reiter |
| 2004/0155748 | A1 | 8/2004 | Steingroever |
| 2004/0244636 | A1 | 12/2004 | Meadow et al. |
| 2004/0251759 | A1 | 12/2004 | Hirzel |
| 2005/0102802 | A1 | 5/2005 | Sitbon et al. |
| 2005/0196484 | A1 | 9/2005 | Khoshnevis |
| 2005/0231046 | A1 | 10/2005 | Aoshima |
| 2005/0240263 | A1 | 10/2005 | Fogarty et al. |
| 2005/0263549 | A1 | 12/2005 | Scheiner |
| 2005/0283839 | A1 | 12/2005 | Cowburn |
| 2006/0066428 | A1 | 3/2006 | McCarthy et al. |
| 2006/0189259 | A1 | 8/2006 | Park et al. |
| 2006/0198047 | A1 | 9/2006 | Xue et al. |
| 2006/0198998 | A1 | 9/2006 | Raksha et al. |
| 2006/0214756 | A1 | 9/2006 | Elliott et al. |
| 2006/0290451 | A1 | 12/2006 | Prendergast et al. |
| 2006/0293762 | A1 | 12/2006 | Schulman et al. |
| 2007/0072476 | A1 | 3/2007 | Milan |
| 2007/0075594 | A1 | 4/2007 | Sadler |
| 2007/0103266 | A1 | 5/2007 | Wang et al. |
| 2007/0138806 | A1 | 6/2007 | Ligtenberg et al. |
| 2007/0255400 | A1 | 11/2007 | Parravicini et al. |
| 2008/0119250 | A1 | 5/2008 | Cho et al. |
| 2008/0139261 | A1 | 6/2008 | Cho et al. |
| 2008/0174392 | A1 | 7/2008 | Cho |
| 2008/0181804 | A1 | 7/2008 | Tanigawa et al. |
| 2008/0186683 | A1 | 8/2008 | Ligtenberg et al. |
| 2008/0218299 | A1 | 9/2008 | Arnold |
| 2008/0224806 | A1 | 9/2008 | Ogden et al. |
| 2008/0272868 | A1 | 11/2008 | Prendergast et al. |
| 2008/0282517 | A1 | 11/2008 | Claro |
| 2009/0021333 | A1 | 1/2009 | Fiedler |
| 2009/0209173 | A1 | 8/2009 | Arledge et al. |
| 2009/0250576 | A1 | 10/2009 | Fullerton et al. |
| 2009/0251256 | A1 | 10/2009 | Fullerton et al. |
| 2009/0254196 | A1 | 10/2009 | Cox et al. |
| 2009/0278642 | A1 | 11/2009 | Fullerton et al. |
| 2009/0289090 | A1 | 11/2009 | Fullerton et al. |
| 2009/0289749 | A1 | 11/2009 | Fullerton et al. |
| 2009/0292371 | A1 | 11/2009 | Fullerton et al. |
| 2010/0033280 | A1 | 2/2010 | Bird et al. |
| 2010/0126857 | A1 | 5/2010 | Polwart et al. |
| 2010/0167576 | A1 | 7/2010 | Zhou |
| 2011/0026203 | A1 | 2/2011 | Ligtenberg et al. |
| 2011/0085157 | A1 | 4/2011 | Bloss et al. |
| 2011/0101088 | A1 | 5/2011 | Marguerettaz et al. |
| 2011/0210636 | A1 | 9/2011 | Kuhlmann-Wilsdorf |
| 2011/0234344 | A1 | 9/2011 | Fullerton et al. |
| 2011/0248806 | A1 | 10/2011 | Michael |
| 2011/0279206 | A1 | 11/2011 | Fullerton et al. |
| 2012/0064309 | A1 | 3/2012 | Kwon et al. |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | A | 1/1938 |
| GB | 1 495 677 | A | 12/1977 |
| JP | S57-59908 | U | 4/1982 |
| JP | S57-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2008035676 | A | 2/2008 |
| JP | 2008165974 | A | 7/2008 |
| JP | 05-038123 | B2 | 10/2012 |
| WO | WO-02/31945 | A2 | 4/2002 |
| WO | WO-2007/081830 | A2 | 7/2007 |
| WO | WO 2007081830 | A2 * | 7/2007 |
| WO | WO-2009/124030 | A1 | 10/2009 |
| WO | WO-2010/141324 | A1 | 12/2010 |

OTHER PUBLICATIONS

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

BNS 33 Range, Magnetic safety sensors, Rectangular design, http://www.farnell.com/datasheets/36449.pdf, 3 pages, date unknown.

(56) References Cited

OTHER PUBLICATIONS

Boston Gear 221S-4, One-stage Helical Gearbox, http://www.bostongear.com/pdf/product_sections/200_series_helical.pdf, referenced Jun. 2010.
Charpentier et al., 2001, "Mechanical Behavior of Axially Magnetized Permanent-Magnet Gears", IEEE Transactions on Magnetics, vol. 37, No. 3, May 2001, p. 1110-17.
Chau et al., 2008, "Transient Analysis of Coaxial Magnetic Gears Using Finite Element Comodeling", Journal of Applied Physics, vol. 103.
Choi et al., 2010, "Optimization of Magnetization Directions in a 3-D Magnetic Structure", IEEE Transactions on Magnetics, vol. 46, No. 6, Jun. 2010, p. 1603-06.
Correlated Magnetics Research, 2009, Online Video, "Innovative Magnetics Research in Huntsville", http://www.youtube.com/watch?v=m4m81JjZCJo.
Correlated Magnetics Research, 2009, Online Video, "Non-Contact Attachment Utilizing Permanent Magnets", http://www.youtube.com/watch?v=3xUm25CNNgQ.
Correlated Magnetics Research, 2010, Company Website, http://www.correlatedmagnetics.com.
Furlani 1996, "Analysis and optimization of synchronous magnetic couplings", J. Appl. Phys., vol. 79, No. 8, p. 4692.
Furlani 2001, "Permanent Magnet and Electromechanical Devices", Academic Press, San Diego.
Furlani, E.P., 2000, "Analytical analysis of magnetically coupled multipole cylinders", J. Phys. D: Appl. Phys., vol. 33, No. 1, p. 28-33.
General Electric DP 2.7 Wind Turbine Gearbox, http://www.gedrivetrain.com/insideDP27.cfm, referenced Jun. 2010.
Ha et al., 2002, "Design and Characteristic Analysis of Non-Contact Magnet Gear for Conveyor by Using Permanent Magnet", Conf. Record of the 2002 IEEE Industry Applications Conference, p. 1922-27.
Huang et al., 2008, "Development of a Magnetic Planetary Gearbox", IEEE Transactions on Magnetics, vol. 44, No. 3, p. 403-12.
International Search Report and Written Opinion dated Jun. 1, 2009, directed to counterpart application No. PCT/US2009/002027. (10 pages).
International Search Report and Written Opinion of the International Searching Authority issued in Application No. PCT/US12/61938 dated Feb. 26, 2013.
International Search Report and Written Opinion of the International Searching Authority issued in Application No. PCT/US2013/028095 dated May 13, 2013.
International Search Report and Written Opinion of the International Searching Authority issued in Application No. PCT/US2013/047986 dated Nov. 21, 2013.
International Search Report and Written Opinion, dated Apr. 8, 2011 issued in related International Application No. PCT/US2010/049410.
International Search Report and Written Opinion, dated Aug. 18, 2010, issued in related International Application No. PCT/US2010/036443.
International Search Report and Written Opinion, dated Jul. 13, 2010, issued in related International Application No. PCT/US2010/021612.
International Search Report and Written Opinion, dated May 14, 2009, issued in related International Application No. PCT/US2009/038925.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Kim, "A future cost trends of magnetizer systems in Korea", Industrial Electronics, Control, and Instrumentation, 1996, vol. 2, Aug. 5, 1996, pp. 991-996.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-547.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
MI, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Series BNS, Compatible Series AES Safety Controllers, http://www.schmersalusa.com/safety_controllers/drawings/aes.pdf, pp. 159-175, date unknown.
Series BNS-B20, Coded-Magnet Sensorr Safety Door Handle, http://www.schmersalusa.com/catalog_pdfs/BNS_B20.pdf, 2pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/246,584 dated May 16, 2013.
United States Office Action issued in U.S. Appl. No. 13/246,584 dated Oct. 15, 2013.
United States Office Action issued in U.S. Appl. No. 13/374,074 dated Feb. 21, 2013.
United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,271.
United States Office Action, dated Feb. 2, 2011, issued in counterpart U.S. Appl. No. 12/476,952.

(56) References Cited

OTHER PUBLICATIONS

United States Office Action, dated Mar. 12, 2012, issued in counterpart U.S. Appl. No. 12/206,271.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.
Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.

* cited by examiner

Amount of force is a linear function of the amount of spatial alignment from zero alignment to complete alignment to zero alignment.

Peak to maximum off peak ratio is 3/1 because coding causes cancellation of attract and repel forces at off-alignment positions.

Peak attract to peak repel is 3/1 ratio. Off peaks are both -1. Therefore, there is an attract force rotational alignment and constant repel force alignments.

Peak to maximum off peak ratio is 4/1. Side lobes of +1, 0, and -1.

Peak attract is 4 and all off peaks are zero. Therefore, there is an attract alignment and zero force alignments.

Spatial Alignment

Peak to maximum off peak ratio is 4/1. Side lobes of +1, 0, and -1.

Peak to maximum off peak ratio is 5/1. Side lobes of 0 and +1.

Peak to maximum off peak ratio is 5/1. Off peaks are all +1.
Therefore, there is some attract force for every rotational alignment.

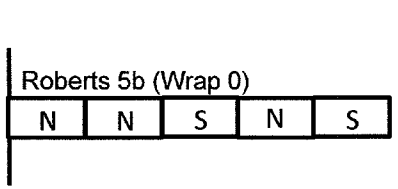
FIG. 20F
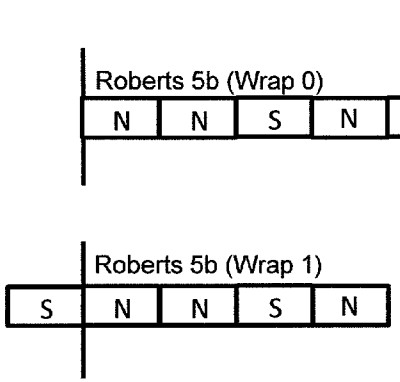
FIG. 20G
FIG. 20H
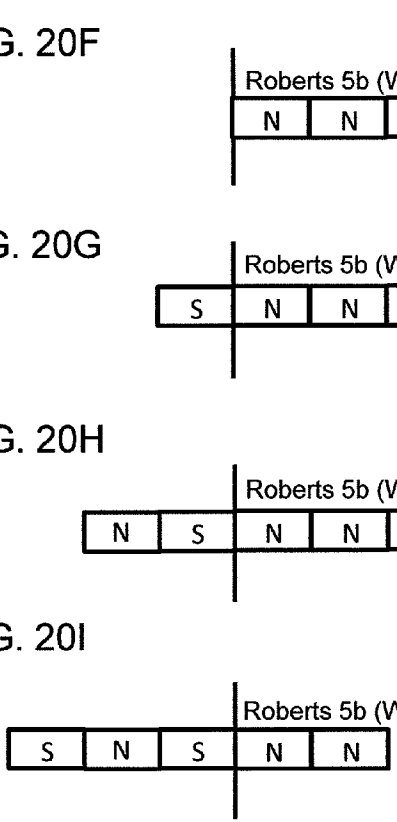
FIG. 20I
FIG. 20J
FIG. 21F
FIG. 21G
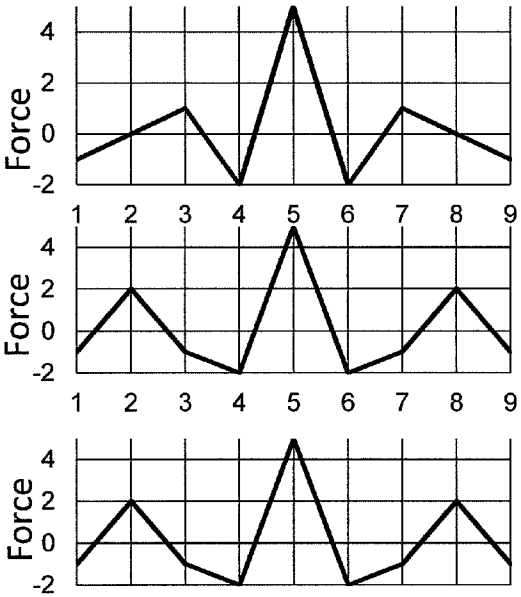
FIG. 21H
FIG. 21I
FIG. 21J

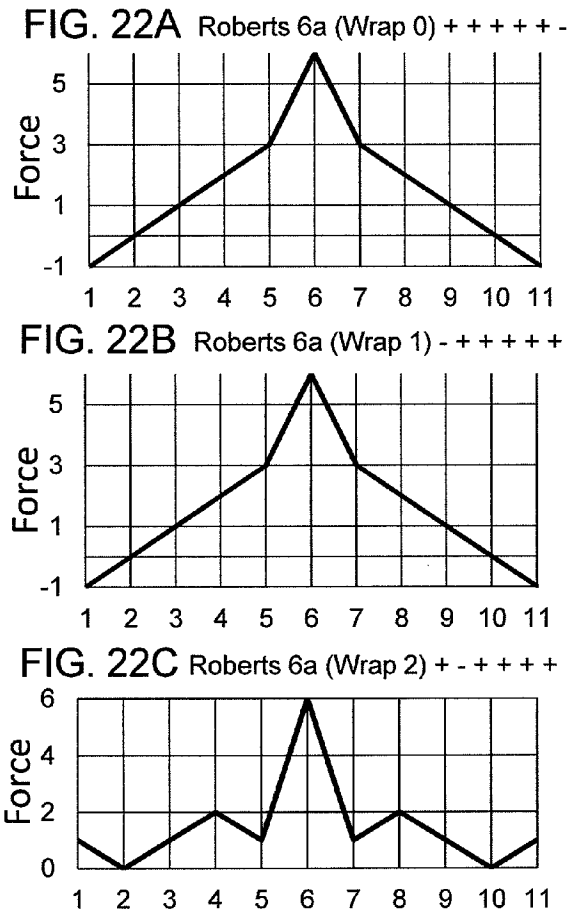
FIG. 22A Roberts 6a (Wrap 0) + + + + + -
FIG. 22B Roberts 6a (Wrap 1) - + + + + +
FIG. 22C Roberts 6a (Wrap 2) + - + + + +
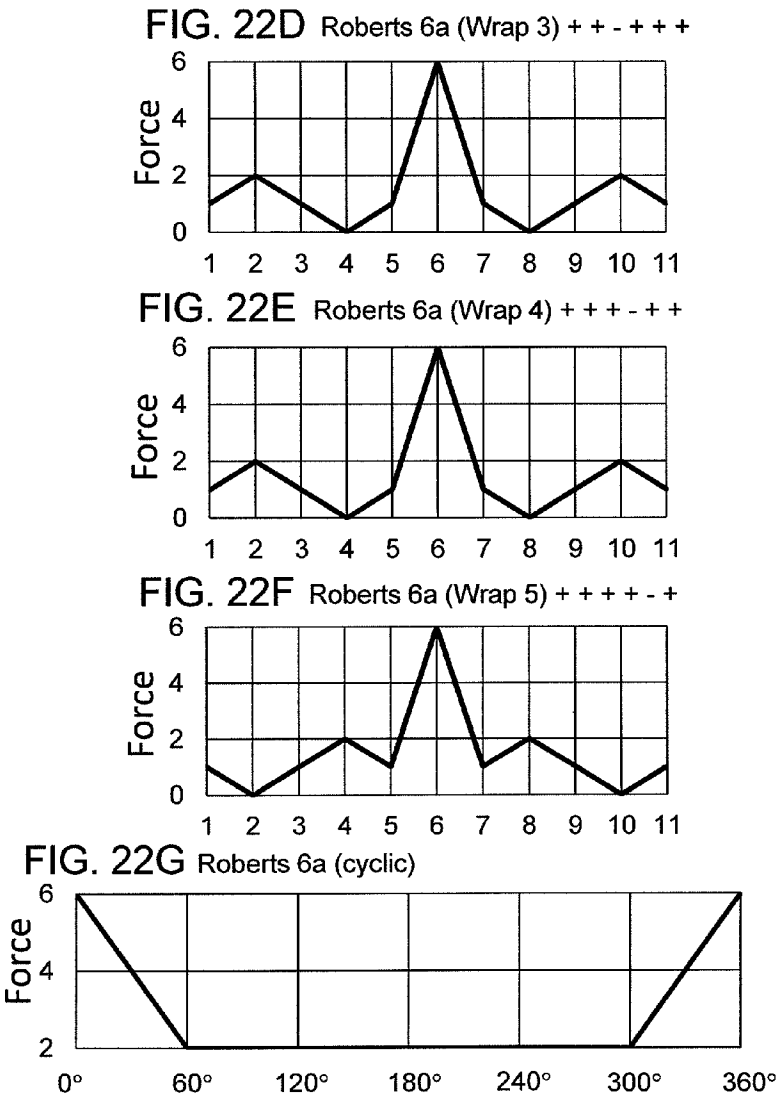
FIG. 22D Roberts 6a (Wrap 3) + + - + + +
FIG. 22E Roberts 6a (Wrap 4) + + + - + +
FIG. 22F Roberts 6a (Wrap 5) + + + + - +
FIG. 22G Roberts 6a (cyclic)

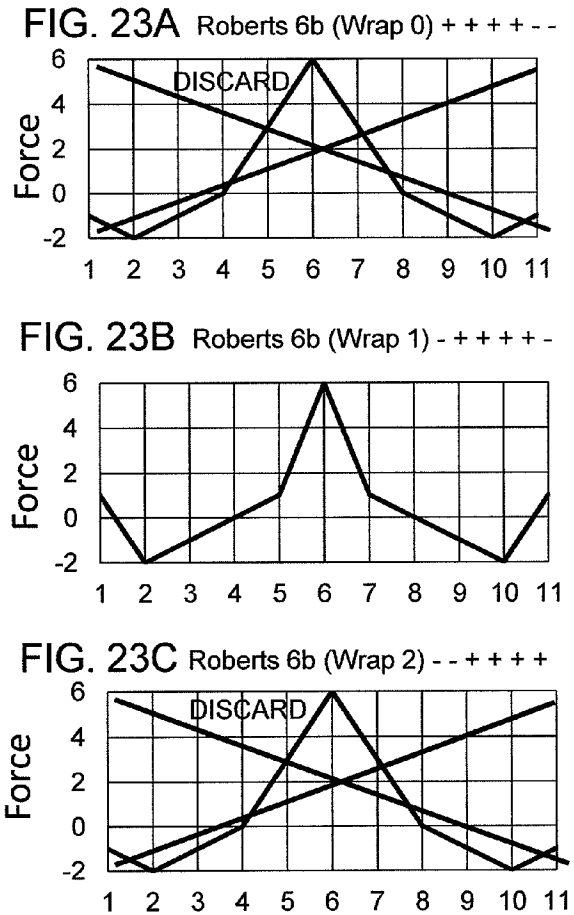
FIG. 23A Roberts 6b (Wrap 0) + + + + - -
FIG. 23B Roberts 6b (Wrap 1) - + + + + -
FIG. 23C Roberts 6b (Wrap 2) - - + + + +
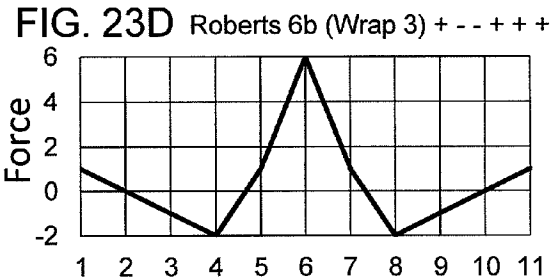
FIG. 23D Roberts 6b (Wrap 3) + - - + + +
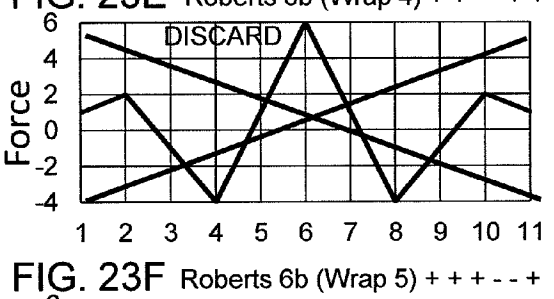
FIG. 23E Roberts 6b (Wrap 4) + + - - + +
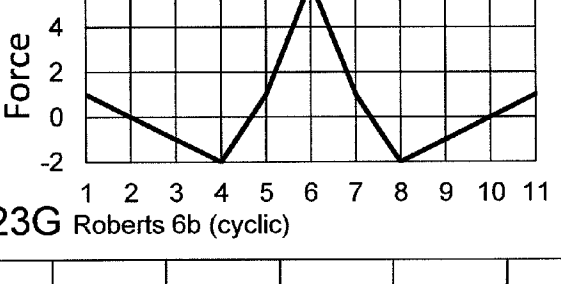
FIG. 23F Roberts 6b (Wrap 5) + + + - - +
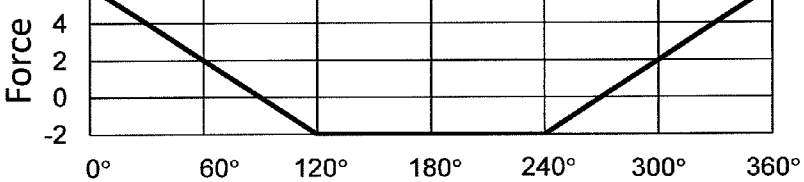
FIG. 23G Roberts 6b (cyclic)

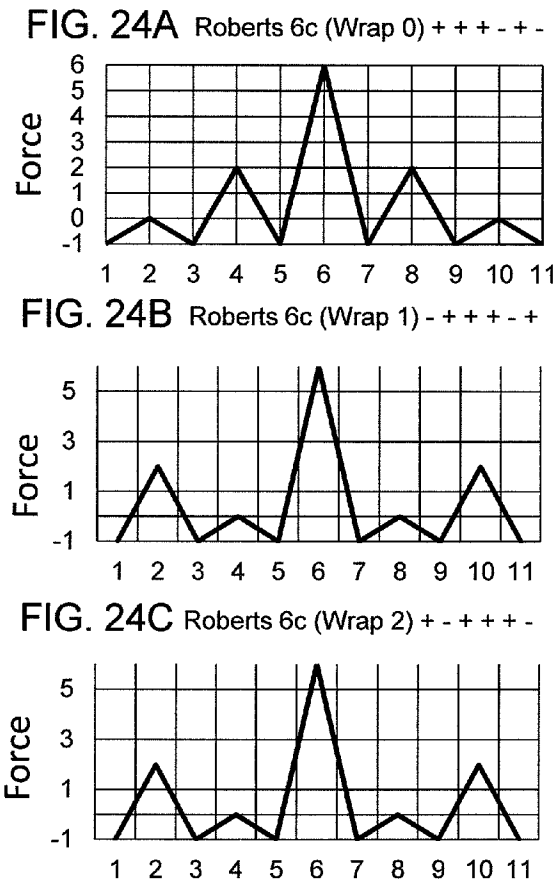
FIG. 24A Roberts 6c (Wrap 0) + + + - + -
FIG. 24B Roberts 6c (Wrap 1) - + + + - +
FIG. 24C Roberts 6c (Wrap 2) + - + + + -
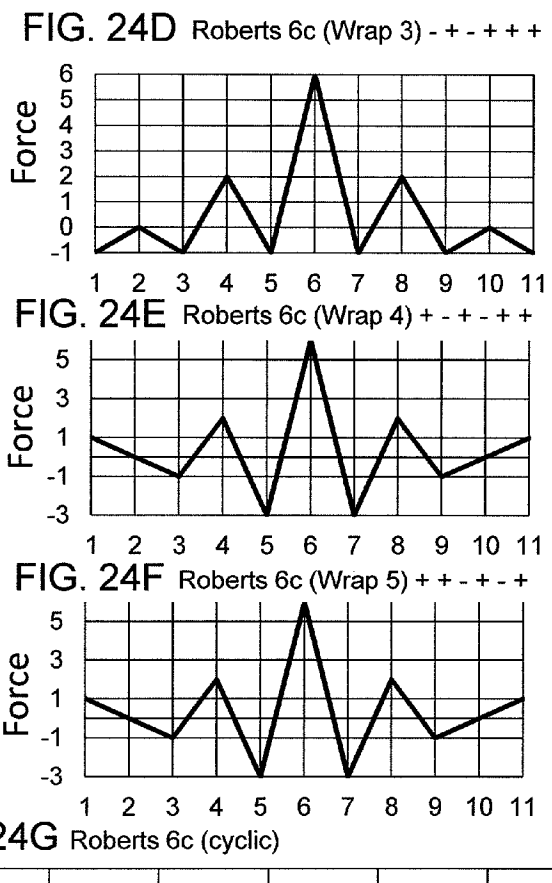
FIG. 24D Roberts 6c (Wrap 3) - + - + + +
FIG. 24E Roberts 6c (Wrap 4) + - + - + +
FIG. 24F Roberts 6c (Wrap 5) + + - + - +
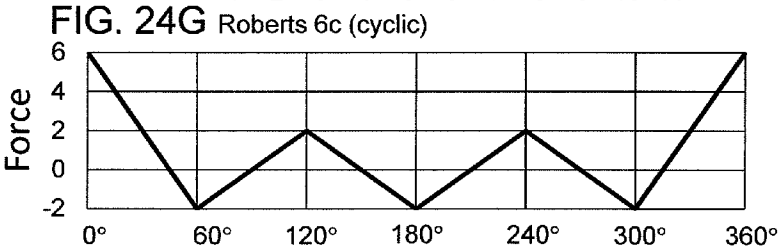
FIG. 24G Roberts 6c (cyclic)

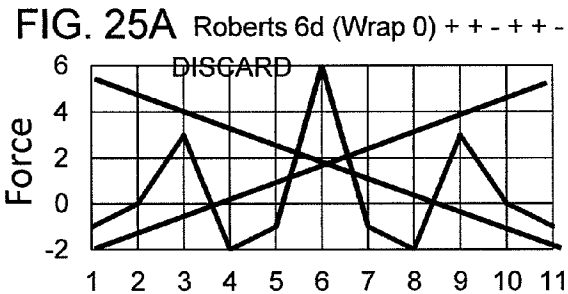
FIG. 25A Roberts 6d (Wrap 0) + + - + + -
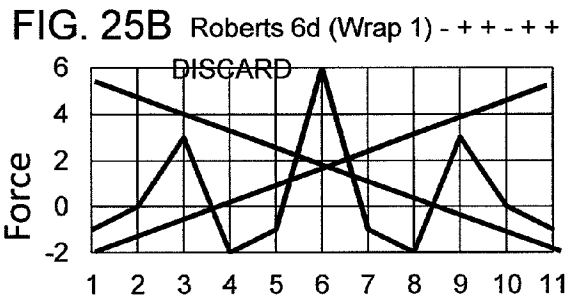
FIG. 25B Roberts 6d (Wrap 1) - + + - + +
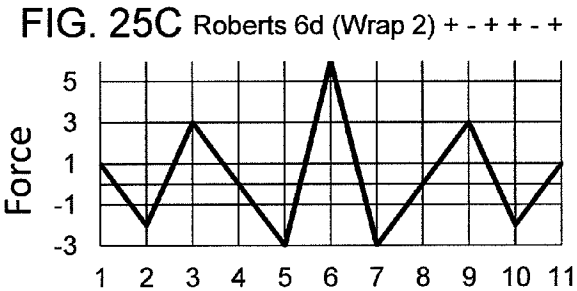
FIG. 25C Roberts 6d (Wrap 2) + - + + - +
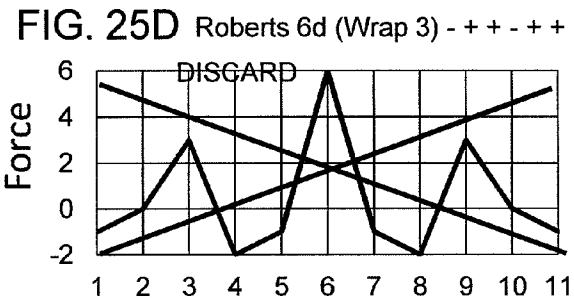
FIG. 25D Roberts 6d (Wrap 3) - + + - + +
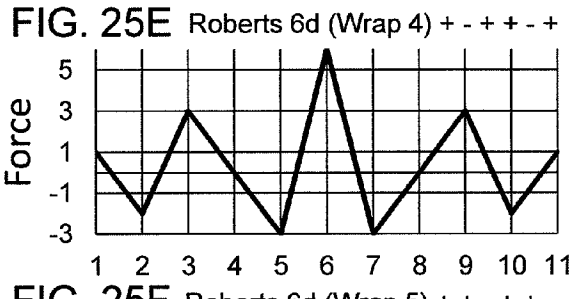
FIG. 25E Roberts 6d (Wrap 4) + - + + - +
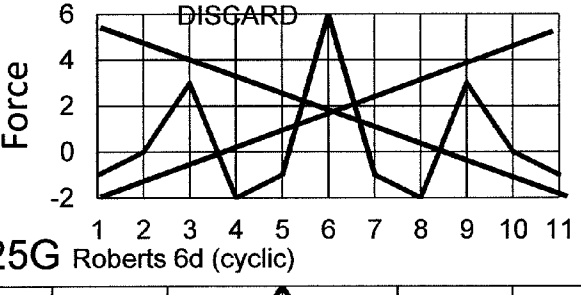
FIG. 25F Roberts 6d (Wrap 5) + + - + + -
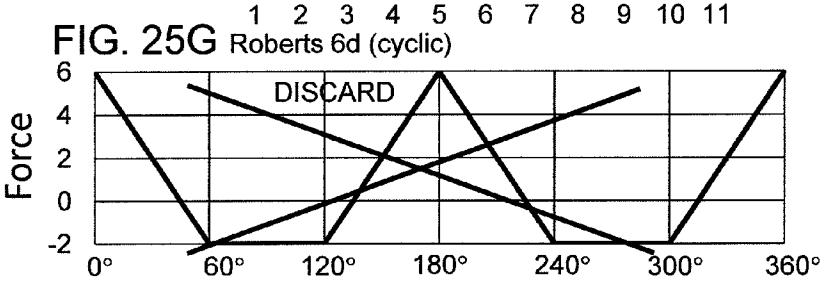
FIG. 25G Roberts 6d (cyclic)

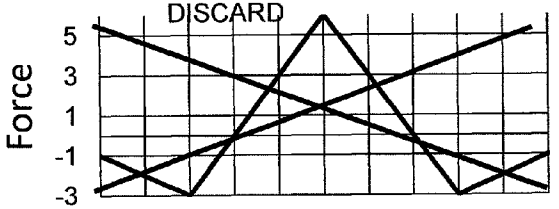
FIG. 26A Roberts 6e (Wrap 0) + + + - - -
FIG. 26B Roberts 6e (Wrap 1) - + + + - -
FIG. 26C Roberts 6e (Wrap 2) - - + + + -
FIG. 26D Roberts 6e (Wrap 3) - - - + + +
FIG. 26E Roberts 6e (Wrap 4) + - - - + +
FIG. 26F Roberts 6e (Wrap 5) + + - - - +
FIG. 26G Roberts 6e (cyclic)

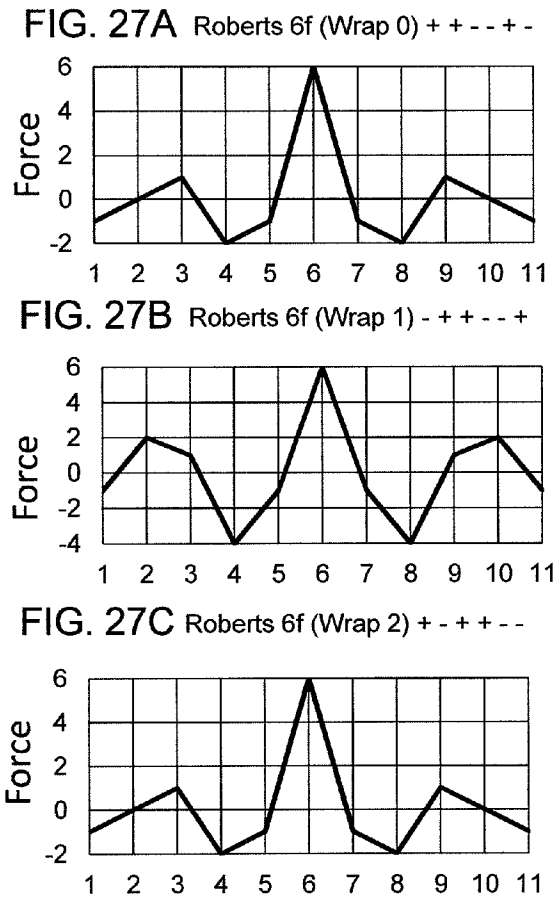
FIG. 27A Roberts 6f (Wrap 0) + + - - + -
FIG. 27B Roberts 6f (Wrap 1) - + + - - +
FIG. 27C Roberts 6f (Wrap 2) + - + + - -
FIG. 27D Roberts 6f (Wrap 3) - + - + + -
FIG. 27E Roberts 6f (Wrap 4) - - + - + +
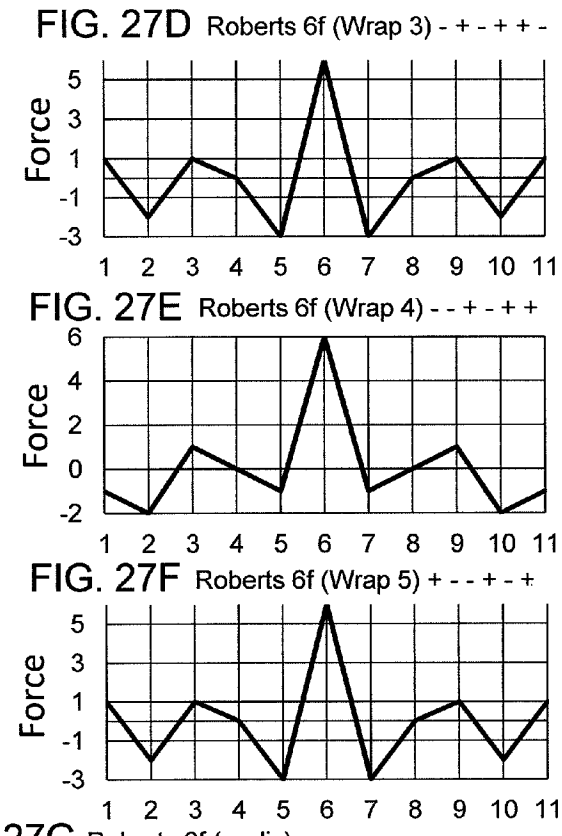
FIG. 27F Roberts 6f (Wrap 5) + - - + - +
FIG. 27G Roberts 6f (cyclic)

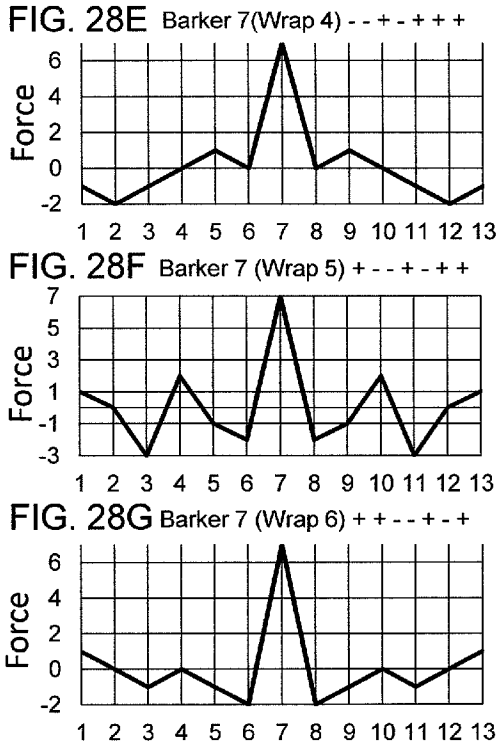
FIG. 28A Barker 7 (Wrap 0) + + + - - + -
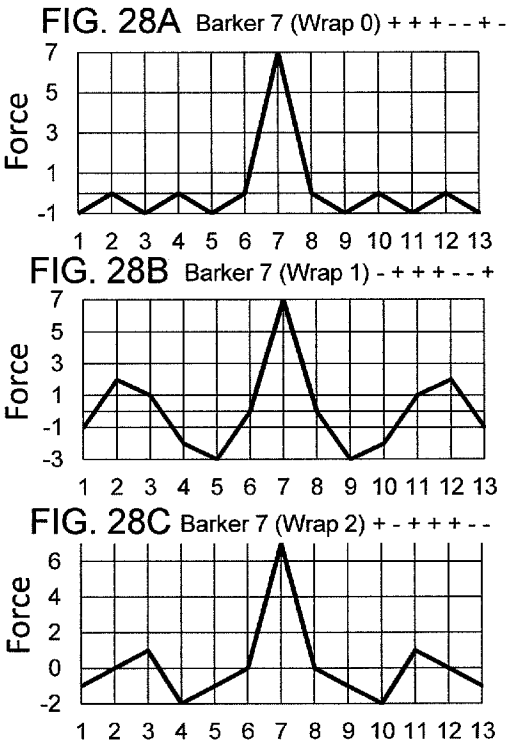
FIG. 28B Barker 7 (Wrap 1) - + + + - - +
FIG. 28C Barker 7 (Wrap 2) + - + + + - -
FIG. 28D Barker 7 (Wrap 3) - + - + + + -
FIG. 28E Barker 7(Wrap 4) - - + - + + +
FIG. 28F Barker 7 (Wrap 5) + - - + - + +
FIG. 28G Barker 7 (Wrap 6) + + - - + - +

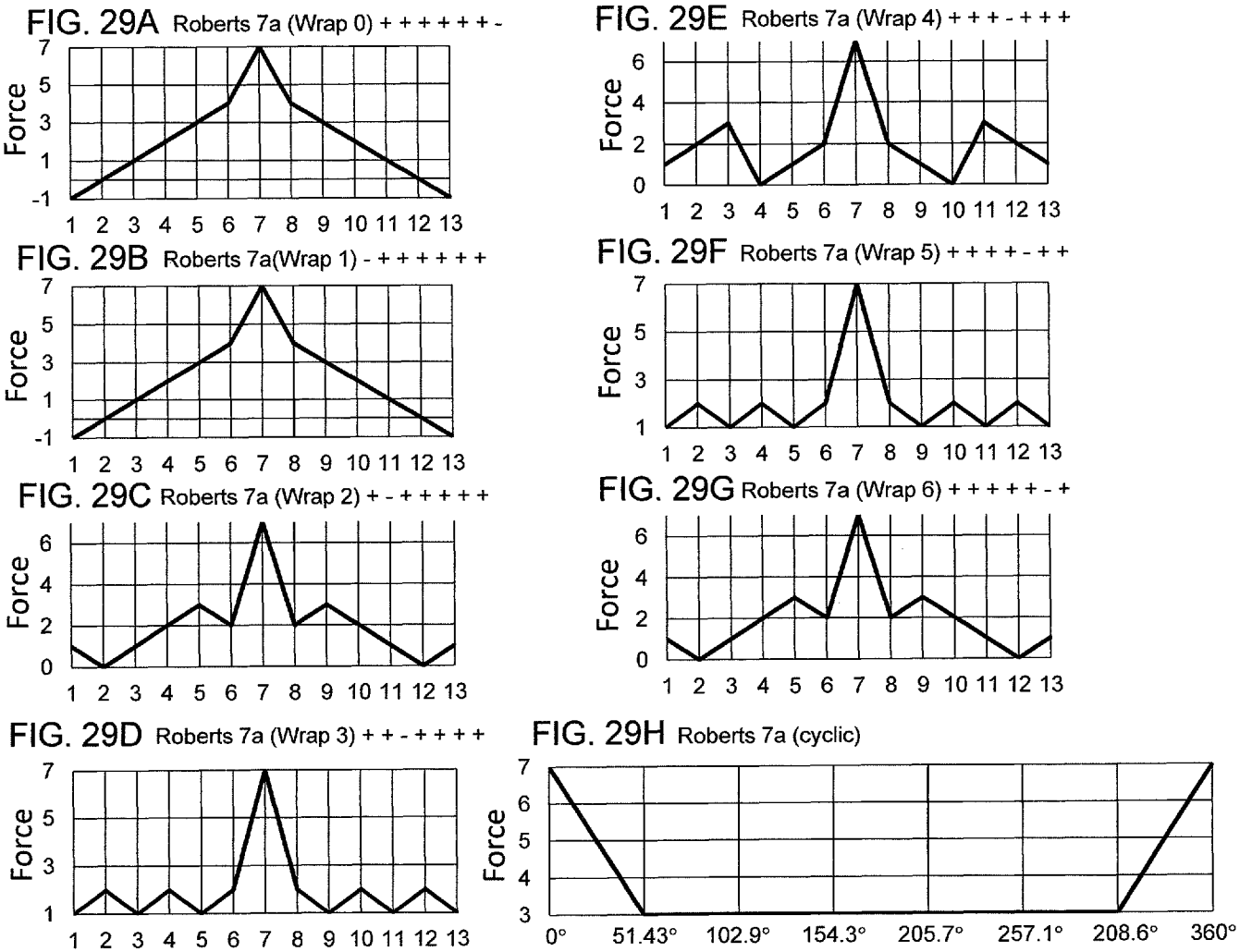
FIG. 29A Roberts 7a (Wrap 0) + + + + + + -
FIG. 29B Roberts 7a(Wrap 1) - + + + + + +
FIG. 29C Roberts 7a (Wrap 2) + - + + + + +
FIG. 29D Roberts 7a (Wrap 3) + + - + + + +
FIG. 29E Roberts 7a (Wrap 4) + + + - + + +
FIG. 29F Roberts 7a (Wrap 5) + + + + - + +
FIG. 29G Roberts 7a (Wrap 6) + + + + + - +
FIG. 29H Roberts 7a (cyclic)

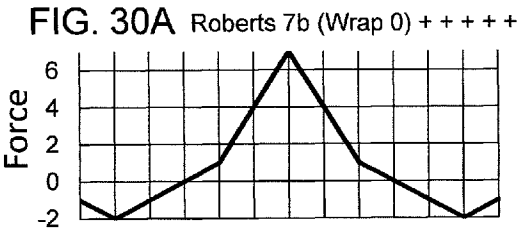
FIG. 30A Roberts 7b (Wrap 0) + + + + + - -
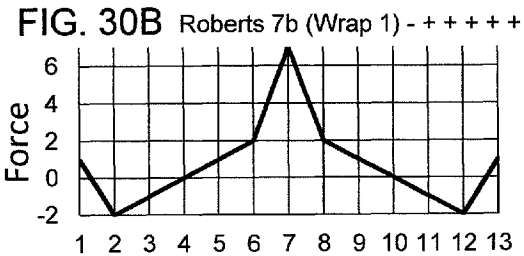
FIG. 30B Roberts 7b (Wrap 1) - + + + + + -
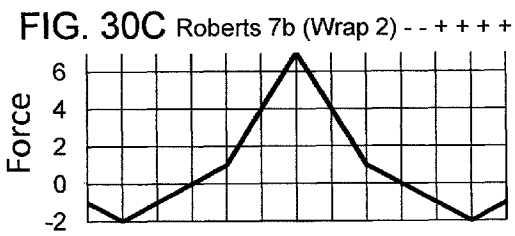
FIG. 30C Roberts 7b (Wrap 2) - - + + + + +
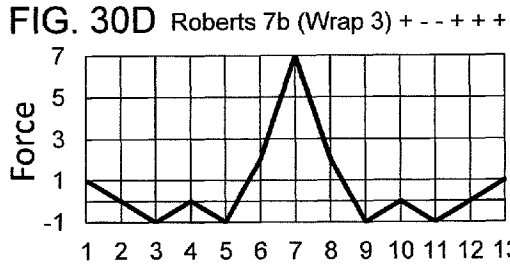
FIG. 30D Roberts 7b (Wrap 3) + - - + + + +
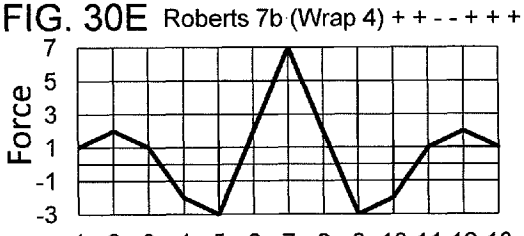
FIG. 30E Roberts 7b (Wrap 4) + + - - + + +
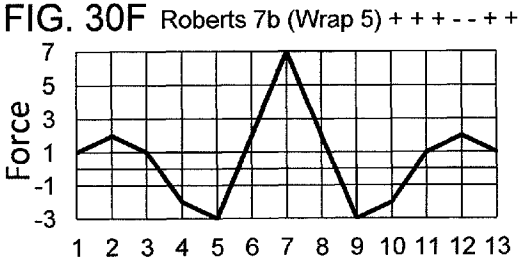
FIG. 30F Roberts 7b (Wrap 5) + + + - - + +
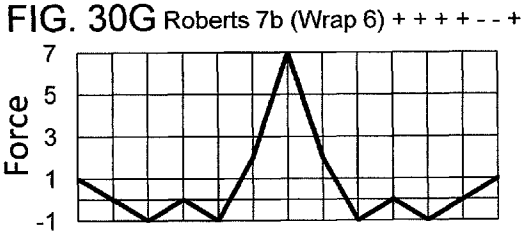
FIG. 30G Roberts 7b (Wrap 6) + + + + - - +
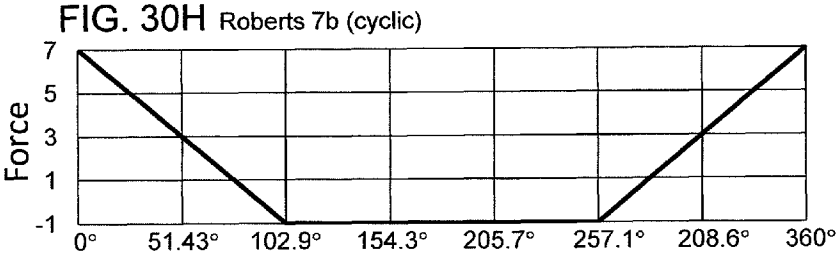
FIG. 30H Roberts 7b (cyclic)

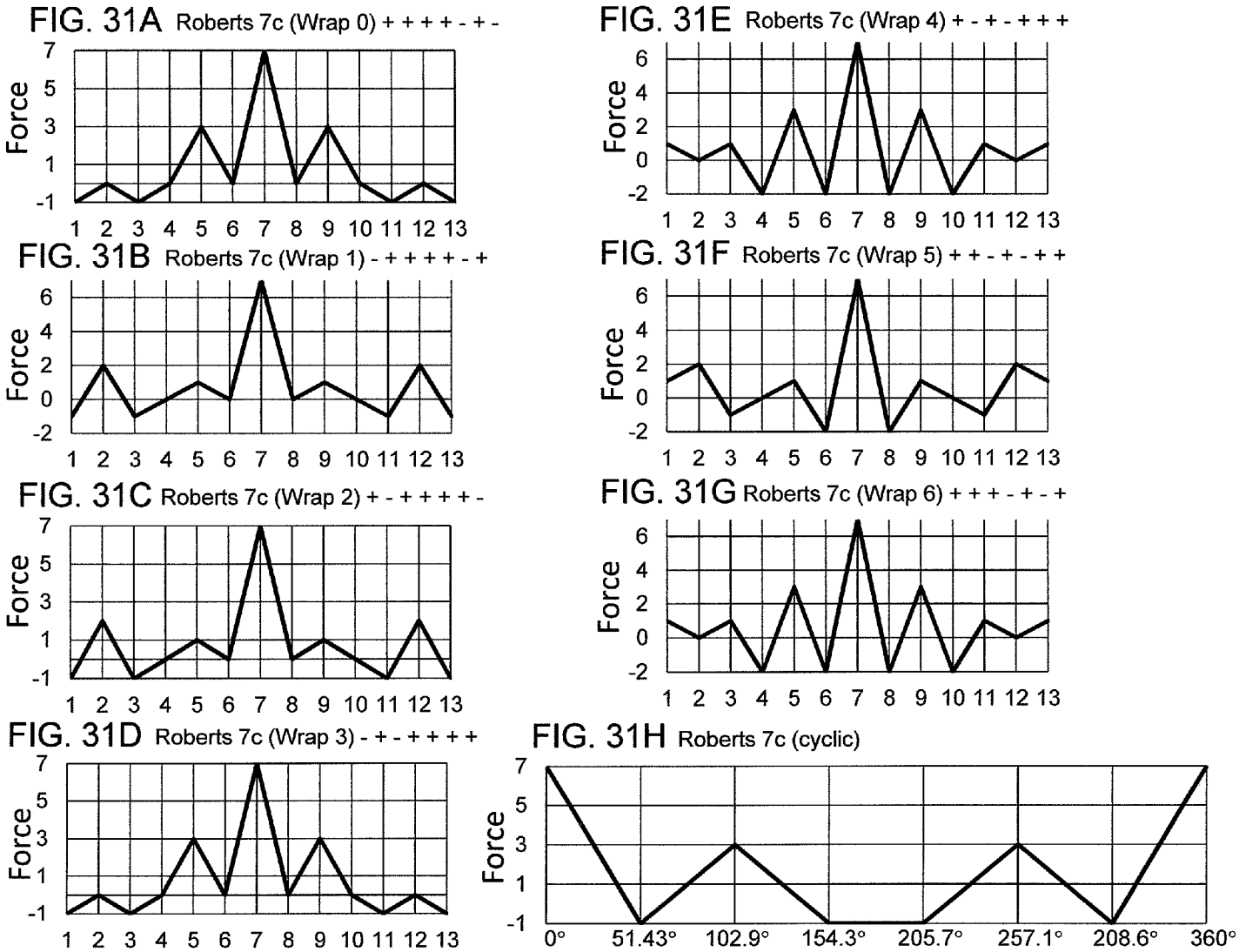
FIG. 31A Roberts 7c (Wrap 0) + + + + - + -
FIG. 31B Roberts 7c (Wrap 1) - + + + + - +
FIG. 31C Roberts 7c (Wrap 2) + - + + + + -
FIG. 31D Roberts 7c (Wrap 3) - + - + + + +
FIG. 31E Roberts 7c (Wrap 4) + - + - + + +
FIG. 31F Roberts 7c (Wrap 5) + + - + - + +
FIG. 31G Roberts 7c (Wrap 6) + + + - + - +
FIG. 31H Roberts 7c (cyclic)

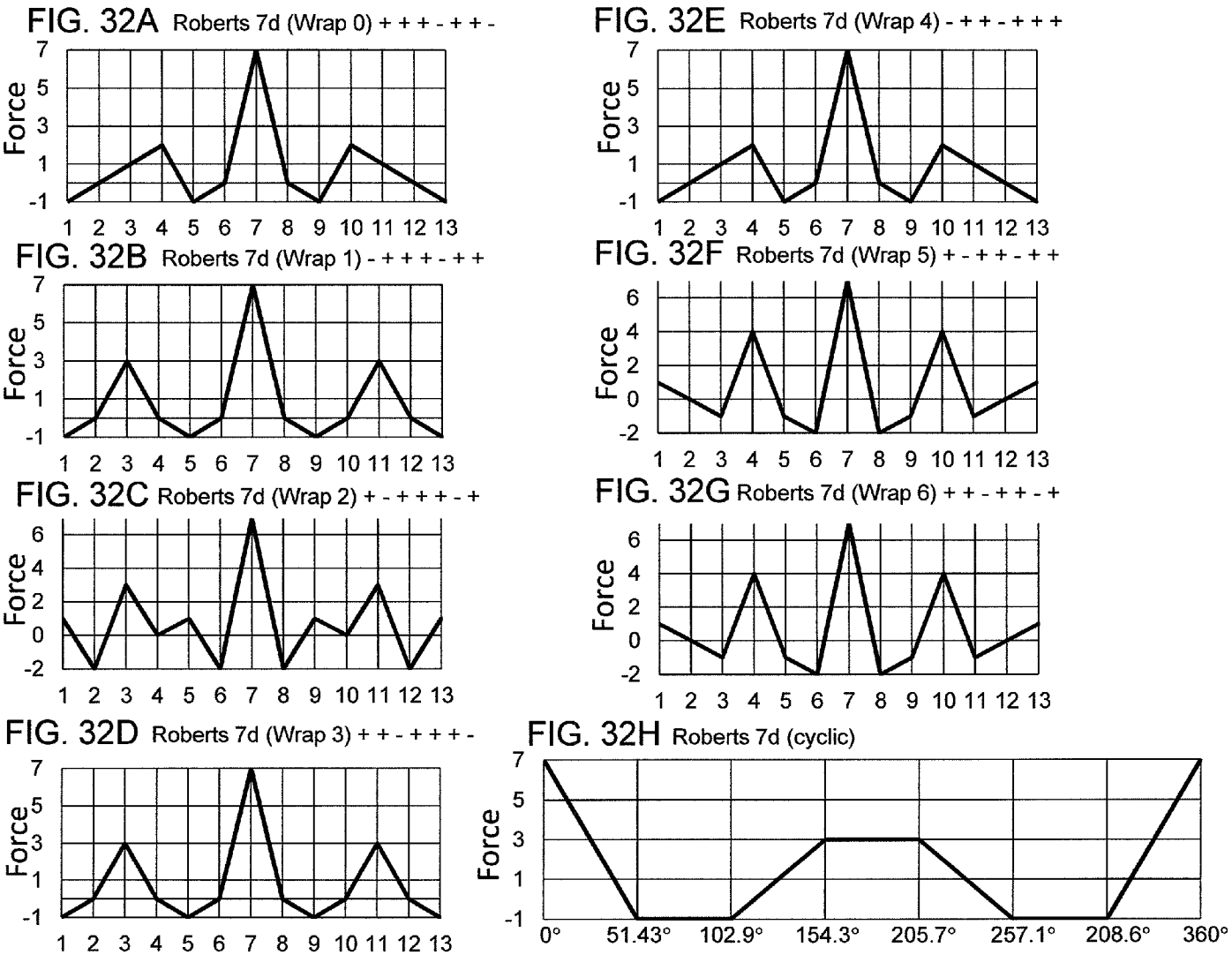
FIG. 32A Roberts 7d (Wrap 0) + + + - + + -
FIG. 32B Roberts 7d (Wrap 1) - + + + - + +
FIG. 32C Roberts 7d (Wrap 2) + - + + + - +
FIG. 32D Roberts 7d (Wrap 3) + + - + + + -
FIG. 32E Roberts 7d (Wrap 4) - + + - + + +
FIG. 32F Roberts 7d (Wrap 5) + - + + - + +
FIG. 32G Roberts 7d (Wrap 6) + + - + + - +
FIG. 32H Roberts 7d (cyclic)

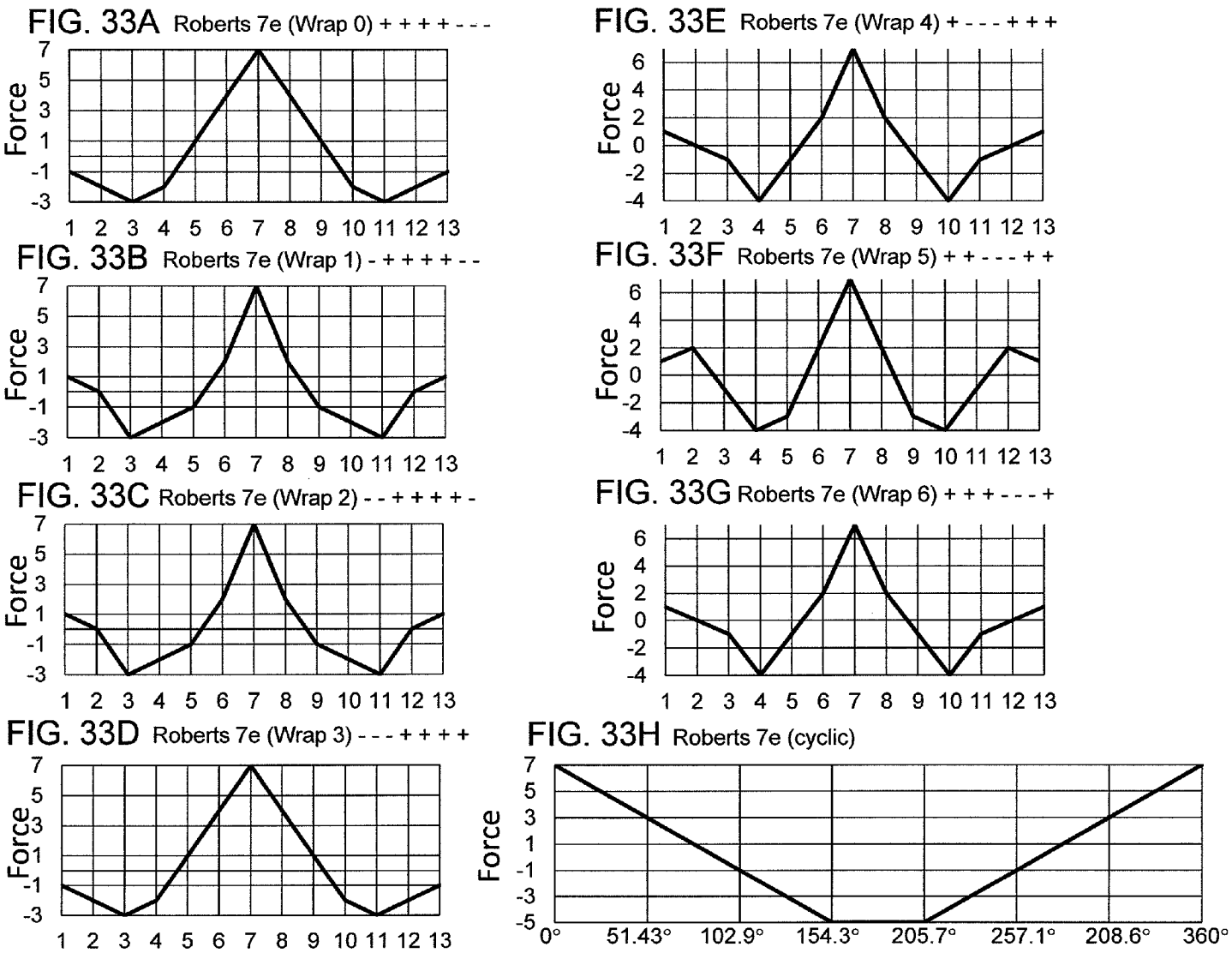
FIG. 33A Roberts 7e (Wrap 0) + + + + - - -
FIG. 33B Roberts 7e (Wrap 1) - + + + + - -
FIG. 33C Roberts 7e (Wrap 2) - - + + + + -
FIG. 33D Roberts 7e (Wrap 3) - - - + + + +
FIG. 33E Roberts 7e (Wrap 4) + - - - + + +
FIG. 33F Roberts 7e (Wrap 5) + + - - - + +
FIG. 33G Roberts 7e (Wrap 6) + + + - - - +
FIG. 33H Roberts 7e (cyclic)

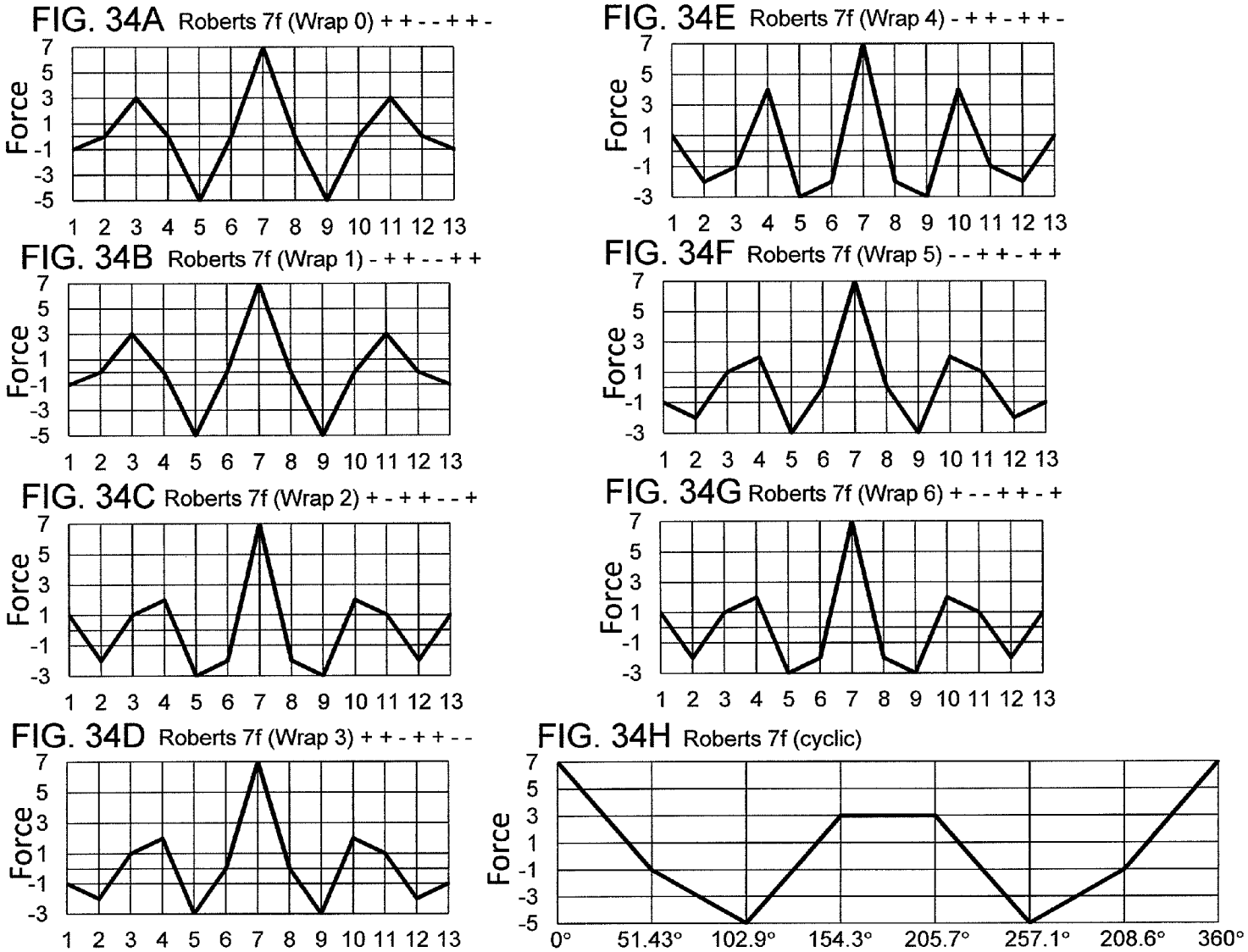
FIG. 34A Roberts 7f (Wrap 0) + + - - + + -
FIG. 34B Roberts 7f (Wrap 1) - + + - - + +
FIG. 34C Roberts 7f (Wrap 2) + - + + - - +
FIG. 34D Roberts 7f (Wrap 3) + + - + + - -
FIG. 34E Roberts 7f (Wrap 4) - + + - + + -
FIG. 34F Roberts 7f (Wrap 5) - - + + - + +
FIG. 34G Roberts 7f (Wrap 6) + - - + + - +
FIG. 34H Roberts 7f (cyclic)

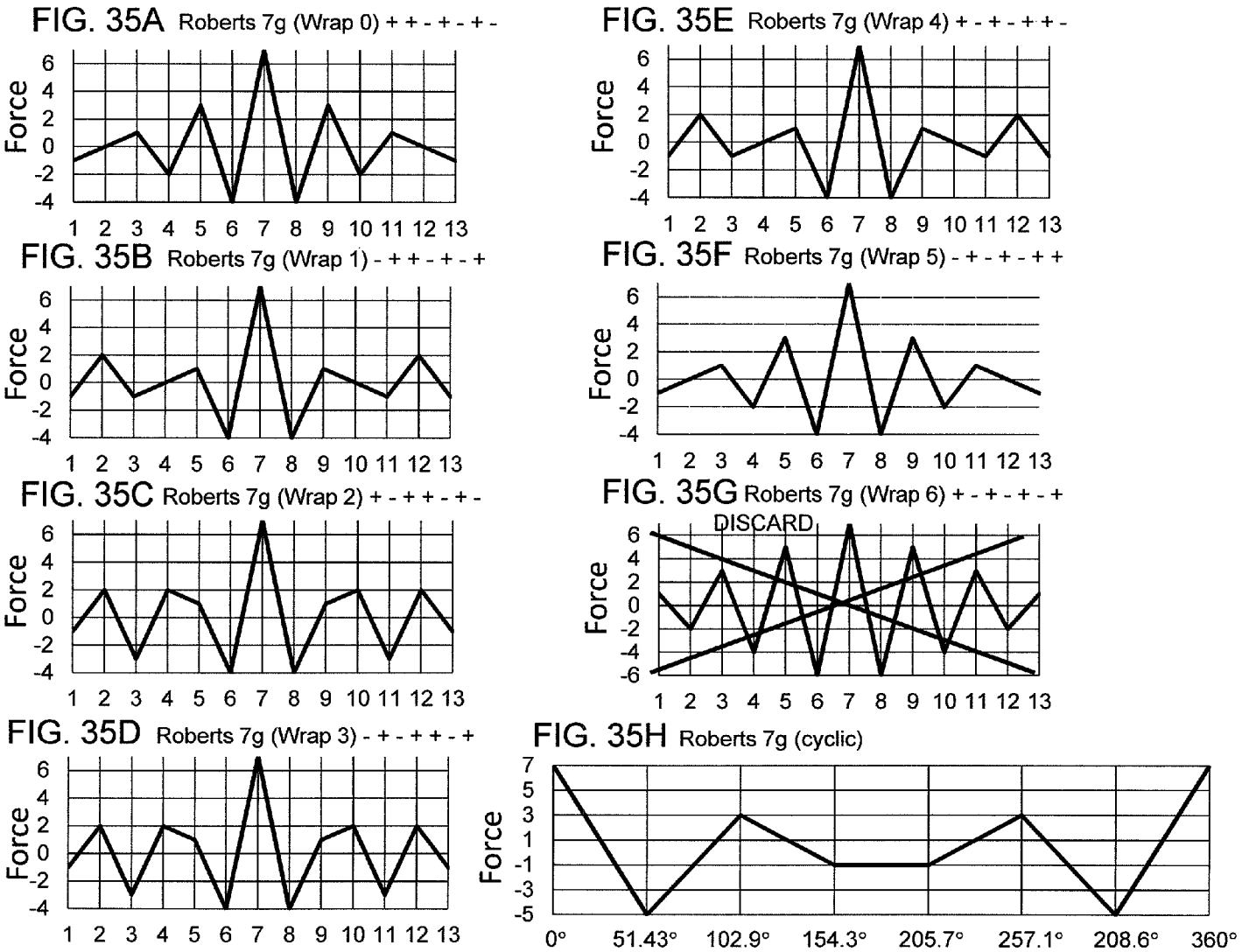
FIG. 35A Roberts 7g (Wrap 0) + + - + - + -
FIG. 35B Roberts 7g (Wrap 1) - + + - + - +
FIG. 35C Roberts 7g (Wrap 2) + - + + - + -
FIG. 35D Roberts 7g (Wrap 3) - + - + + - +
FIG. 35E Roberts 7g (Wrap 4) + - + - + + -
FIG. 35F Roberts 7g (Wrap 5) - + - + - + +
FIG. 35G Roberts 7g (Wrap 6) + - + - + - +
FIG. 35H Roberts 7g (cyclic)

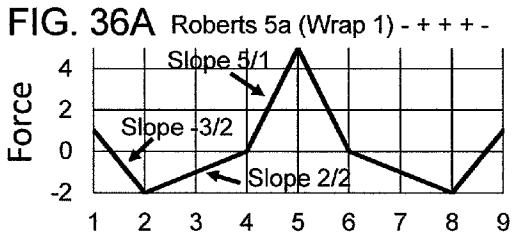
FIG. 36A Roberts 5a (Wrap 1) - + + + -
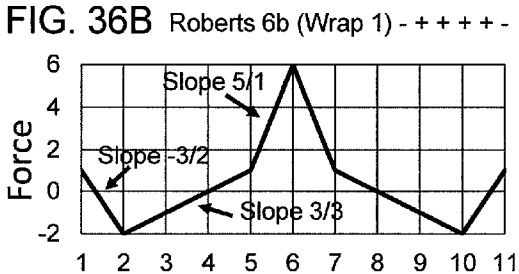
FIG. 36B Roberts 6b (Wrap 1) - + + + -
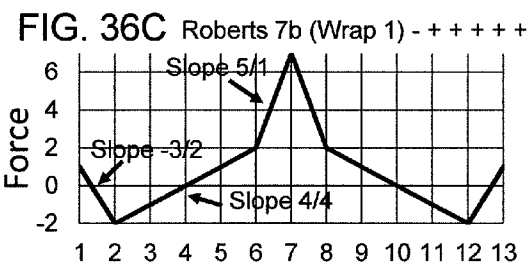
FIG. 36C Roberts 7b (Wrap 1) - + + + + -
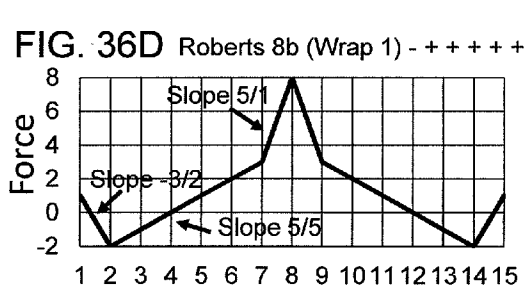
FIG. 36D Roberts 8b (Wrap 1) - + + + + + -
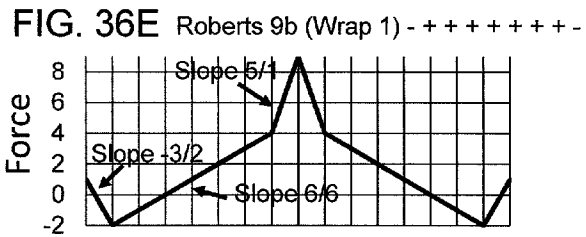
FIG. 36E Roberts 9b (Wrap 1) - + + + + + + -
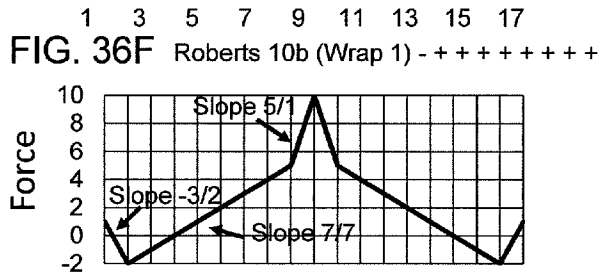
FIG. 36F Roberts 10b (Wrap 1) - + + + + + + + -
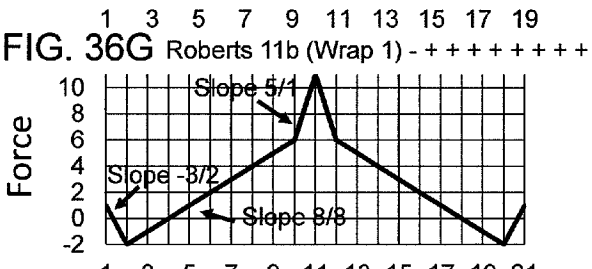
FIG. 36G Roberts 11b (Wrap 1) - + + + + + + + + -
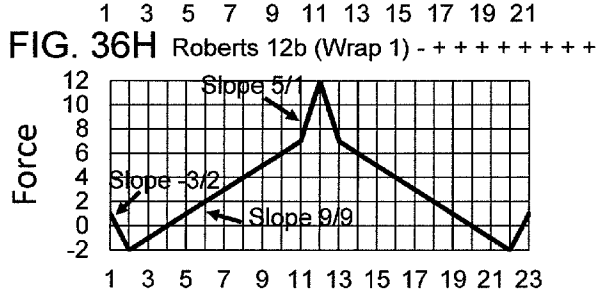
FIG. 36H Roberts 12b (Wrap 1) - + + + + + + + + + -

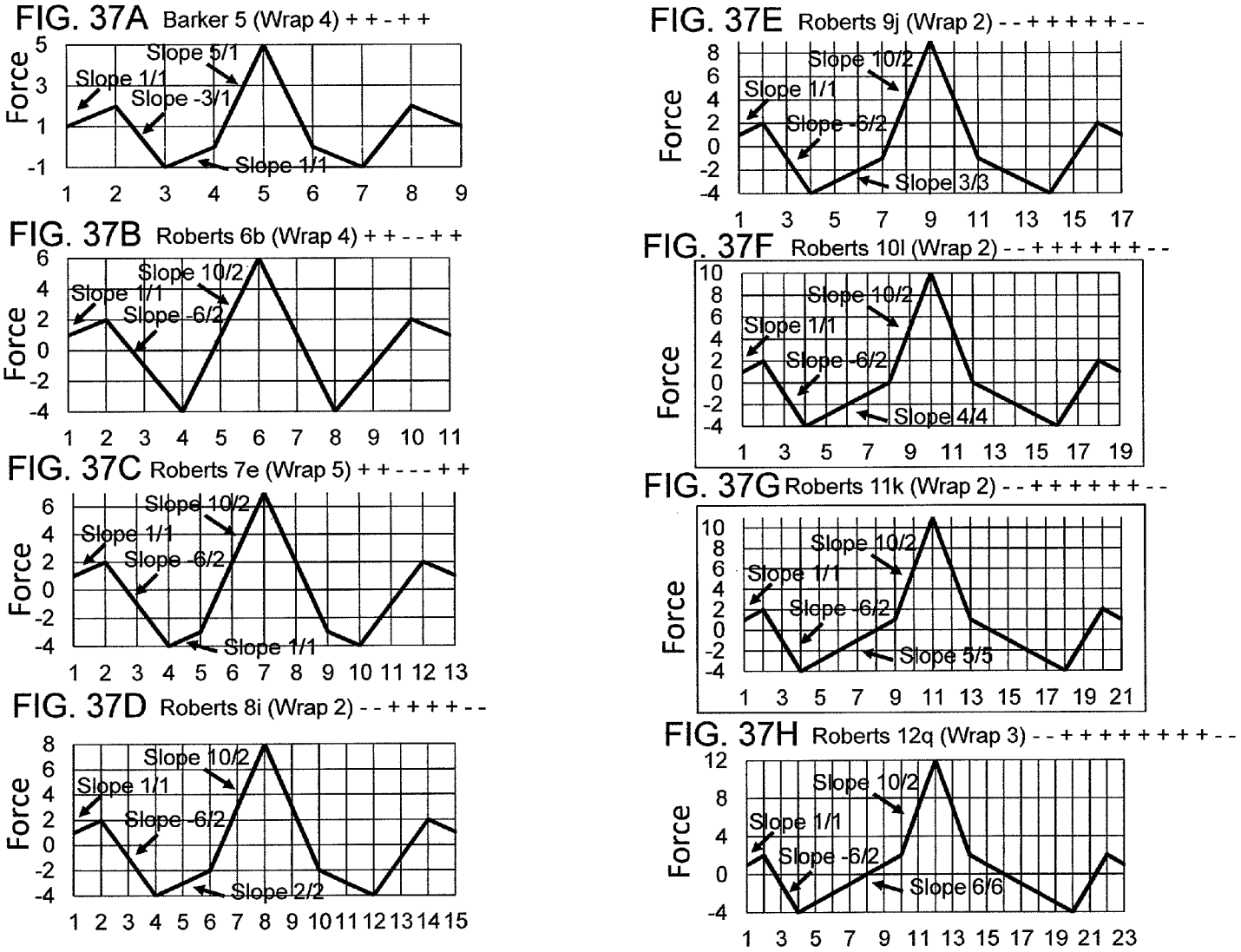
FIG. 37A Barker 5 (Wrap 4) + + - + +
FIG. 37B Roberts 6b (Wrap 4) + + - - + +
FIG. 37C Roberts 7e (Wrap 5) + + - - - + +
FIG. 37D Roberts 8i (Wrap 2) - - + + + + - -
FIG. 37E Roberts 9j (Wrap 2) - - + + + + + - -
FIG. 37F Roberts 10l (Wrap 2) - - + + + + + + - -
FIG. 37G Roberts 11k (Wrap 2) - - + + + + + + - -
FIG. 37H Roberts 12q (Wrap 3) - - + + + + + + + + - -

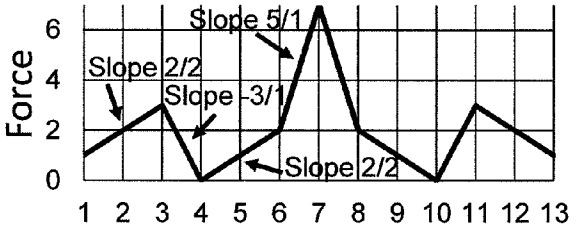
FIG. 38A Roberts 7a (Wrap 4) + + + - + + +
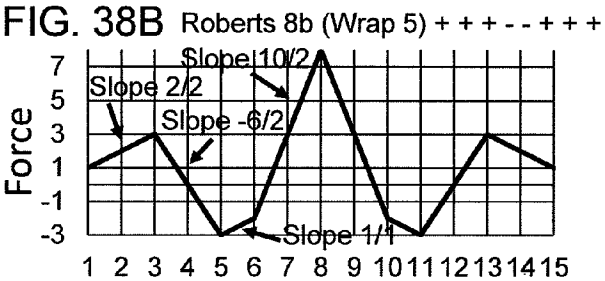
FIG. 38B Roberts 8b (Wrap 5) + + + - - + + +
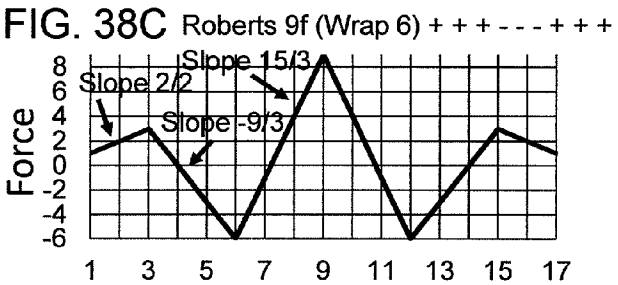
FIG. 38C Roberts 9f (Wrap 6) + + + - - - + + +
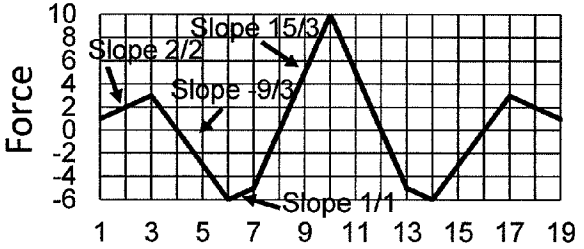
FIG. 38D Roberts 10k (Wrap 7) + + + - - - - + + +
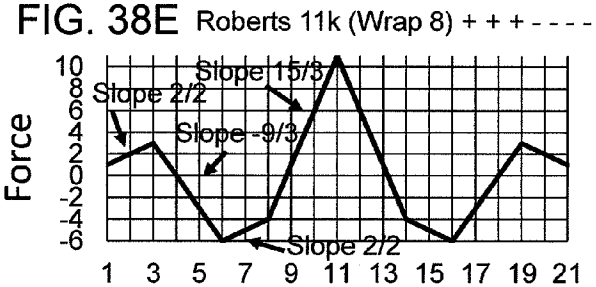
FIG. 38E Roberts 11k (Wrap 8) + + + - - - - - + + +
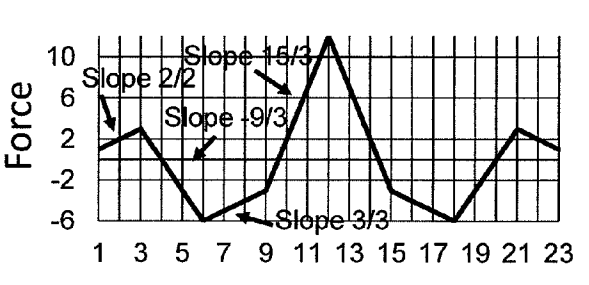
FIG. 38F Roberts 12bl (Wrap 9) + + + - - - - - - + + +

FIG. 41B

Basic Concept with Horizontal Symbol

Here the positive stripes and negative stripes become - + and + - symbols.

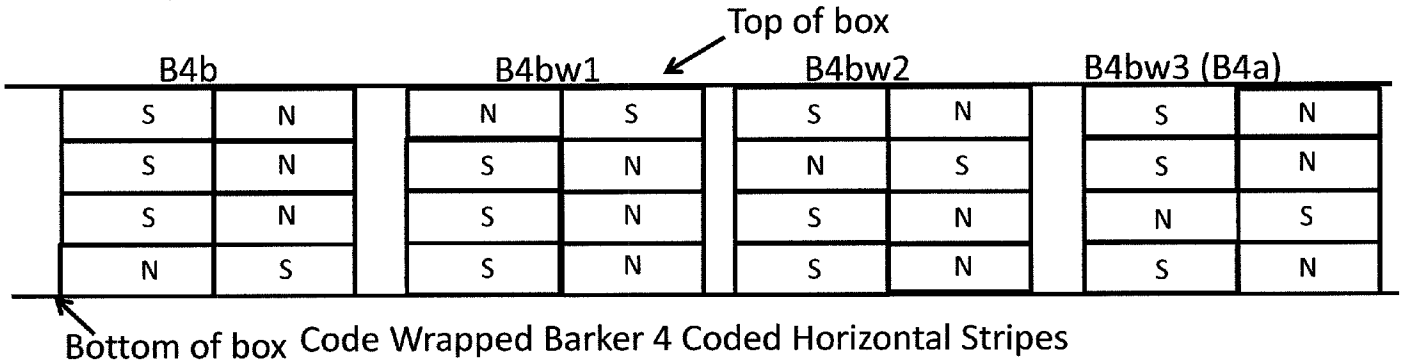

Code Wrapped Barker 4 Coded Horizontal Stripes

FIG. 41C

Here the positive stripes and negative stripes become Barker 3 and complementary Barker 3 symbols.

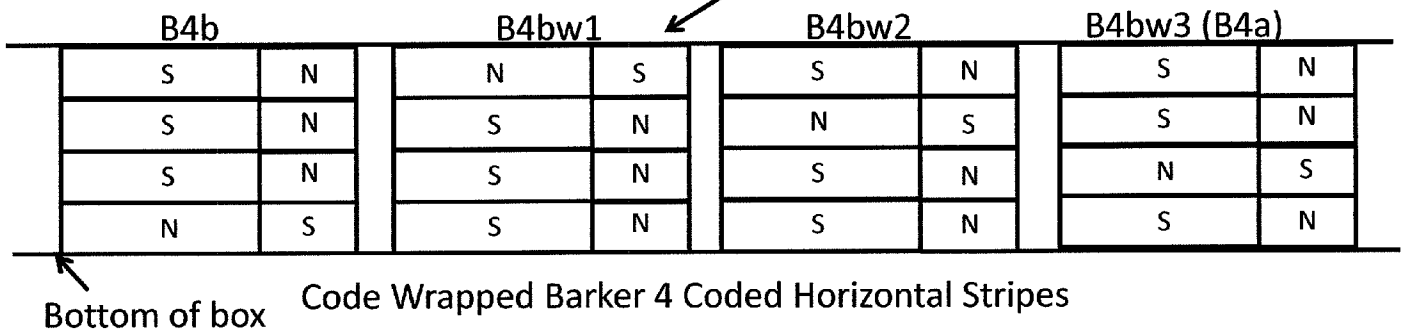

Code Wrapped Barker 4 Coded Horizontal Stripes

Legend: B4b – Barker 4b code
B4bw1 – Barker 4b code w/ 1 code wrap
B4a – Barker 4a code

MAGNETIC STRUCTURES AND METHODS FOR DEFINING MAGNETIC STRUCTURES USING ONE-DIMENSIONAL CODES

RELATED U.S. APPLICATIONS

This Application claims the benefit under 35 USC 119(e) of provisional application 61/851,614, titled "Magnetic Hinge System", filed Mar. 11, 2013, by Fullerton et al.; and is a continuation in part of non-provisional application Ser. No. 13/959,649, titled: "Magnetic Device Using Non Polarized Magnetic Attraction Elements" filed Aug. 5, 2013 by Richards et al. and claims the benefit under 35 USC 119(e) of provisional application 61/744,342, titled "Magnetic Structures and Methods for Defining Magnetic Structures Using One-Dimensional Codes", filed Sep. 24, 2012 by Roberts; Ser. No. 13/959,649 is a continuation in part of non-provisional application Ser. No. 13/759,695, titled: "System and Method for Defining Magnetic Structures" filed Feb. 5, 2013 by Fullerton et al., which is a continuation of application Ser. No. 13/481,554, titled: "System and Method for Defining Magnetic Structures", filed May 25, 2012, by Fullerton et al., U.S. Pat. No. 8,368,495; which is a continuation-in-part of Non-provisional application Ser. No. 13/351,203, titled "A Key System For Enabling Operation Of A Device", filed Jan. 16, 2012, by Fullerton et al., U.S. Pat. No. 8,314,671; Ser. No. 13/481,554 also claims the benefit under 35 USC 119(e) of provisional application 61/519,664, titled "System and Method for Defining Magnetic Structures", filed May 25, 2011 by Roberts et al.; Ser. No. 13/351,203 is a continuation of application Ser. No. 13/157,975, titled "Magnetic Attachment System With Low Cross Correlation", filed Jun. 10, 2011, by Fullerton et al., U.S. Pat. No. 8,098,122, which is a continuation of application Ser. No. 12/952,391, titled: "Magnetic Attachment System", filed Nov. 23, 2010 by Fullerton et al., U.S. Pat. No. 7,961,069; which is a continuation of application Ser. No. 12/478,911, titled "Magnetically Attachable and Detachable Panel System" filed Jun. 5, 2009 by Fullerton et al., U.S. Pat. No. 7,843,295; Ser. No. 12/952,391 is also a continuation of application Ser. No. 12/478,950, titled "Magnetically Attachable and Detachable Panel Method," filed Jun. 5, 2009 by Fullerton et al., U.S. Pat. No. 7,843,296; Ser. No. 12/952,391 is also a continuation of application Ser. No. 12/478,969, titled "Coded Magnet Structures for Selective Association of Articles," filed Jun. 5, 2009 by Fullerton et al., U.S. Pat. No. 7,843,297; Ser. No. 12/952,391 is also a continuation of application Ser. No. 12/479,013, titled "Magnetic Force Profile System Using Coded Magnet Structures," filed Jun. 5, 2009 by Fullerton et al., U.S. Pat. No. 7,839,247; the preceding four applications above are each a continuation-in-part of Non-provisional application Ser. No. 12/476,952 filed Jun. 2, 2009, by Fullerton et al., titled "A Field Emission System and Method", which is a continuation-in-part of Non-provisional application Ser. No. 12/322,561, filed Feb. 4, 2009 by Fullerton et al., titled "System and Method for Producing an Electric Pulse", which is a continuation-in-part application of Non-provisional application Ser. No. 12/358,423, filed Jan. 23, 2009 by Fullerton et al., titled "A Field Emission System and Method", which is a continuation-in-part application of Non-provisional application Ser. No. 12/123,718, filed May 20, 2008 by Fullerton et al., titled "A Field Emission System and Method", U.S. Pat. No. 7,800,471, which claims the benefit under 35 USC 119(e) of U.S. Provisional Application Ser. No. 61/123,019, filed Apr. 4, 2008 by Fullerton, titled "A Field Emission System and Method". The applications and patents listed above are incorporated by reference herein in their entirety.

FIELD OF THE INVENTION

The present invention relates generally to magnetic structures and a method for defining magnetics structures. More particularly, the present invention relates to magnetic structures having irregular polarity patterns defined in accordance with one-dimensional codes.

SUMMARY OF THE INVENTION

In one aspect, the present invention provides a field emission system consisting of a first field emission structure and a second field emission structure each comprising an array of field emission sources each having positions and polarities relating to a spatial force function that corresponds to forces produced by aligned field emission sources of the first and second field emission structures at different spatial alignments within a field domain. The spatial force function is in accordance with a code modulo of a code that defines an irregular polarity pattern that is at least one of an asymmetric polarity pattern or an uneven polarity pattern. A code modulo has a length equal to the length of the code. The code defines at least one peak force per code modulo corresponding to one or more spatial alignments of a plurality of the field emission sources of the first field emission structure and a plurality of the field emission sources of the second field emission structure, where a peak force is a spatial force produced when all aligned field emission sources produce an attractive force or all aligned field emission sources produce a repellant force. The code also defines a plurality of off peak forces per code modulo corresponding to a plurality of spatial missalignments of said first and second field emission structures, where an off peak force is a spatial force resulting from cancellation of at least one attractive force produced by aligned field emission sources of said first and second field emission structures by at least one repellant force produced by aligned field emission sources of said first and second field emission structures.

The code can be a pseudorandom code, a deterministic code, or a designed code.

The code can be a one dimensional code, a two dimensional code, a three dimensional code, or a four dimensional code.

Each field emission source of each said array of field emission sources may have a first vector direction or a second vector direction that is opposite the first vector direction.

At least one off peak force of said plurality of off peak forces may be a zero side lobe.

Each array of field emission sources can be one of a one-dimensional array, a two-dimensional array, or a three-dimensional array.

The polarities of the field emission sources may be North-South polarities or positive-negative polarities.

A field emission source can be a magnetic field emission source or an electric field emission source.

At least one of the field emission sources can be a permanent magnet, an electromagnet, an electret, a magnetized ferromagnetic material, a portion of a magnetized ferromagnetic material, a soft magnetic material, or a superconductive magnetic material.

At least one the first and second field emission structures may include at least one of a back keeper layer, a front saturable layer, an active intermediate element, a passive intermediate element, a lever, a latch, a swivel, a heat source, a heat sink, an inductive loop, a plating nichrome wire, an embedded wire, or a kill mechanism.

At least one of the first and second field emission structures may include a planer structure, a conical structure, a cylindrical structure, a curve surface, a stepped surface.

In another aspect, the present invention provides a field emissions method involving defining a spatial force function corresponding to the relative alignment of a first array of field emission sources of a first field emission structure and a second array of field emission sources of a second field emission structure within a field domain and establishing, in accordance with said spatial force function, a position and polarity of each field emission source of said first array of field emission sources and said second array of field emission sources. The spatial force function is in accordance with a code modulo of a code that defines an irregular polarity pattern that is at least one of an asymmetric polarity pattern or an uneven polarity pattern. The code modulo has a length equal to the length of the code. The code defines at least one peak force per code modulo corresponding to one or more spatial alignments of a plurality of the field emission sources of said first field emission structure and a plurality of the field emission sources of said second field emission structure. A peak force is a spatial force produced when all aligned field emission sources produce an attractive force or all aligned field emission sources produce a repellant force. The code also defines a plurality of off peak forces per code modulo corresponding to a plurality of spatial missalignments of said first and second field emission structures. An off peak force is a spatial force resulting from cancellation of at least one attractive force produced by aligned field emission sources of said first and second field emission structures by at least one repellant force produced by aligned field emission sources of said first and second field emission structures.

The code can be a pseudorandom code, a deterministic code, or a designed code.

The code can be a one dimensional code, a two dimensional code, a three dimensional code, or a four dimensional code.

Each field emission source of each said array of field emission sources may have a first vector direction or a second vector direction that is opposite the first vector direction.

At least one off peak force of said plurality of off peak forces may be a zero side lobe.

Each array of field emission sources can be one of a one-dimensional array, a two-dimensional array, or a three-dimensional array.

A field emission source can be a magnetic field emission source or an electric field emission source.

At least one of the field emission sources may be a permanent magnet, an electromagnet, an electret, a magnetized ferromagnetic material, a portion of a magnetized ferromagnetic material, a soft magnetic material, or a superconductive magnetic material.

In yet another aspect, the present invention provides a field emission system including a first field emission structure and a second field emission structure each having arrays of field emission sources having an irregular polarity pattern defined in accordance with a code modulo of a code, where an irregular polarity pattern is at least one of an asymmetrical polarity pattern or an uneven polarity pattern. The code modulo has a length equal to the length of said code. The code defines at least one peak force and a plurality of off peak spatial forces corresponding to a plurality of alignments of said first and second field emission structures per code modulo, where a peak force is a spatial force produced when all aligned field emission sources produce an attractive force or all aligned field emission sources produce a repellant force and where an off peak force is a spatial force resulting from cancellation of at least one attractive force by at least one repellant force.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIGS. 20F-20J depict an exemplary Roberts 5b code wrap family;

FIGS. 21A-21J depict exemplary correlation functions of linear implementations of the Roberts 5b code wrap family of FIGS. 22A-22E;

FIGS. 22A-22F depict exemplary correlation functions of linear implementations of the Roberts 6a code wrap family;

FIG. 22G depicts and exemplary correlation functions of the cyclic implementations of the Roberts 6a code;

FIGS. 23A-23F depict exemplary correlation functions of linear implementations of the Roberts 6b code wrap family;

FIG. 23G depicts and exemplary correlation functions of the cyclic implementations of the Roberts 6b code;

FIGS. 24A-24F depict exemplary correlation functions of linear implementations of the Roberts 6c code wrap family;

FIG. 24G depicts and exemplary correlation functions of the cyclic implementations of the Roberts 6c code;

FIGS. 25A-25F depict exemplary correlation functions of linear implementations of the Roberts 6d code wrap family;

FIG. 25G depicts and exemplary correlation functions of the cyclic implementations of the Roberts 6d code;

FIGS. 26A-26F depict exemplary correlation functions of linear implementations of the Roberts 6e code wrap family;

FIG. 26G depicts and exemplary correlation functions of the cyclic implementations of the Roberts 6e code;

FIGS. 27A-27F depict exemplary correlation functions of linear implementations of the Roberts 6f code wrap family;

FIG. 27G depicts and exemplary correlation functions of the cyclic implementations of the Roberts 6f code;

FIGS. 28A-28G depict exemplary correlation functions of linear implementations of the Barker code wrap family;

FIGS. 29A-29G depict exemplary correlation functions of linear implementations of the Roberts 7a code wrap family;

FIG. 29H depicts and exemplary correlation functions of the cyclic implementations of the Roberts 7a code;

FIGS. 30A-30G depict exemplary correlation functions of linear implementations of the Roberts 7b code wrap family;

FIG. 30H depicts and exemplary correlation functions of the cyclic implementations of the Roberts 7b code;

FIGS. 31A-31G depict exemplary correlation functions of linear implementations of the Roberts 7c code wrap family;

FIG. 31H depicts and exemplary correlation functions of the cyclic implementations of the Roberts 7c code;

FIGS. 32A-32G depict exemplary correlation functions of linear implementations of the Roberts 7d code wrap family;

FIG. 32H depicts and exemplary correlation functions of the cyclic implementations of the Roberts 7d code;

FIGS. 33A-33G depict exemplary correlation functions of linear implementations of the Roberts 7e code wrap family;

FIG. 33H depicts and exemplary correlation functions of the cyclic implementations of the Roberts 7e code;

FIGS. 34A-34G depict exemplary correlation functions of linear implementations of the Roberts 7f code wrap family;

FIG. 34H depicts and exemplary correlation functions of the cyclic implementations of the Roberts 7f code;

FIGS. 35A-35G depict exemplary correlation functions of linear implementations of the Roberts 7g code wrap family;

FIG. 35H depicts and exemplary correlation functions of the cyclic implementations of the Roberts 7g code;

FIGS. 36A-36H depict exemplary correlation functions of a group of codes having a first class of magnetic behavior;

FIGS. 37A-37H depict exemplary correlation functions of a group of codes having a second class of magnetic behavior;

FIGS. 38A-38F depict exemplary correlation functions of a group of codes having a third class of magnetic behavior;

FIG. 41B depicts use of a "+ −" and "− +" symbols to provide centering characteristics to the parts of the self-assembly toy; and FIG. 41C depicts use of a Barker 3 code and complementary Barker 3 code as symbols to provide centering characteristics to the part of the self-assembly toy.

DETAILED DESCRIPTION OF THE INVENTION

Figure 1A:
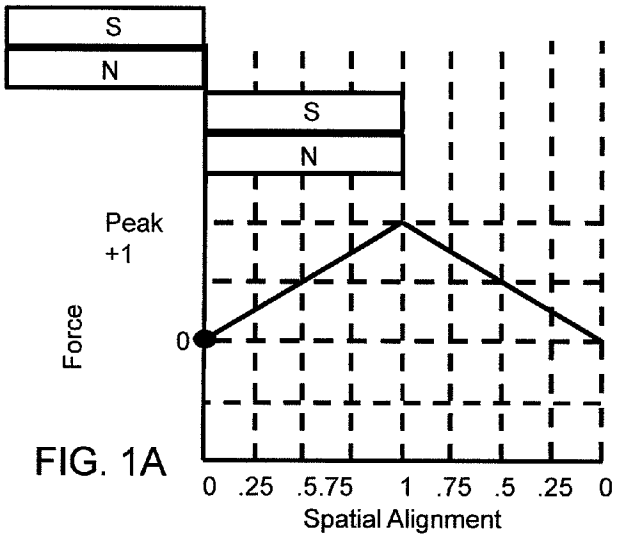
FIGS. 1A-1D depict an exemplary spatial force function and four spatial alignments of opposite poles of two magnets.
Figure 1B:
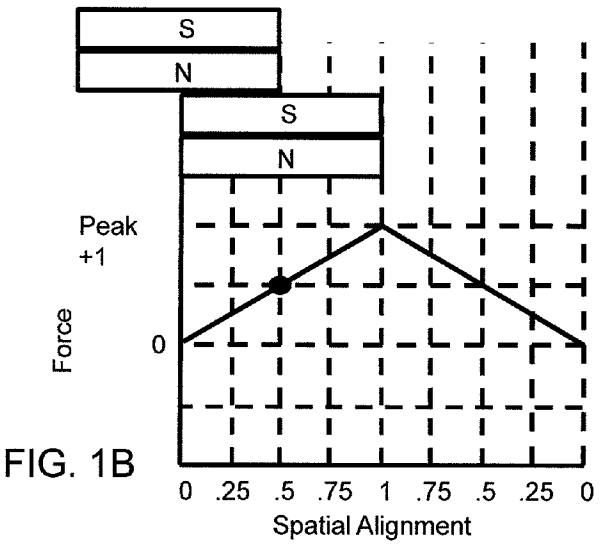
Figure 1C:
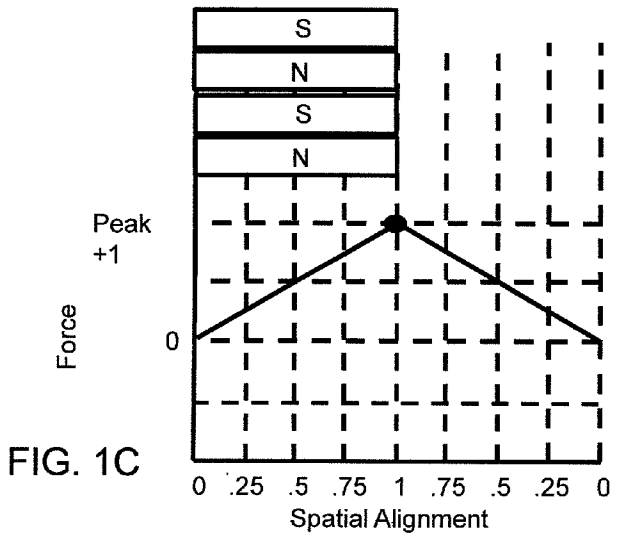
Figure 1D:
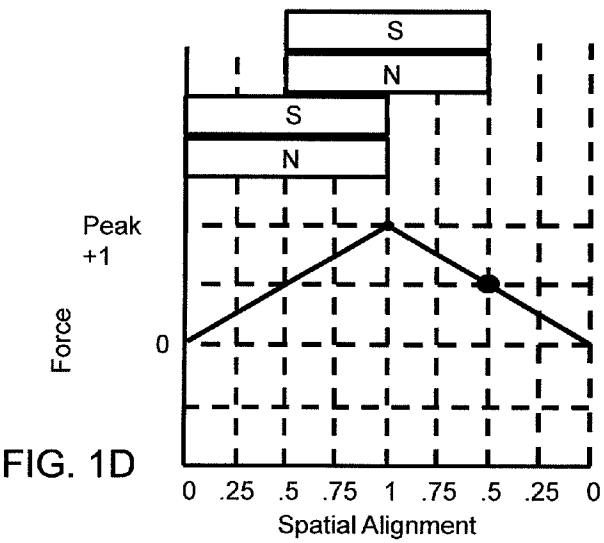

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. patent application Ser. No. 12/476,952 filed on Jun. 2, 2009, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. patent application Ser. No. 12/895,589 filed Sep. 30, 2010, which is all incorporated herein by reference in its entirety.

Such systems and methods described in U.S. Pat. No. 7,681,256 issued Mar. 23, 2010, U.S. Pat. No. 7,750,781 issued Jul. 6, 2010, U.S. Pat. No. 7,755,462 issued Jul. 13, 2010, U.S. Pat. No. 7,812,698 issued Oct. 12, 2010, U.S. Pat. Nos. 7,817,002, 7,817,003, 7,817,004, 7,817,005, and 7,817,006 issued Oct. 19, 2010, U.S. Pat. No. 7,821,367 issued Oct. 26, 2010, U.S. Pat. Nos. 7,823,300 and 7,824,083 issued Nov. 2, 2011, U.S. Pat. No. 7,834,729 issued Nov. 16, 2011, U.S. Pat. No. 7,839,247 issued Nov. 23, 2010, U.S. Pat. Nos. 7,843,295, 7,843,296, and 7,843,297 issued Nov. 30, 2010, U.S. Pat. No. 7,893,803 issued Feb. 22, 2011, U.S. Pat. Nos. 7,956,711 and 7,956,712 issued Jun. 7, 2011, U.S. Pat. Nos. 7,958,575, 7,961,068 and 7,961,069 issued Jun. 14, 2011, U.S. Pat. No. 7,963,818 issued Jun. 21, 2011, and U.S. Pat. Nos. 8,015,752 and 8,016,330 issued Sep. 13, 2011, and U.S. Pat. No. 8,035,260 issued Oct. 11, 2011, and U.S. Pat. No. 8,174,347 issued May 8, 2012, and U.S. Pat. Nos. 8,279,031 and 8,279,032 issued Oct. 2, 2012, and U.S. Pat. No. 8,368,495 issued Feb. 5, 2013 are all incorporated by reference herein in their entirety.

Such systems and methods described in U.S. patent application Ser. No. 13/240,335 filed Sep. 22, 2011, Ser. No. 13/246,584 filed Sep. 27, 2011, Ser. No. 13/374,074 filed Dec. 9, 2011, Ser. No. 13/604,939 filed Sep. 6, 2012, Ser. No. 13/659,444 filed Oct. 23, 2012, Ser. No. 13/687,819 filed Nov. 28, 2012, Ser. No. 13/779,611 filed Feb. 27, 2013, and Ser. No. 13/959,201 filed Aug. 5, 2013 are all incorporated by reference herein in their entirety.

The present invention pertains to magnetic structures and methods for defining magnetic structures having irregular polarity patterns in accordance with one-dimensional codes such as Barker codes, where an irregular polarity pattern is at least one of an asymmetrical polarity pattern or an uneven polarity pattern. An uneven polarity pattern will have a greater amount of a first polarity than a second polarity per code modulo, where a code modulo is an instance of a code having a code length N. Such one-dimensional codes define at least one peak force per code modulo corresponding to one or more spatial alignments of a plurality of the field emission sources of a first field emission structure and a plurality of the field emission sources of a second field emission structure, where a peak force is a spatial force produced when all aligned field emission sources produce an attractive force or all aligned field emission sources produce a repellant force. Such codes also define a plurality of off peak spatial forces per code modulo corresponding to a plurality of missalignments of said first and second field emission structures, where an off peak force is a spatial force resulting from cancellation of at least one attractive force produced by aligned field emission sources of said first and second field emission structures by at least one repellant force produced by aligned field emission sources of said first and second field emission structures. Such codes can be used, for example, in linear magnetic structures and cyclic magnetic structures.

The following discussion uses a mathematical approximation of the forces produced between interfacing magnetic structures which assumes individual magnetic poles each have the same magnetic field strength and ignores side magnetic interactions, where interfacing like polarity poles produce a normalized unit repel force (−1) and interfacing opposite polarity poles produce a normalized unit attract force (+1). One skilled in the art will understand that side magnetic interactions do have certain effects and that variation in material and variation of magnetization of material are possible. However, the application of this mathematical approximation approach remains generally applicable for teaching a basic understanding of the correlation characteristics of complementary magnetic structures comprising patterns (or codes) of multiple poles. One skilled in the art will also recognize that magnets of different sizes can be used to implement the codes and that portions of magnetizable material can be magnetized in accordance with a given code.

The exemplary codes, or polarity patterns, or polarity sequences, presented herein uses a notation such as + + − to represent two consecutive same polarity code elements (i.e., magnetic sources) followed by an opposite polarity code element, where a + or − symbol could be a South pole and North pole, or vice versa. Generally, the polarities assigned to a given symbol (e.g., + or −) are interchangeable since the vector math being applied is the same regardless, where the relative locations and the resulting cancellations of forces are determined by the relative polarity pattern. A complementary arrangement of a first magnetic structure in accordance with a first code such as + + + − + is therefore understood to interface with a second magnetic structure having a complementary code − − − + −. Similarly, an anti-complementary arrangement of a first code + + + − + that is interfacing with the same (or duplicate) polarity poles + + + − + is understood to be magnetically equivalent to a second code − − − + − interfacing with the same (or duplicate) polarity poles − − − + −. Additionally, one skilled in the art will recognize that a double width code element (i.e., 2+) is equivalent to consecutive single width code elements (i.e., + +). For example, a Barker 3 code could be implemented using a double length element of a first polarity and a single length element of a second polarity. Such a structure would have the same polarity imbalance (i.e., uneven polarity) as a structure produced with three single length elements and have the same correlation functions when aligned with a complementary or duplicate structure.

In accordance with the invention, a code having an irregular one-dimensional polarity pattern may have more of a first polarity than a second polarity. Alternatively, the amount of the first polarity may be the same as the second polarity but the polarity pattern may be asymmetrical and therefore be an irregular polarity pattern. As such a structure having an irregular polarity pattern in accordance with a one-dimensional code may have more of a first polarity than a second polarity per code modulo. For example, a Barker 3 code (1, 1, −1) defines two magnetic sources of a first polarity and one magnetic source of a second polarity, where two code modulos would have four magnetic sources of a first polarity and two magnetic sources of a second polarity, and so on. Alternatively, an irregular polarity pattern may be an asymmetric polarity pattern such as the one-dimensional pattern (1, −1, 1, −1, −1, 1). One skilled in the art will understand that uniformly alternating polarity patterns such as (1, 1, −1, −1) and (1, −1, 1) are not irregular polarity patterns.

One skilled in the art will also understand that polarity patterns having a first half that is complementary to a second half of the pattern, such as (1, 1, −1, −1, −1, 1) are also not irregular patterns because such patterns are actually instances of an alternating polarity code (1, −1) implemented with a pair of complementary symbols (i.e., '1, 1, −1' and '−1, −1, 1'), where a first symbol of a pair of complementary symbols can be multiplied by −1 to produce the second symbol of the pair of complementary symbols, and vice versa. One skilled in the art will also understand that for the symbols to be complementary within a one-dimensional code, their polarity pattern must have the same order (i.e., one symbol cannot be in reverse polarity pattern order as its complementary symbol). For example, a code of (1, 1, −1, 1, −1, −1) does not have complementary symbols because the first symbol (1, 1, −1) must be multiplied by −1 and the order of the resulting polarity pattern must be reversed in order to produce the second symbol (1, −1, −1). However, such a pattern will have even (i.e., balanced) polarity and be symmetrical so it would not be an irregular polarity pattern.

FIGS. 1A-1D depict an exemplary spatial force function, which is also a correlation function, and four spatial alignments of opposite poles of two magnets, where the amount of attractive force produced is a linear function of the interfacing areas of the two faces of the magnets as the first magnet is moved across the second magnet.

The spatial force functions of FIGS. 1A-1D and others in this disclosure are idealized, but illustrate the main principle and primary performance. The curves show the performance assuming equal magnet size, shape, and strength and equal distance between corresponding magnets and no spacing between adjacent magnets. For simplicity, the plots only show discrete integer positions and interpolate linearly. Actual force values may vary from the graph due to various factors such as diagonal coupling of adjacent magnets, magnet shape, spacing between magnets, properties of magnetic materials, etc. The curves also assume equal attract and repel forces for equal distances. Such forces may vary considerably and may not be equal depending on magnet material and field strengths. High coercive force materials typically perform well in this regard.

Figure 2:
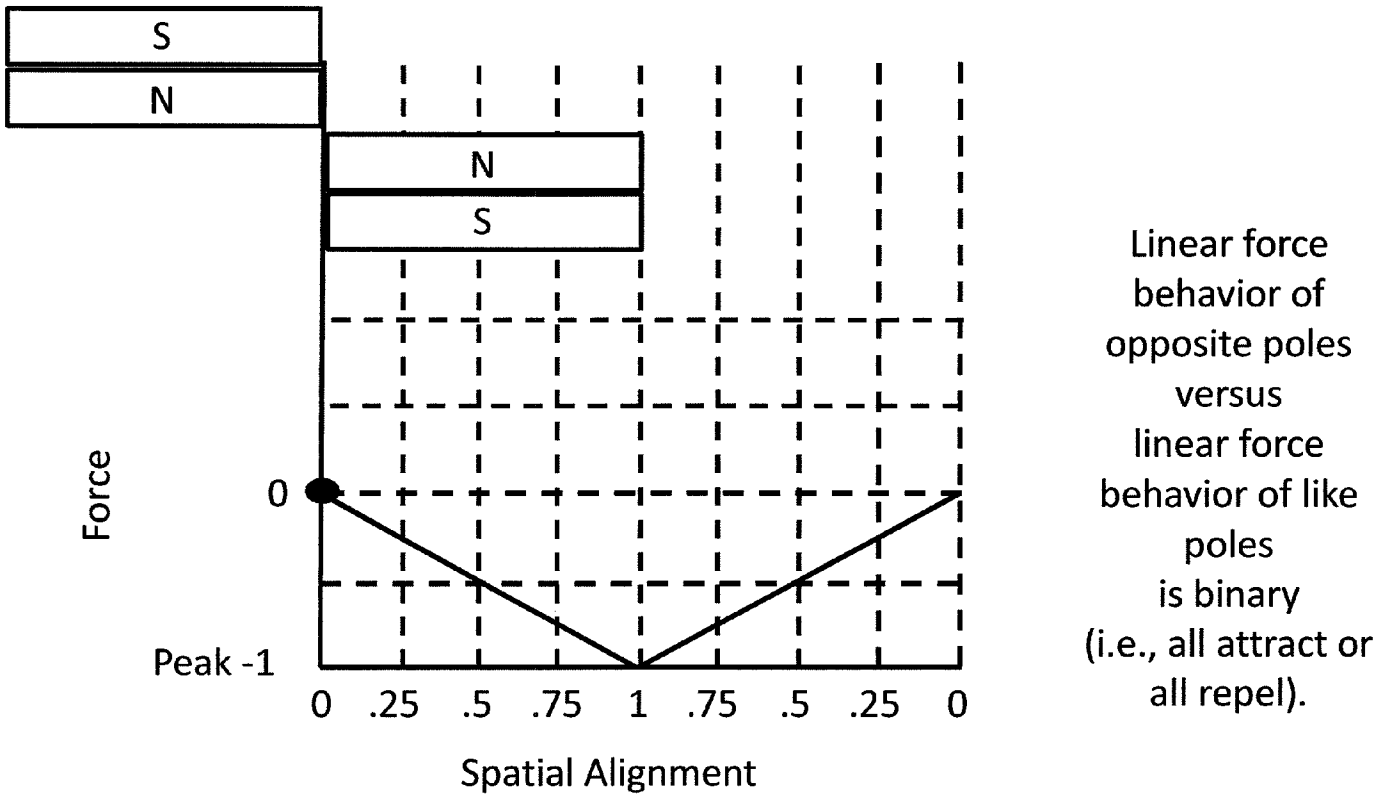
FIG. 2 depicts an exemplary spatial force function corresponding to like poles of two magnets.

FIG. 2 depicts an exemplary spatial force function corresponding to like poles of two magnets, where the spatial force function is the inverse of the spatial force function of FIGS. 1A-1D and involves a repel force. There is not any cancellation of an attract force by a repel force in either of the two spatial force functions of FIGS. 1A-1D and FIG. 2.

Figure 3B:
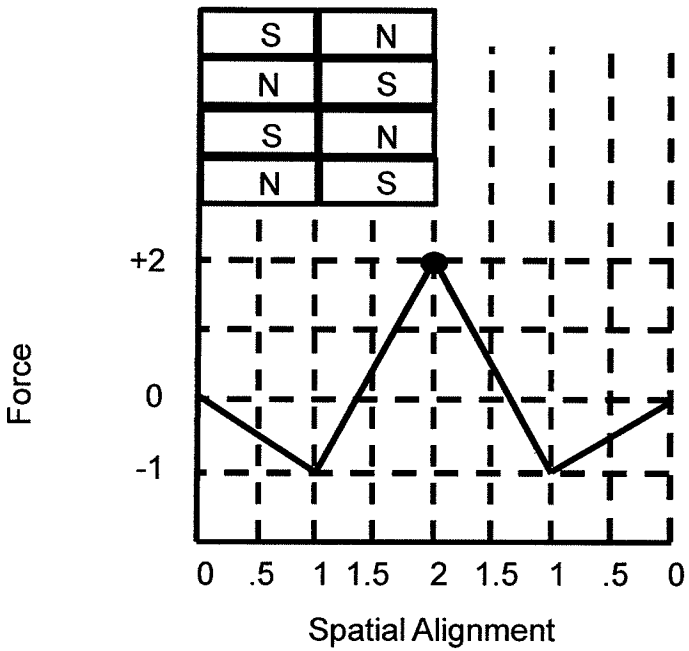
FIGS. 3A and 3B depict an exemplary saw tooth spatial force function and two spatial alignments of complementary alternating polarity magnetic structures.
Figure 3A:
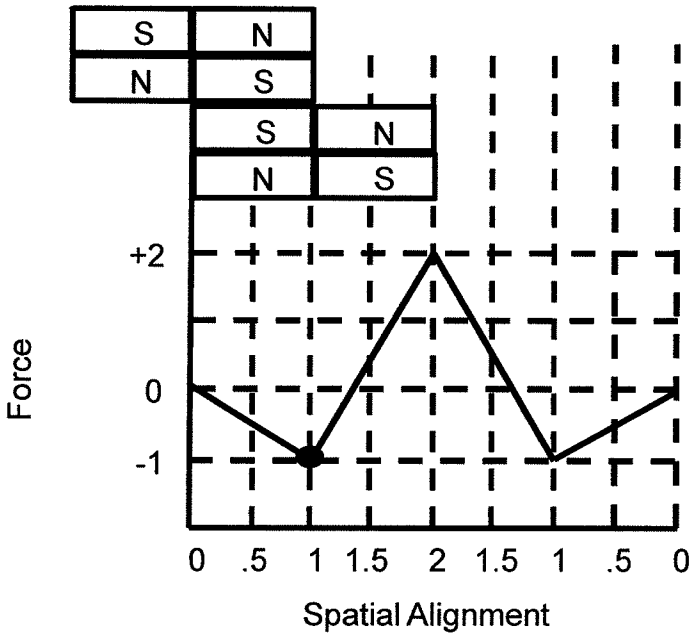

FIGS. 3A and 3B depict an exemplary saw tooth spatial force function and two spatial alignments of complementary alternating polarity magnetic structures. With such alternating polarity structures there are zero crossings when poles are partially aligned but not zero side lobes involving cancelation of repel forces produced by aligned same polarity poles by attract forces produced by aligned opposite polarity poles. With FIGS. 3A and 3B the −1 side lobes occur because of what can be described as a ramp up-ramp down process whereby the number of interfacing poles goes from zero to one to two to one to zero.

Figure 4:
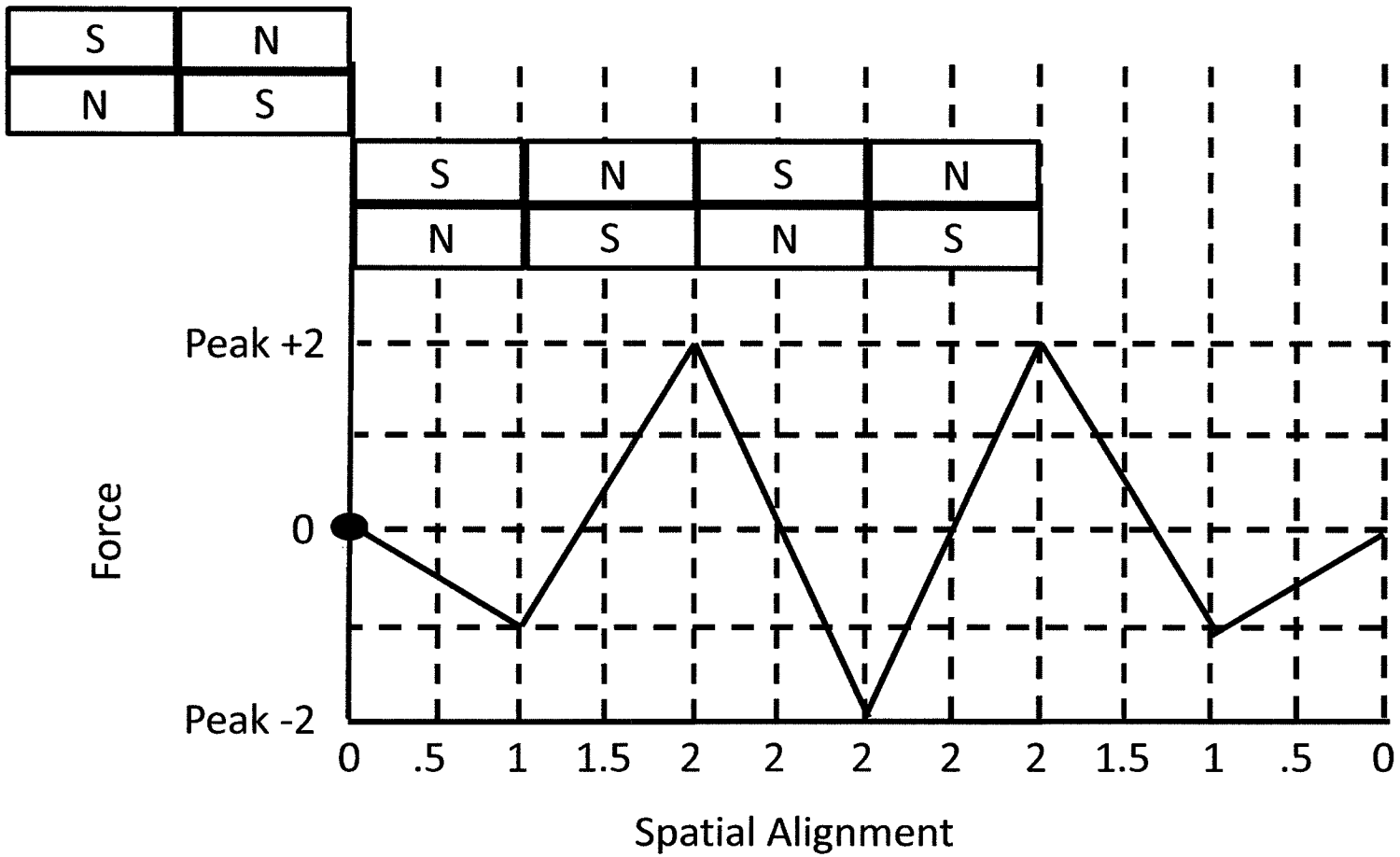
FIG. 4 depicts an exemplary saw tooth spatial force function of a first magnetic structure comprising two alternating polarity magnets facing a second magnetic structure comprising four alternating polarity magnets.

FIG. 4 depicts an exemplary saw tooth spatial force function of a first magnetic structure comprising two alternating polarity magnets facing a second magnetic structure comprising four alternating polarity magnets. As with FIGS. 3A and 3B the −1 side lobes are present as a result of the ramp up-ramp down process but because the second magnetic structure comprises four alternating polarity magnets there are three positions where the two magnets of the first magnetic structure fully align with two magnets of the second magnetic structure. For these alignments, the number of interfacing magnets remains constant and, as such, the saw tooth spatial force function alternates from an attract force of two to a repel force of two to an attract force of two.

Figure 5:
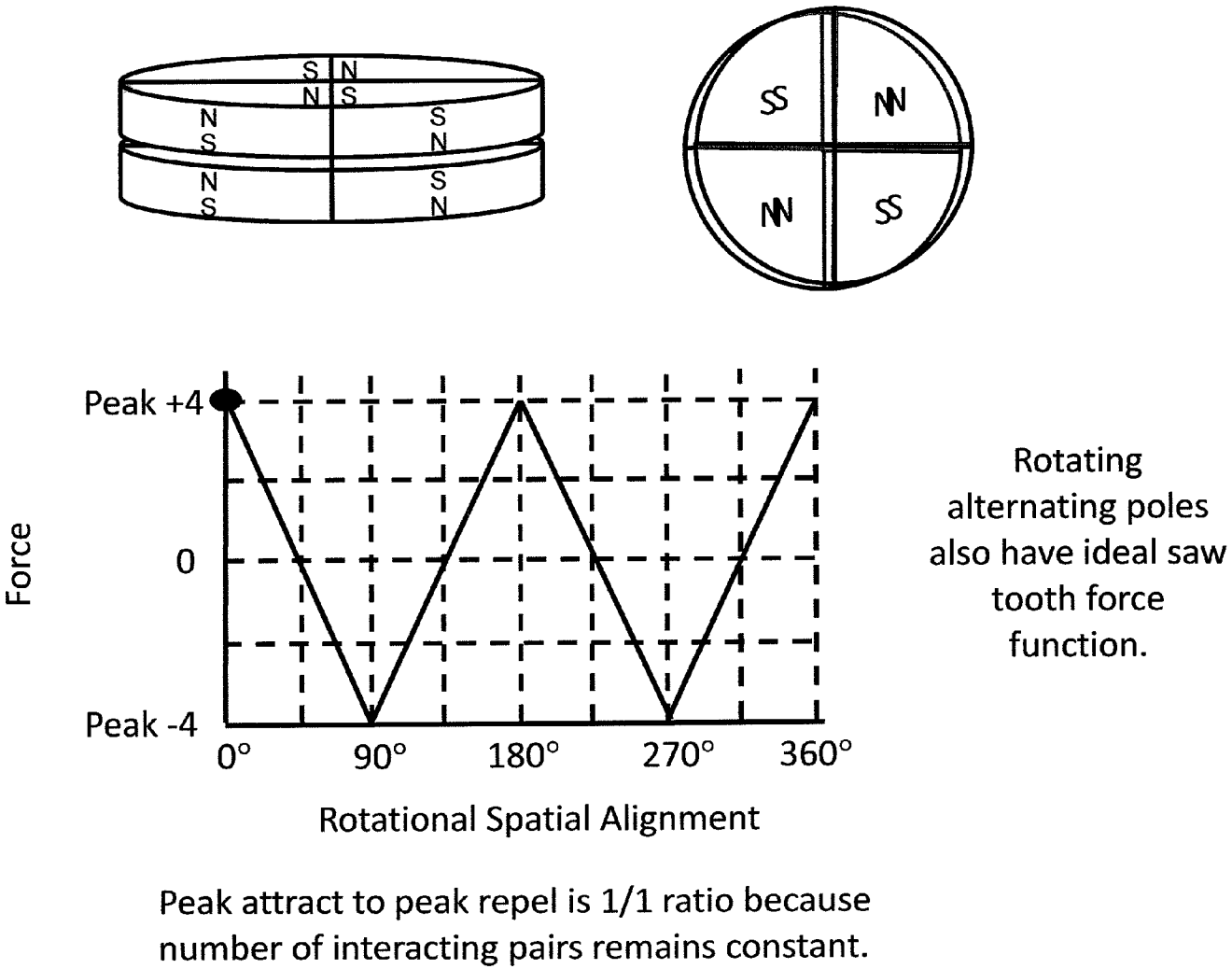
FIG. 5 depicts an exemplary saw tooth spatial force function of two circular magnetic structures each comprising four alternating polarity quadrants.

FIG. 5 depicts an exemplary saw tooth spatial force function of two circular magnetic structures each comprising four alternating polarity quadrants. As the circular structures rotate relative to each other the number of interfacing poles remains constant producing the ideal saw tooth force function where the force being produced between the structures alternates between a peak attract force and a peak repel force. As such, one skilled in the art will recognize from FIGS. 1A-5 that the correlation functions of magnetic structures will vary depending on how a one-dimensional pattern (or code) is implemented to include linear implementations and cyclic implementations and whether multiple instances (or modulos) of a pattern are repeated relative to another instance of a pattern. Moreover, one skilled will understand that the correlation functions and resulting magnetic behavior may depend on movement constraining mechanisms (e.g., only allowing circular structures to rotate and not translate relative to each other) and that it in certain applications a first structure's movement relative to a second structure may be limited to enable only a portion of the spatial force function. Furthermore, the exemplary structures described herein are complementary structures. One skilled in the art will recognize that the same codes (e.g., Barker codes) can be used to define anti-complementary structures which produce a peak repel force, where the spatial force functions of the anti-complementary structures are the same as the spatial force functions of the complementary structures except inverted (i.e., multiplied by −1).

Figure 6:
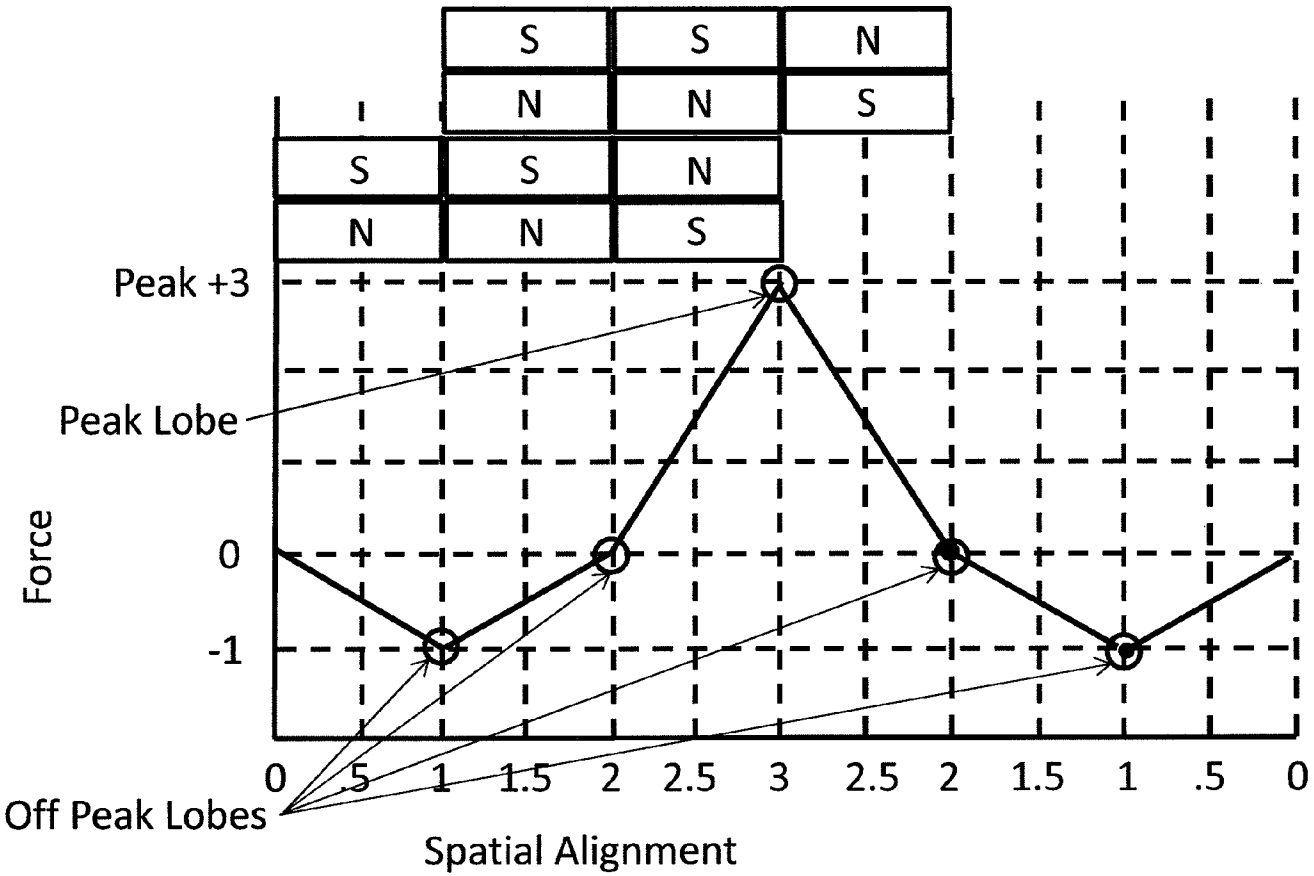
FIG. 6 depicts an exemplary spatial force function of two linear complementary magnetic structures having polarity patterns in accordance with a Barker 3 code.

FIG. 6 depicts an exemplary spatial force function of two linear complementary magnetic structures having polarity patterns in accordance with a Barker 3 code. As seen in FIG. 6, when the three magnets of the first structure are the fully aligned with the three magnets of the second structure a peak lobe corresponding to a peak attract force of 3 is produced and when the two structures are not aligned off peak forces of 0 and −1 are produced due to cancellation of repel and attract forces and the ramp up-ramp down process.

Figure 7:
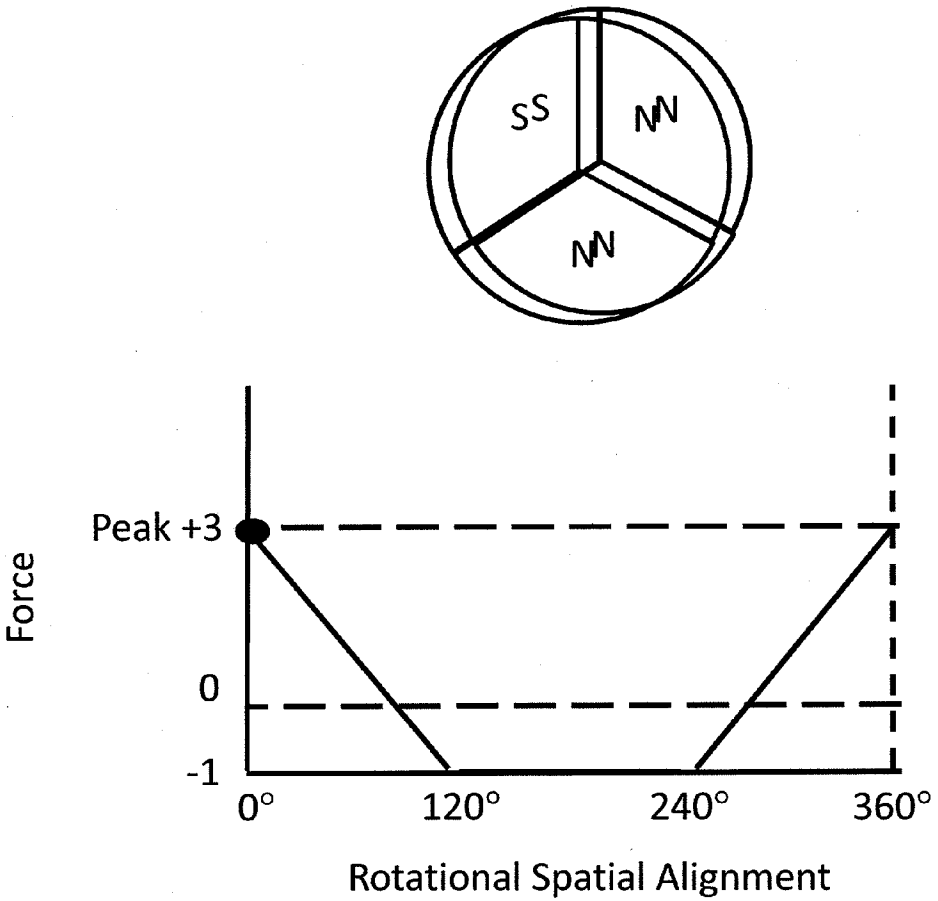
FIG. 7 depicts an exemplary spatial force function of two circular complementary magnetic structures having polarity patterns in accordance with a Barker 3 code.

FIG. 7 depicts an exemplary spatial force function of two circular complementary magnetic structures having polarity patterns in accordance with a Barker 3 code. As can be seen by comparing FIGS. 6 and 7, a cyclic implementation of the Barker 3 code where movement is constrained such that there is only rotational movement between the two structures (i.e., no translational relative movement) produces a peak attract force of 3 when the complementary magnet pairs of the two structures are aligned but because there is no ramp up-ramp down process the off peak lobes produced when the complementary magnet pairs of the two structures are misaligned are both −1.

Figure 8:
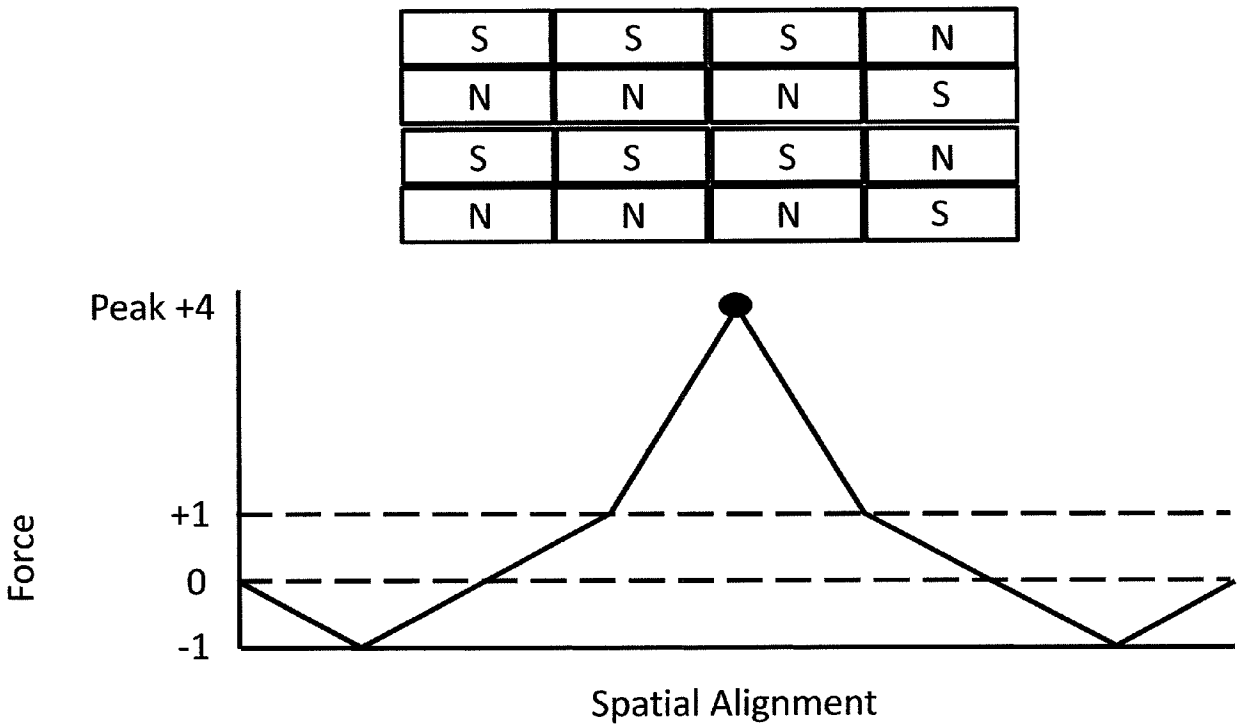
FIG. 8 depicts an exemplary spatial force function of two linear complementary magnetic structures having polarity patterns in accordance with a Barker 4a code.

FIG. 8 depicts an exemplary spatial force function of two linear complementary magnetic structures having polarity patterns in accordance with a Barker 4a code. As with the Barker 3 code, a peak lobe force (4) is produced when the two structures are aligned and off peak lobe forces (1, 0, −1) are produced due to cancellation of repel and attract forces and the ramp up-ramp down process.

Figure 9:
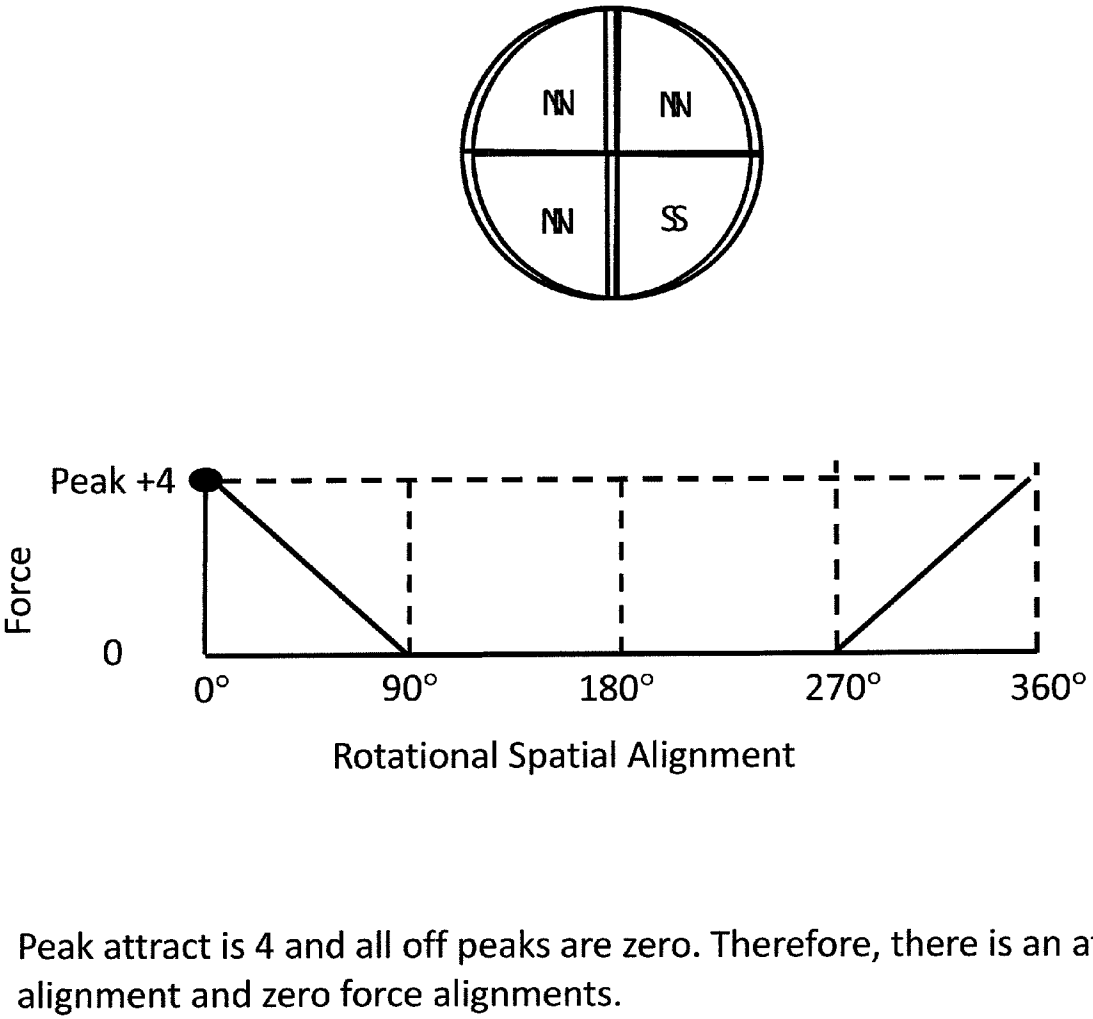
FIG. 9 depicts an exemplary spatial force function of two circular complementary magnetic structures having polarity patterns in accordance with a Barker 4a code.

FIG. 9 depicts an exemplary spatial force function of two circular complementary magnetic structures having polarity patterns in accordance with a Barker 4a code, where a peak attract force of 4 is produced when complementary magnets are all aligned and because there is no ramp up-ramp down process the off peak lobes all produce a net force of 0 as a result of cancellation of produced attract forces (2) by produced repel forces (−2) for each of the three off peak lobe positions.

Figure 10:
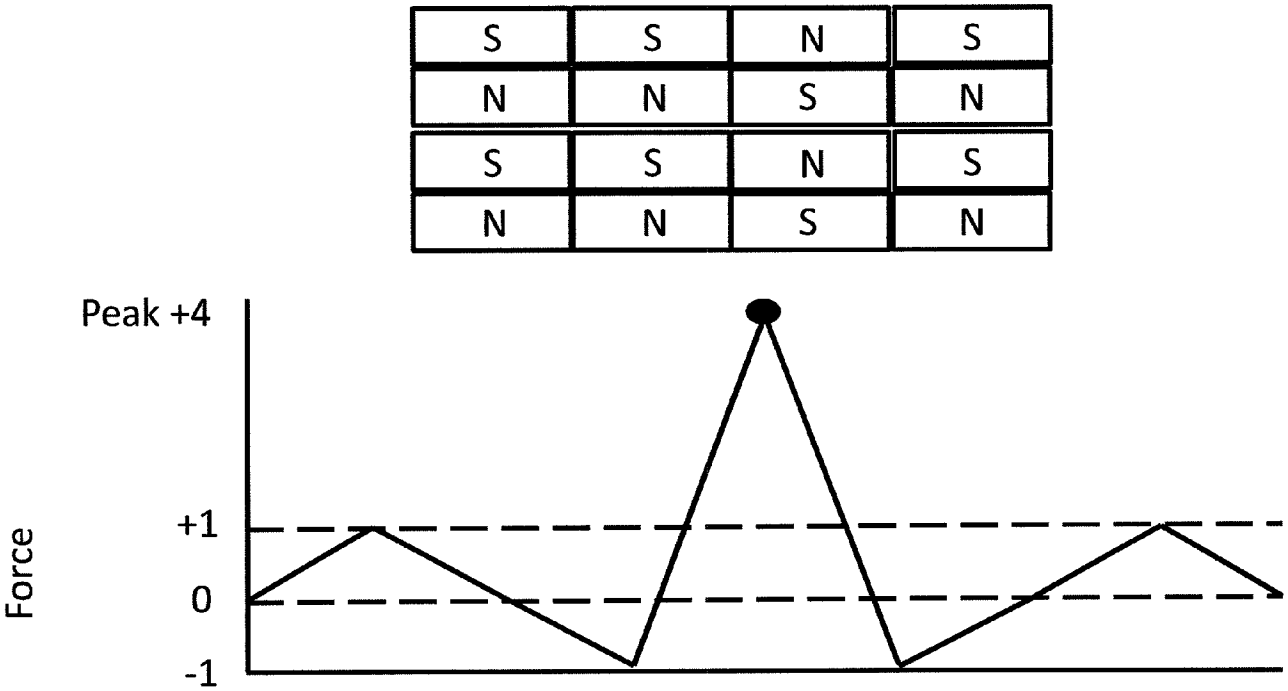
FIG. 10 depicts an exemplary spatial force function of two linear complementary magnetic structures having polarity patterns in accordance with a Barker 4b code.

FIG. 10 depicts an exemplary spatial force function of two linear complementary magnetic structures having polarity patterns in accordance with a Barker 4b code. Like the linear implementation of the Barker 4a code, the linear implementation of the Barker 4b code produces side lobe forces of 1, 0, and −1. However, it is noteworthy that the 1 and −1 positions are swapped between the two codes. One skilled in the art will also recognize that the cyclic implementation of the Barker 4b code is the same as depicted in FIG. 9 for the Barker 4a code.

Figure 11:
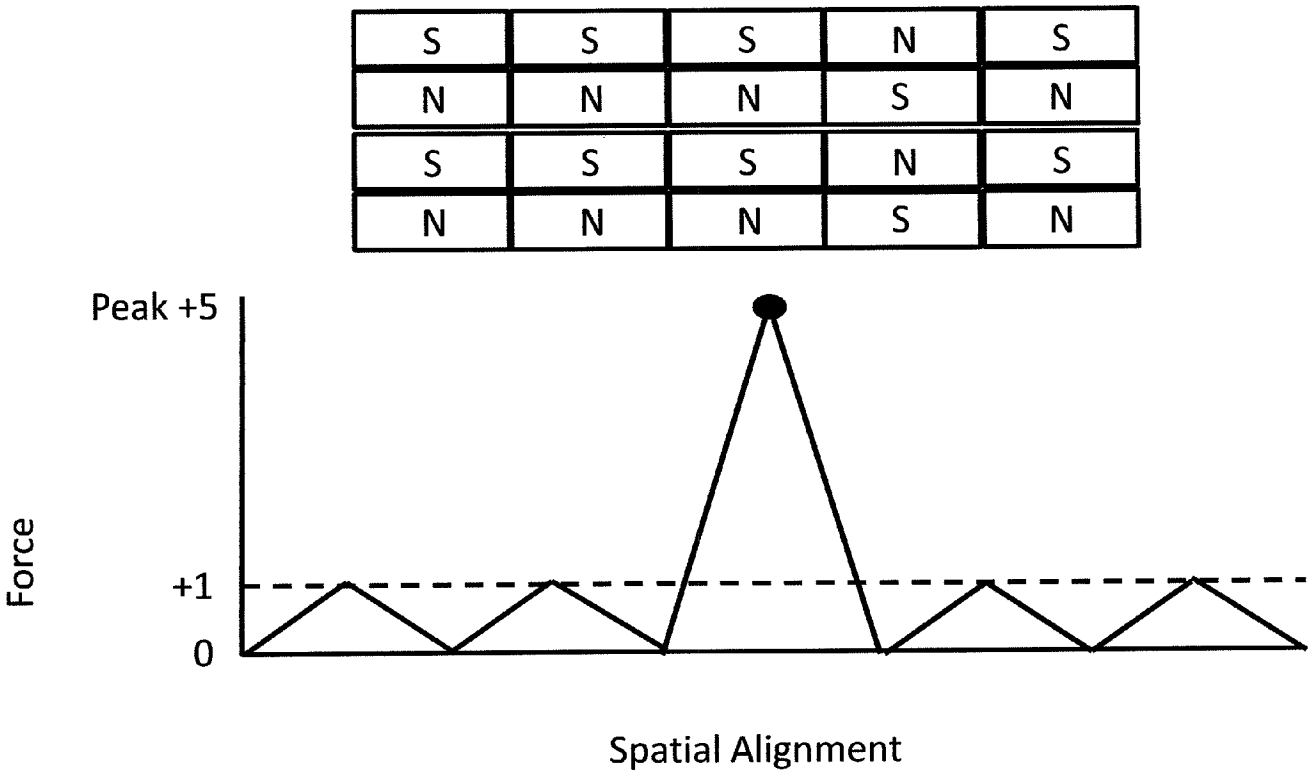
FIG. 11 depicts an exemplary spatial force function of two linear complementary magnetic structures having polarity patterns in accordance with a Barker 5 code.

FIG. 11 depicts an exemplary spatial force function of two linear complementary magnetic structures having polarity patterns in accordance with a Barker 5 code, where a peak force of 5 is produced when the structures are aligned and the side lobe forces are 0 and 1.

Figure 12:
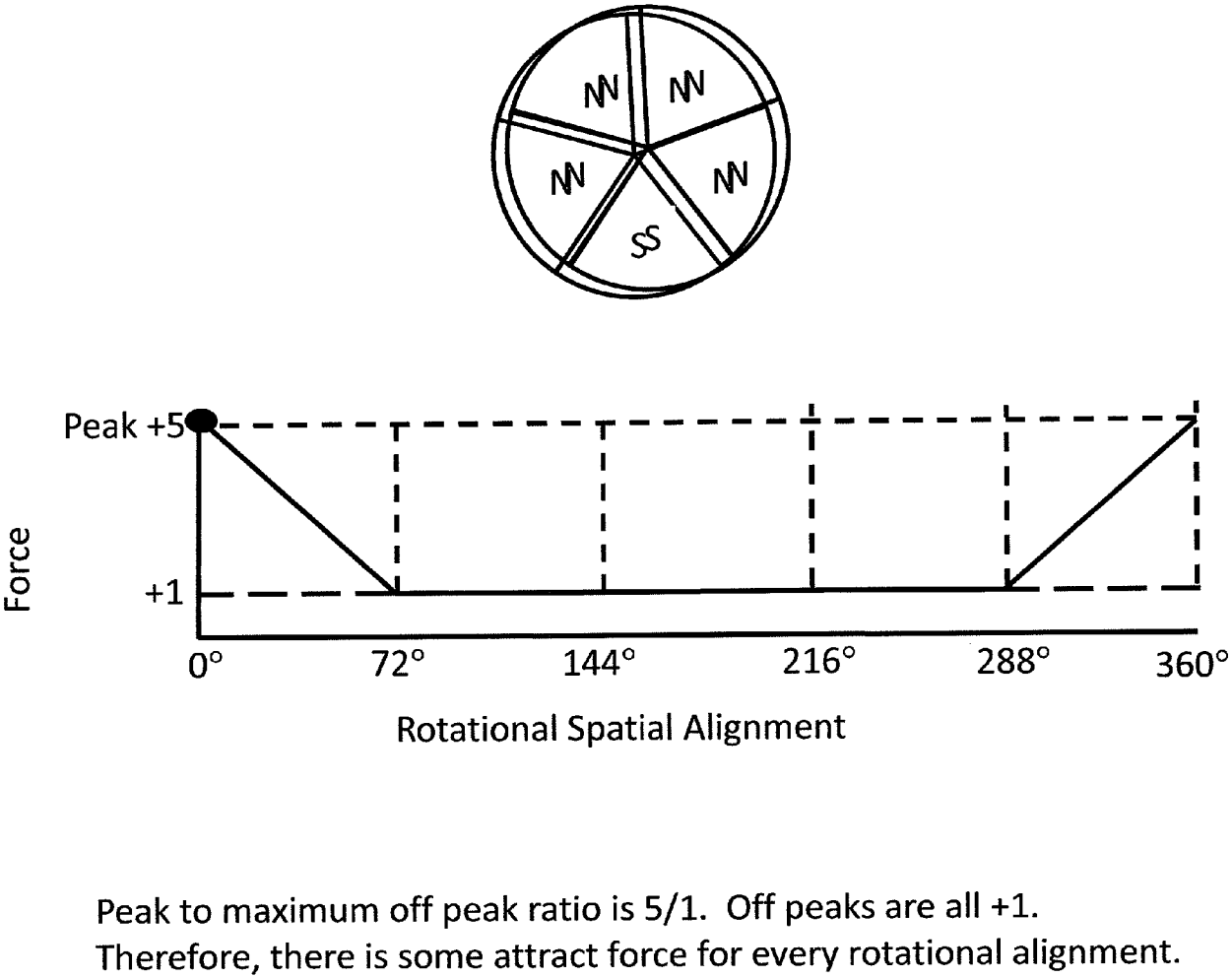
FIG. 12 depicts an exemplary spatial force function of two circular complementary magnetic structures having polarity patterns in accordance with a Barker 5 code.

FIG. 12 depicts an exemplary spatial force function of two circular complementary magnetic structures having polarity patterns in accordance with a Barker 5 code, where the peak lobe force is 5 and the side lobe forces are all +1.

Figure 13:
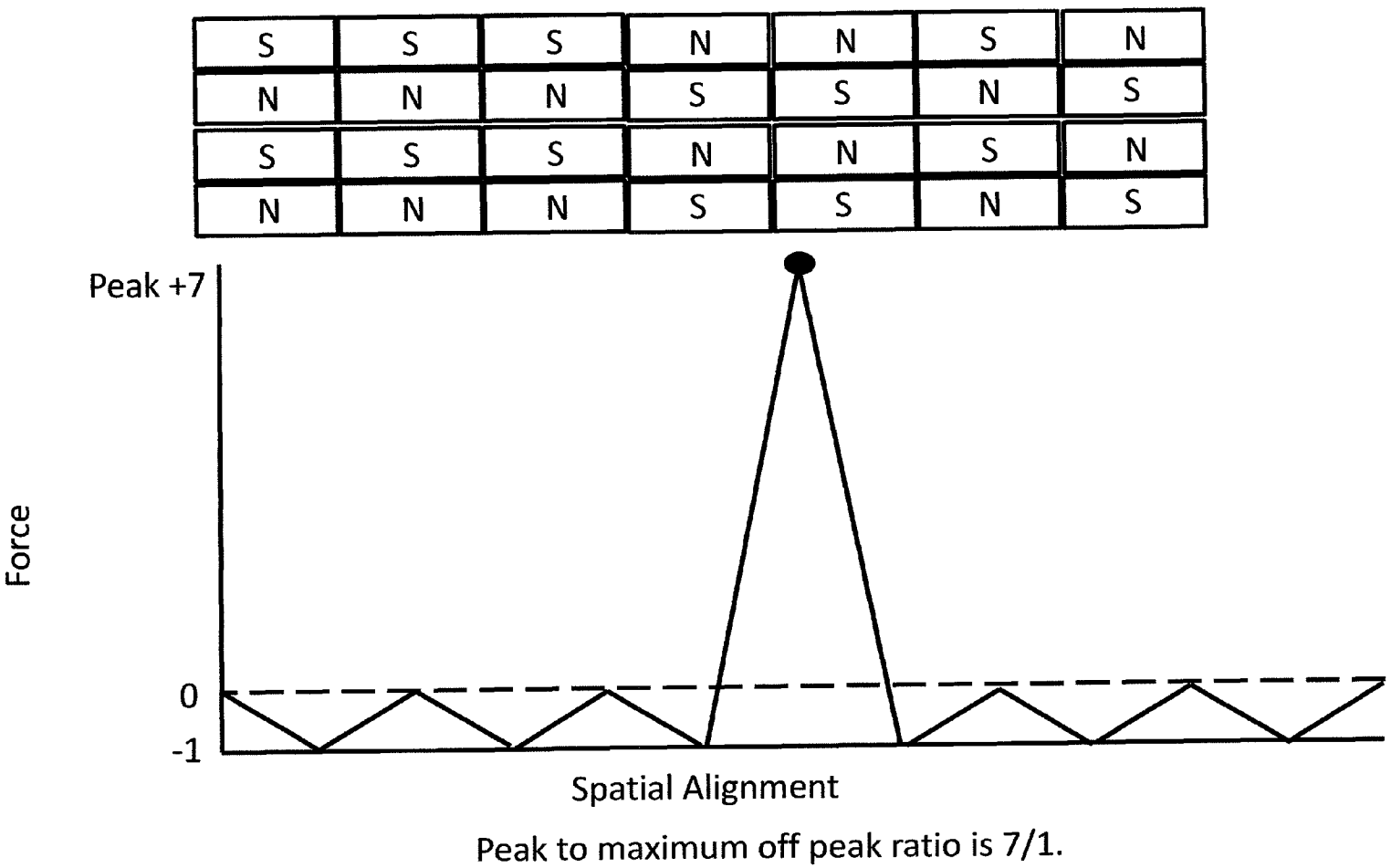
FIG. 13 depicts an exemplary spatial force function of two linear complementary magnetic structures having polarity patterns in accordance with a Barker 7 code.

FIG. 13 depicts an exemplary spatial force function of two linear complementary magnetic structures having polarity patterns in accordance with a Barker 7 code, where a peak force of 7 is produced when the structures are aligned and the side lobe forces are 0 and −1.

Figure 14:
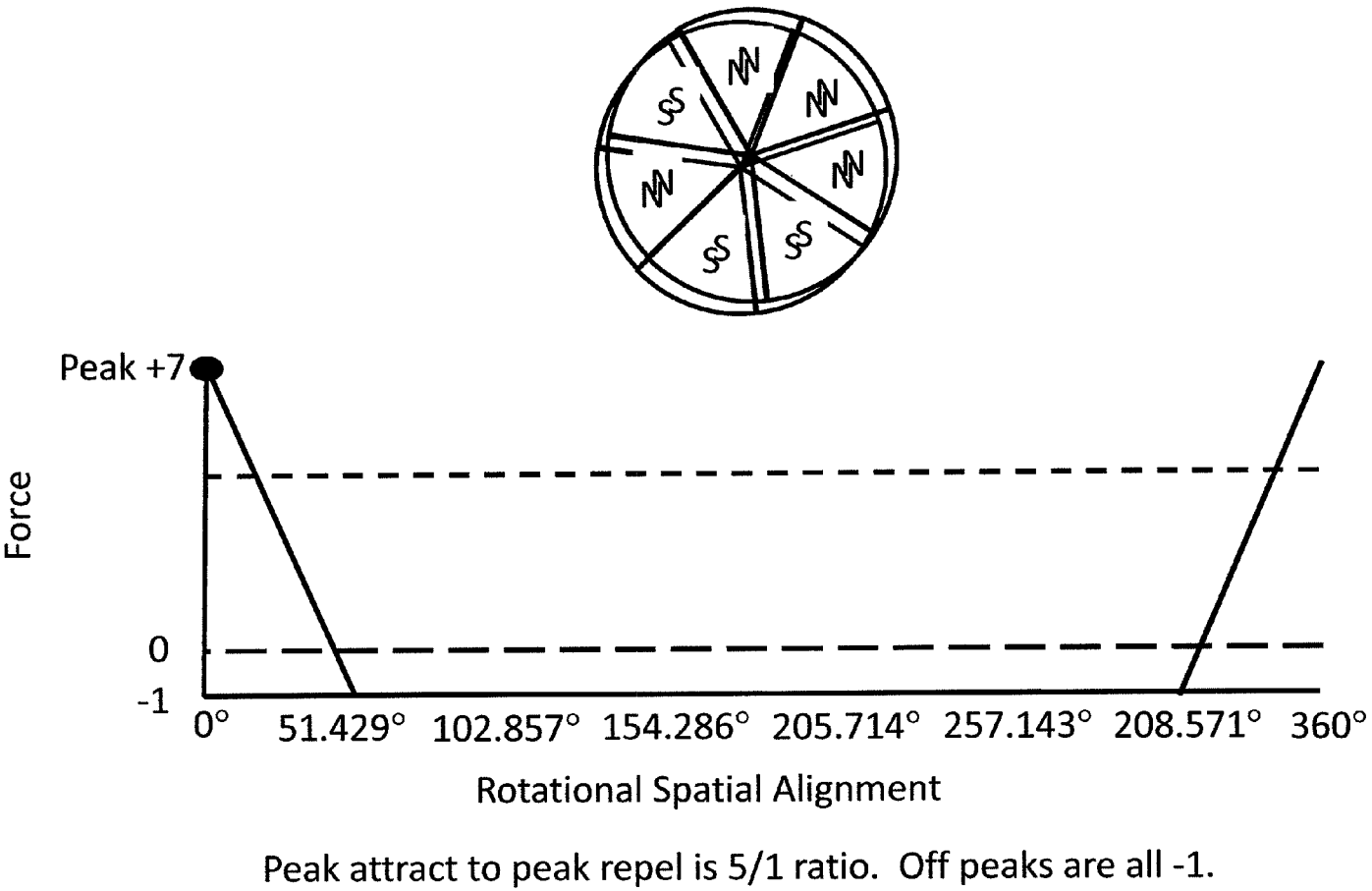
FIG. 14 depicts an exemplary spatial force function of two circular complementary magnetic structures having polarity patterns in accordance with a Barker 7 code.

FIG. 14 depicts an exemplary spatial force function of two circular complementary magnetic structures having polarity patterns in accordance with a Barker 7 code, where the peak force is 7 and the off peak forces are all −1.

Figure 15:
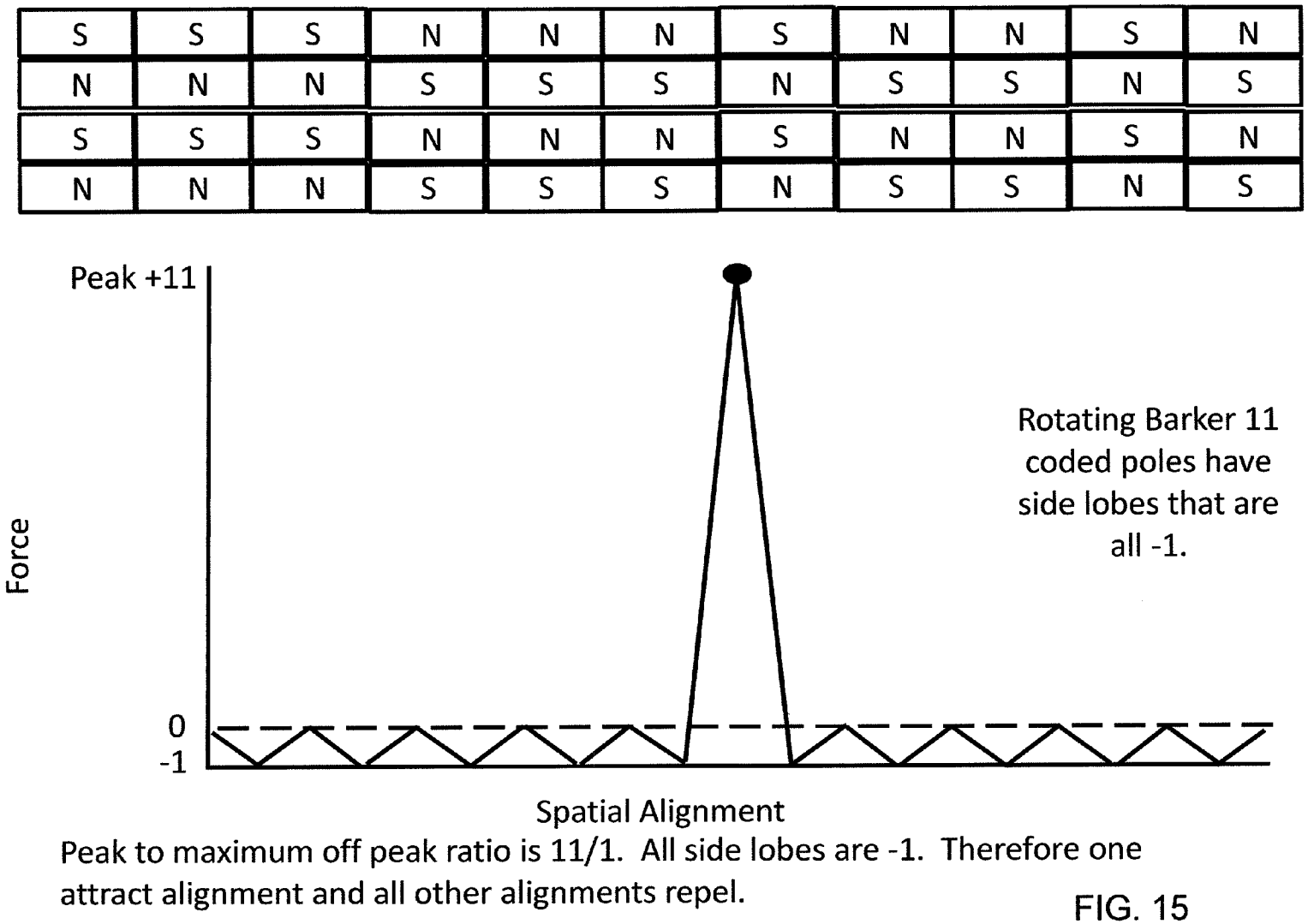
FIG. 15 depicts an exemplary spatial force function of two linear complementary magnetic structures having polarity patterns in accordance with a Barker 11 code.

FIG. 15 depicts an exemplary spatial force function of two linear complementary magnetic structures having polarity patterns in accordance with a Barker 11 code, where there is a peak lobe force of 11 and off peak lobe forces of 0 and −1. Although, not shown, and as would be expected based on the teachings above, a cyclic implementation of the Barker 11 code produces a peak lobe attract force of 11 and has constant off peak repel forces of −1.

Figure 16A:
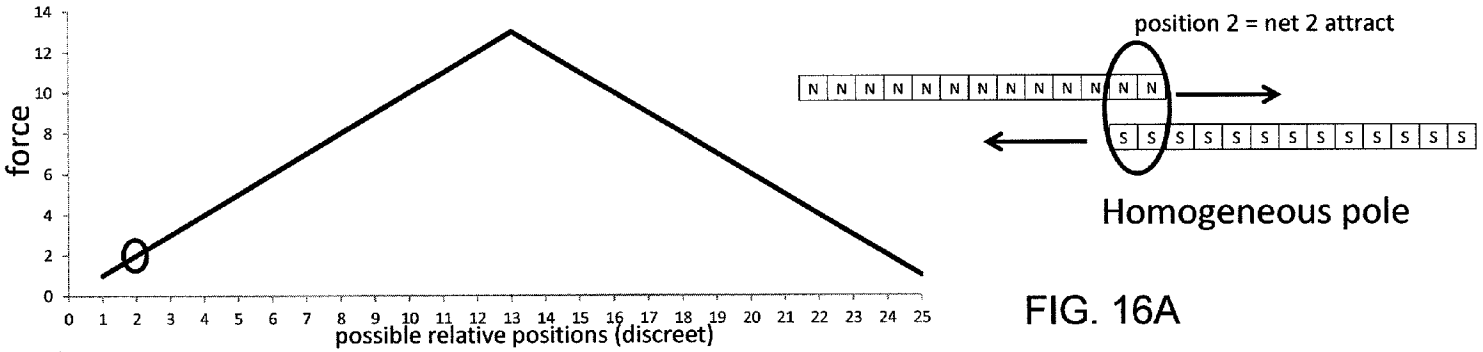
FIGS. 16A-16C depict exemplary spatial force functions of three sets of linear complementary structures having homogenous pole, alternating pole, and Barker 13 coded poles, respectively.
Figure 16B:
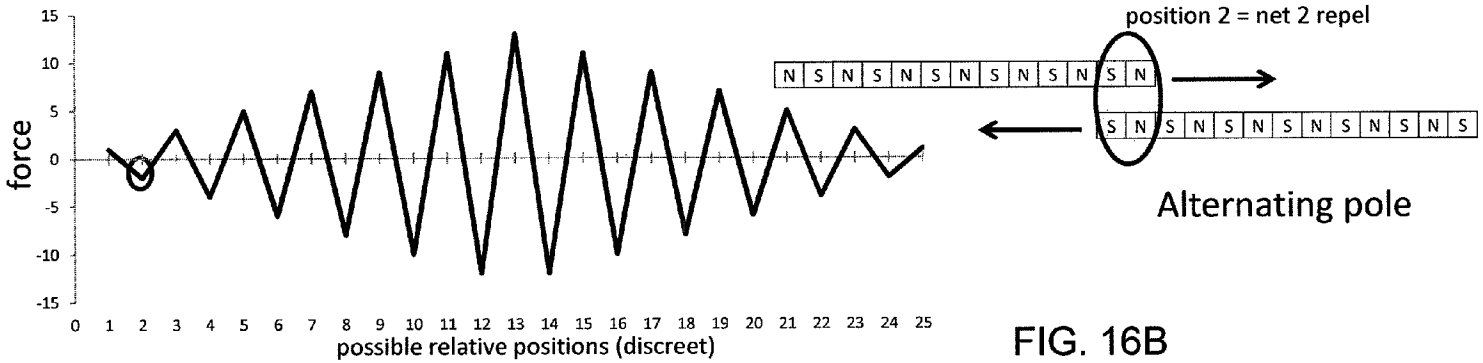
Figure 16C:
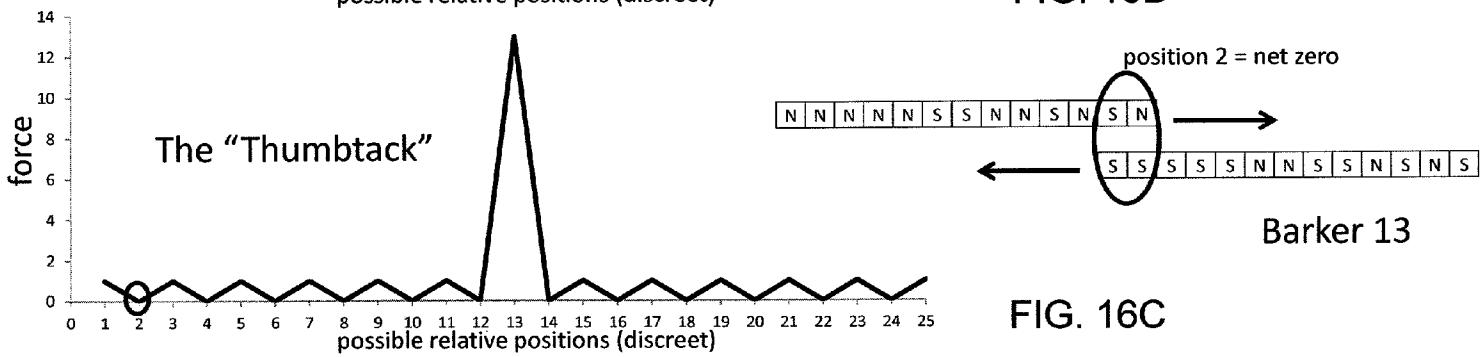

FIGS. 16A-16C depict exemplary spatial force functions of three sets of linear complementary structures having homogenous pole, alternating pole, and Barker 13 coded poles, respectively.

Figures 17A, 17B, 17C:
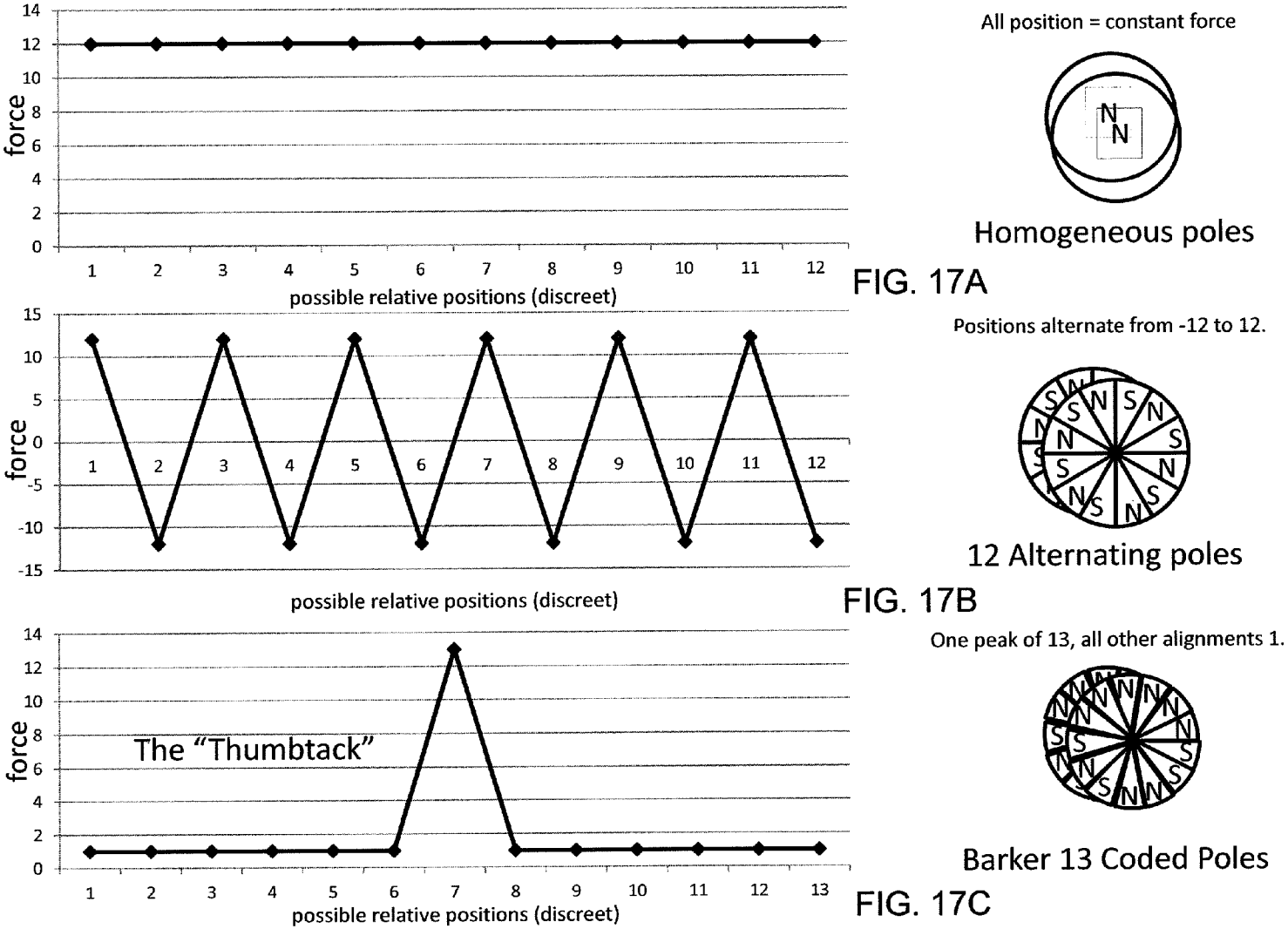
FIGS. 17A-17C depict exemplary spatial force functions of three sets of circular complementary structures having homogenous pole, alternating pole, and Barker 13 coded poles, respectively.
Figure 18A:
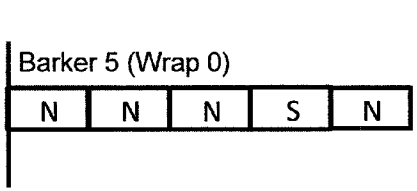
FIGS. 18A-18E depict an exemplary Barker 5 code wrap family.
Figure 18B:
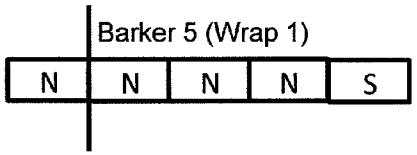
Figure 18C:
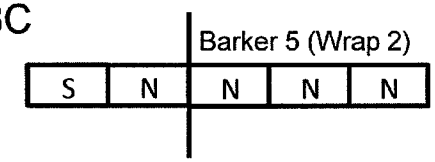
Figure 18D:
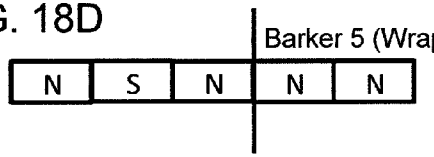
Figure 18E:
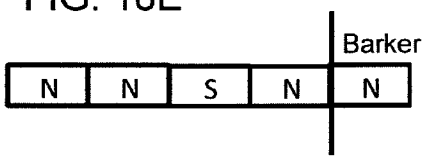
Figure 19A:
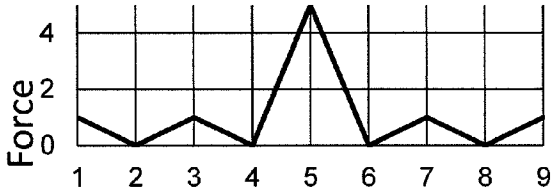
FIGS. 19A-19E depict the correlation functions of the exemplary Barker 5 code wrap family of FIGS. 18A-18E.
Figure 19B:
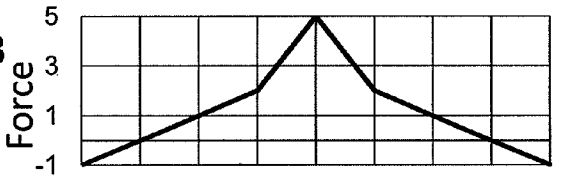
Figure 19C:
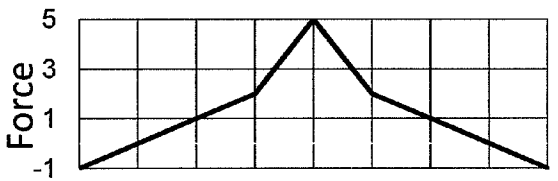
Figure 19D:
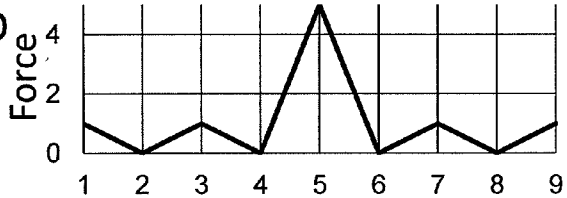
Figure 19E:
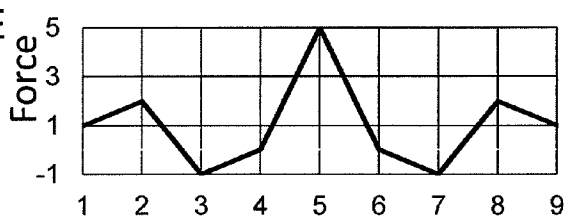
Figure 20A:
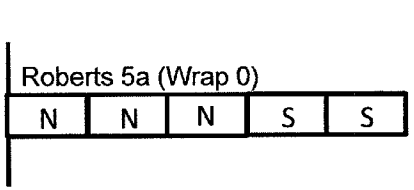
FIGS. 20A-20E depict an exemplary Roberts 5a code wrap family.
Figure 20B:
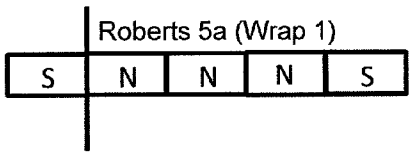
Figure 20C:
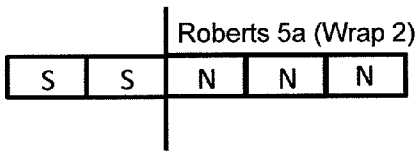
Figure 20D:
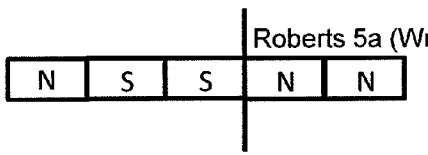
Figure 20E:
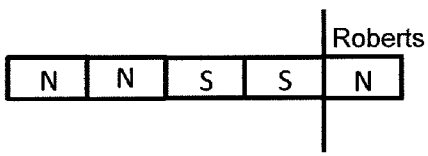

FIGS. 17A-17C depict exemplary spatial force functions of three sets of circular complementary structures having homogenous pole, alternating pole, and Barker 13 coded poles, respectively.

Barker Coded magnetic structures fall into three magnetic behavioral type categories for both linear and cyclic complementary (peak attract) and anti-complementary (AC, peak repel) implementations as detailed in Table 1.

TABLE 1

Barker Code Magnetic Behaviors

| Type | Barker Codes | Comp. Linear | Comp. Cyclic | Anti-Comp. Linear | Anti-comp Cyclic |
|---|---|---|---|---|---|
| 1 | 4a, 4b | ML = N<br>SL = 0, −1, 1 | ML = N<br>SL = 0 | ML = −N<br>SL = 0, −1, 1 | ML = −N<br>SL = 0 |
| 2 | 3, 7, 11 | ML = N<br>SL = 0, −1 | ML = N<br>SL = −1 | ML = −N<br>SL = 0, 1 | ML = −N<br>SL = 1 |
| 3 | 5, 13 | ML = N<br>SL = 0, 1 | ML = N<br>SL = 1 | ML = −N<br>SL = 0, −1 | ML = −N<br>SL = −1 |

As seen in Table 1, type 1 complementary structures have side lobes (SL) of 0, −1, and 1. Type 2 complementary structures have side lobes of 0 and −1. Type 3 complementary structures have side lobes of 0 and 1. All three types have a main lobe (ML) equal to the number of elements (N). So, Type 1 structures have strong attachment, weak attachment, and weak repel behavioral modes. Type 2 complementary structures have strong attachment and weak repel behavioral modes. Type 3 complementary structures have strong attachment and weak attachment behavioral modes. AC structures have main lobes and side lobes that are the opposite of complementary. Type 1 AC structures have side lobes of 0, −1, and 1. Type 2 AC structures have side lobes of 0 and 1. Type 3 AC structures have side lobes of 0 and −1. All three types have a main lobe equal to minus the number of elements (−N). So, Type 1 AC structures have strong repel, weak attachment, and weak repel behavioral modes. Type 2 AC structures have a strong repel and weak attract behavioral modes. Type 3 AC structures have a strong repel and weak repel behavioral modes.

For certain applications where the movement of magnetic structures is constrained, code wrap families are possible that have desirable auto-correlation and cross-correlation properties. In accordance with the invention, code elements of length N one-dimensional codes, or code element sequences or patterns, e.g., Barker codes, are shifted (or wrapped) to produce families of length N one-dimensional codes. One-dimensional codes can be wrapped, whereby M of N code elements are taken off one end of the code and wrapped (or brought) around to the other side. To produce a code wrap family, a code can be wrapped left to right, where code elements are moved from the left side of a code to the right side of a code, or a code can be or wrapped right to left, where code elements are moved from the right side of a code to the left side of the code, where the members of the resulting code wrap family are the same regardless of which direction of code wrapping is used.

FIGS. 18A-18E depict a five member family of length 5 codes produced by code wrapping a Barker 5 code (N N N S N) from right to left, where the corresponding correlation functions, or spatial force functions, of linear implementations of each member of the code family aligning with a complementary code are depicted in FIGS. 19A-19E, respectively. The correlation functions for the linear and cyclic implementations of a Barker 5 code were previously provided in FIGS. 11 and 12. One skilled in the art will understand that a Barker 5 code could be otherwise represented by (S S S N S), (+ + + − +), (− − − + −), (1, 1, 1, −1, 1), (−1, −1, −1, 1, −1), or any other desired notation for representing a Barker 5 polarity pattern.

Code wrapping may have the effect of changing the direction (or order) of a code but not otherwise change correlation properties or magnetic behavioral type (e.g., FIGS. 18A and 18D) or code wrapping can result in substantial changes to correlation properties and magnetic behavior. It should be noted that the concept of code wraps does not apply to cyclic implementations of a one-dimensional code, since a cyclic sequence of code elements has the same correlation function regardless of what is selected as being the first element in the sequence, which merely corresponds to an arbitrary starting point in a circle (e.g., 0°).

Table 2 presents linear Barker 3, Barker 4a, Barker 4b, and Barker 5 code wrap families produced by code wrapping the Barker codes from right to left. The Barker 3, Barker 4a, Barker 4b, and Barker 5 codes are a special class of Barker codes each having 1/(N−1) polarity ratios, where there is one code element of one polarity and N−1 code elements of the opposite polarity in each of the codes of the various code wrap families. The Barker 3 code wrap 2 code is an alternating polarity pattern that doesn't produce canceling forces. As such, it can be discarded from the code wrap family. The side lobe notation discloses the side lobes on one side of the main lobe, where one skilled in the art will recognize that the side lobes on each side of the main lobe are symmetrical. For example, the notation 0, −1 corresponds to the linear Barker 3 correlation function of −1, 0, 3, 0, −1.

TABLE 2

Barker Code Wrap Families Having 1/(N − 1) Polarity Ratios

| Code | Wrap | Pattern | Side lobes | Type | Comments |
|---|---|---|---|---|---|
| Barker 3 | 0 | ++− | 0, −1 | 2 | |
| | 1 | −++ | 0, −1 | 2 | B3 reversed |
| | 2 | +−+ | **−2**, −1 | Alt | Uniformly Alternating Discard |
| Barker 4a | 0 | ++−+ | −1, 0, **1** | 1 | S1Delta = 5, S2Delta = 4 |
| | 1 | +++− | **1**, 0, −1 | 1 | S1Delta = 3, S2Delta = 4 B4aw2 reversed |
| | 2 | −+++ | **1**, 0, −1 | 1 | S1Delta = 3, S2Delta = 4 B4aw1 reversed |
| | 3 | +−++ | −1, 0, **1** | 1 | S1Delta = 5, S2Delta = 4 B4a reversed |
| Barker 4b | **0** | +++− | **1**, 0, −1 | 1 | B4aw1 |
| | 1 | −+++ | **1**, 0, −1 | 1 | B4aw2 |
| | 2 | +−++ | −1, 0, **1** | 1 | B4aw3 |
| | 3 | ++−+ | −1, 0, **1** | 1 | B4a |
| Barker 5 | 0 | +++−+ | 0, **1**, 0, **1** | 3 | S1Delta = 5 S2Delta = 4 |
| | 1 | ++++− | 2, **1**, 0, −1 | 1 | 5/2 ratio, Rev. B5w2 S1Delta = 3, S2Delta = 4 |
| | 2 | −++++ | 2, **1**, 0, −1 | 1 | 5/2 ratio, Rev. B5w1 S1Delta = 3, S2Delta = 4 |
| | 3 | +−+++ | 0, **1**, 0, **1** | 3 | B5 Reversed |
| | 4 | ++−++ | 0, −1, **2**, **1** | 1 | 5/2 ratio S1Delta = 5 S2Delta = 6 |

Bold = Attach Side Lobe

The code wrap families of Table 2 have some interesting magnetic behavior attributes. Each code wrap family has a first family member that is the reversal (in direction) of a second family member, where the Barker 4a, Barker 4b, and Barker 5 code wrap families also have a third family member that is the reversal of a fourth family member. The Barker 3 family includes a uniformly alternating polarity pattern (+ − +), where the alternating polarity magnetic sources are the same size, and the Barker 5 family includes a family member (+ + − + +) that is a non-uniformly alternating polarity pattern, where the right most and left most poles represent twice the pole width as the middle pole. The Barker 4a and 4b code families are the same, which is to be expected given that the Barker 4a code is a shifted or wrapped Barker 4b code. Introduced in the comments portion of the table are the concepts of S1Delta and S2Delta, which are exemplary factors corresponding to the force differences between the closest side lobes to the main lobe and the next closest side lobes to the main lobe. These and other such factors can be important in characterizing the magnetic behavior of two structures because the wrapping of codes can make magnetic behaviors vary substantially over the width of the code (i.e., the code space) and as such it can be important to recognize the distances between a given lobe (e.g., the main lobe) and corresponding nearby side lobes and the force patterns that exist. For example, a Barker 4a and a Barker 4aw3 (i.e., Barker 4 wrap 3) code have a S1Delta of 5, whereas the Barker 4aw1 and Barker 4aw2 codes have a S1Delta of 3. As such, Barker 4a and Barker 4aw3 magnetic structures have a greater net force causing a first magnetic structure to move relative to the second magnetic structure when there relative alignments corresponds to either of the side lobe positions nearest the main lobe position. If S1Delta is greater than N then a negative side lobe is next to the main lobe, which means the structures will be repelled away from the negative side lobe which typically will be towards the main lobe. If S2Delta is greater than S1 Delta then there is a greater tendency for the auto-alignment movement of two structures to begin further away from the main lobe alignment position.

Also of possible interest are the locations of attract (or attach) side lobes. For example, the Barker 4a and Barker 4aw3 codes have stable attract alignments when just one magnet of each of two complementary structures are aligned. As such, when coming from the right or coming from the left, two structures will tend to want to attach to each other. The next lobe over is 0 and then −1. To move one structure across the other, a force sufficient to overcome the attract force must be applied and then a force sufficient to overcome the repel force must be applied before the attractive force of the main lobe will result in auto alignment. In contrast, the Barker 4aw1 and Barker 4aw2 codes require a force sufficient to overcome the outermost repel side lobe but then the inner positive side lobe will pull the magnetic structure(s) to its corresponding alignment position and depending on various factors (e.g., friction, magnet separation distance, etc.) the magnetic structure(s) will then move over to the peak lobe position.

One skilled in the art will recognize that all sorts of differentiating factors can be established for comparing linear (or cyclic) implementations of one-dimensional length N codes, which may include corresponding code family members. Factors such as the number of elements from main lobe to largest side lobe, number of elements between the largest attract side lobe and the largest repel side lobe, the number of attract lobes, the number of repel lobes, the location of the attract lobe furthest from the main lobe, and so on. Generally, a desired magnetic behavior can be selected and one or more factors (or criteria) can be established and used to grade or rate different combinations of magnetic sources having polarities based on the one-dimensional length N codes.

Table 3 presents the code wrap families for the remaining Barker codes, i.e., lengths 7, 11, and 13, that each have polarity ratios greater than 1/(N−1). Correlation functions for the Barker 7 code wrap family are also provided in FIGS. 28A-28G.

TABLE 3

Barker Code Wrap Families Having Polarity Ratios Greater Than 1/(N − 1)

| Code | Wrap | Pattern | Side lobes | Type | Comments |
|---|---|---|---|---|---|
| Barker 7 | 0 | +++−−+− | 0, −1, 0, −1, 0, −1 | 2 | 7/1 ratio, S1Delta = 7, S2Delta = 8 |
| | 1 | −+++−−+ | 0, −3, −2, **1**, **2**, −1 | 1 | 7/3 ratio, 7/2 attract ratio, S1Delta = 7, S2Delta = 10 |
| | 2 | +−+++−− | 0, −3, −2, **1**, 0, −1 | 1 | 7/3 ratio, 7/1 attract ratio, S1Delta = 7, S2Delta = 10 |
| | 3 | −+−+++− | −2, **1**, −2, **1**, −2, **1** | 1 | 7/2 ratio, 7/1 attract ratio S1Delta = 9, S2Delta = 6 |
| | 4 | −−+−+++ | 0, **1**, 0, −1, **2**, −1 | 1 | 7/2 ratio, 7/2 attract ratio S1Delta = 7, S2Delta = 6 |
| | 5 | +−−+−++ | **2**, −1, **2**, −3, 0, **1** | 1 | 7/3 ratio, 7/2 attract ratio S1Delta = 5, S2Delta = 8 |
| | 6 | ++−−+−+ | −2, −1, 0, −1, 0, **1** | 1 | 7/2 ratio, 7/1 attract ratio S1Delta = 9, S2Delta = 8 |
| Barker 11 | 0 | +++−−−+−−+− | 0, −1, 0, −1, 0, −1, 0, −1, 0, −1 | 2 | S1 Delta = 11, S2 Delta = 12 |
| | 1 | −+++−−−+−−+ | 0, −3, −2, **1**, 0, −1, −2, **1**, **2**, −1 | 1 | 11/3 ratio, 11/2 attract ratio S1 Delta = 11, S2Delta = 14 |
| | 2 | +−+++−−−+−− | 0, −1, −2, **3**, 0, −1, −4, **1**, 0, −1 | 1 | 11/4 ratio, 11/3 attract ratio S1 Delta = 11, S2Delta = 12 |
| | 3 | −+−+++−−−+− | −2, **1**, −4, **1**, −2, **1**, −2, **3**, −2, **1** | 1 | 11/4 ratio, 11/3 attract ratio S1 Delta = 13, S2Delta = 10 |
| | 4 | −−+−+++−−−+ | 0, −1, −4, −1, −2, **1**, 0, **3**, 0, −1 | 1 | 11/4 ratio, 11/3 attract ratio S1 Delta = 11, S2Delta = 12 |
| | 5 | +−−+−+++−−− | 0, −1, −2, −3, −2, **1**, **2**, **1**, 0, **1** | 1 | 11/3 ratio, 11/2 attract ratio S1 Delta = 11, S2Delta = 12 |
| | 6 | −+−−+−+++−− | −2, −1, 0, −3, 0, −1, **2**, −1, 0, **1** | 1 | 11/3 ratio, 11/2 attract ratio S1 Delta = 13, S2Delta = 12 |
| | 7 | −−+−−+−+++− | −2, −1, **2**, −1, −2, **1**, 0, −3, 0, **1** | 1 | 11/3 ratio, 11/2 attract ratio S1 Delta = 13, S2Delta = 12 |
| | 8 | −−−+−−+−+++ | 0, **1**, **2**, −1, 0, −1, 0, −3, −2, −1 | 1 | 11/3 ratio, 11/2 attract ratio S1 Delta = 11, S2Delta = 10 |
| | 9 | +−−−+−−+−++ | −2, −1, **2**, −1, 0, −1, 0, −3, 0, **1** | 1 | 11/3 ratio, 11/2 attract ratio S1 Delta = 13, S2Delta = 12 |

TABLE 3-continued

| Barker Code Wrap Families Having Polarity Ratios Greater Than 1/(N − 1) | | | | | |
|---|---|---|---|---|---|
| Code | Wrap | Pattern | Side lobes | Type | Comments |
| | 10 | ++−−−+−−+−+ | −2, −1, 0, −1, **2**, −3, 0, −1, 0, **1** | 1 | 11/3 ratio, 11/2 attract ratio S1Delta = 13, S2Delta = 12 |
| Barker 13 | 0 | +++++−−++−+−+ | 0, **1**, 0, **1**, 0, **1**, 0, **1**, 0, **1**, 0, **1**, 0, **1** | 3 | 13/1 ratio, 13/1 attract ratio S1Delta = 13, S2Delta = 12 |
| | 1 | ++++++−−++−+− | **2**, **1**, **2**, **1**, 0, **1**, 0, **1**, 0, −1, 0, −1 | 1 | 13/2 ratio, 13/2 attract ratio S1Delta = 11, S2Delta = 12 |
| | 2 | −++++++−−++−+ | **2**, −1, **2**, **1**, −2, −1, **2**, **3**, 0, −1, **2**, −1 | 1 | 13/3 ratio, 13/3 attract ratio S1Delta = 11, S2Delta = 14 |
| | 3 | +−++++++−−++− | **2**, −1, **2**, **3**, 0, −1, **2**, **1**, −2, −1,, **2**, −1 | 1 | 13/3 ratio, 13/3 attract ratio S1Delta = 11, S2Delta = 14 |
| | 4 | −+−++++++−−++ | **2**, **1**, 0, **1**, 0, −1, **2**, **1**, 0, **1**, 0, −1 | 1 | 13/2 ratio, 13/2 attract ratio S1Delta = 11, S2Delta = 12 |
| | 5 | +−+−++++++−−+ | 0, **3**, 0, **1**, 0, −1, **2**, **1**, 0, **1**, −2, **1** | 1 | 13/3 ratio, 13/3 attract ratio S1Delta = 13, S2Delta = 10 |
| | 6 | ++−+−++++++−− | **2**, **3**, 0, −1, 0, −1, **2**, **1**, **2**, **1**, −2, −1 | 1 | 13/3 ratio, 13/3 attract ratio S1Delta = 11, S2Delta = 10 |
| | 7 | −++−+−++++++− | 0, **3**, **2**, −1, **2**, −1, **2**, −1, **2**, −1, −2, **1** | 1 | 13/3 ratio, 13/3 attract ratio S1Delta = 13, S2Delta = 10 |
| | 8 | −−++−+−++++++ | **2**, **3**, **2**, **1**, **2**, **1**, 0, −1, 0, −1, −2, −1 | 1 | 13/3 ratio, 13/3 attract ratio S1Delta = 13, S2Delta = 12 |
| | 9 | +−−++−+−+++++ | 0, **1**, **2**, **1**, 0, **3**, −2, **1**, 0, −1, 0, **1** | 1 | 13/3 ratio, 13/3 attract ratio S1Delta = 13, S2Delta = 12 |
| | 10 | ++−−++−+−++++ | 0, −1, 0, **1**, **2**, **1**, 0, −1, 0, **1**, **2**, **1** | 1 | 13/2 ratio, 13/2 attract ratio S1Delta = 13, S2Delta = 14 |
| | 11 | +++−−++−+−++++ | 0, −1, −2, **1**, **2**, **3**, −2, −1, 0, **3**, **2**, **1** | 1 | 13/3 ratio, 13/3 attract ratio S1Delta = 13, S2Delta = 14 |
| | 12 | ++++−−++−+−++++ | 0, −1, 0, −1, **2**, **3**, −2, −1, 2, **1**, **2**, **1** | 1 | 13/3 ratio, 13/3 attract ratio S1Delta = 13, S2Delta = 14 |

Unlike the code wrap families of Table 2, the code wrap families of Table 3 don't have members that are directional reversals of other members. There are also not any symmetrical alternating polarity patterns such as the + − + and + + −+ + patterns. There are however some magnetic behaviors of special interest. For example, the Barker 7 wrap 3 code has an interesting magnetic behavior when compared to the Barker 7 code. In both codes, there is a main lobe and then a saw tooth side lobe behavior on each side of the main lobe. With the Barker 7 code, the saw tooth side lobe behavior has a delta of 1 oscillating from 0 to −1, whereas the Barker 7 wrap 3 code has a saw tooth side lobe behavior that has a delta of 3 oscillating from −2 to 1. Another example is the Barker 7 wrap 6 code that has only one positive side lobe on either side of the main lobe that are on the outer perimeter of the code space where there are zero and negative side lobes in between the positive side lobes and the main lobe. Similarly, the Barker 7 wrap 2 code has only one positive side lobe on either side of the main lobe except the locations of the positive side lobes are shifted inward from the outer perimeter of the code space by two alignment positions.

Barker 11 code wrap 10 has positive side lobes (1) on the outer perimeter of the side lobe code space and has positive side lobes (2) half way between the outer perimeter and the main lobe. Similarly, Barker 11 code wrap 9 and Barker 11 code wrap 6 have attract positions on the perimeter and attract positions between the outer perimeter and the main lobe where they are shifted away from the halfway position by two positions (i.e., left and right, respectively). Barker 13 code wrap 10 has side lobes that vary over space much like a sine wave. Barker 13 code wrap 6 has positive side lobes on the inner halves of the side lobe code space nearest the main lobe and negative and zero side lobes on the outer halves of the side lobe code space. Thus, as can be seen in Table 2 and Table 3, code wrap techniques can be used to achieve desirable magnetic behaviors required to meet different application requirements.

Figure 21A:
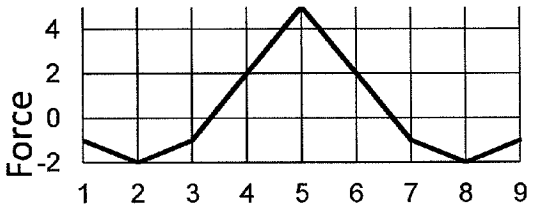
FIGS. 21A-21E depict exemplary correlation functions of linear implementations of the Roberts 5a code wrap family of FIGS. 20A-20E.
Figure 21B:
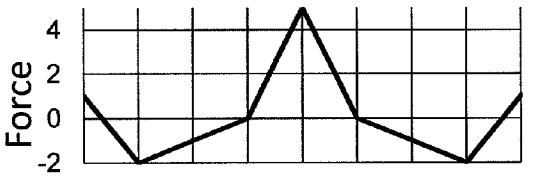
Figure 21C:
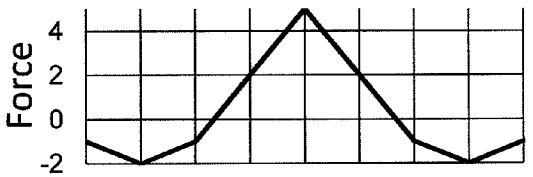
Figure 21D:
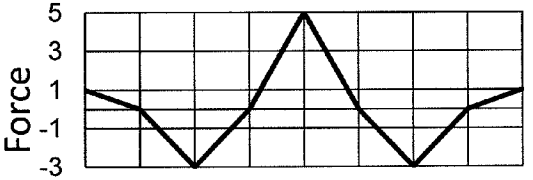
Figure 21E:
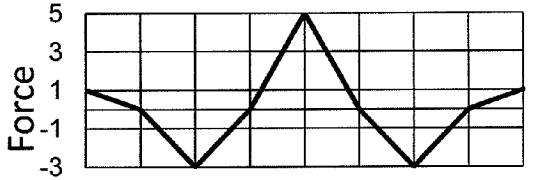
Figure 21K:
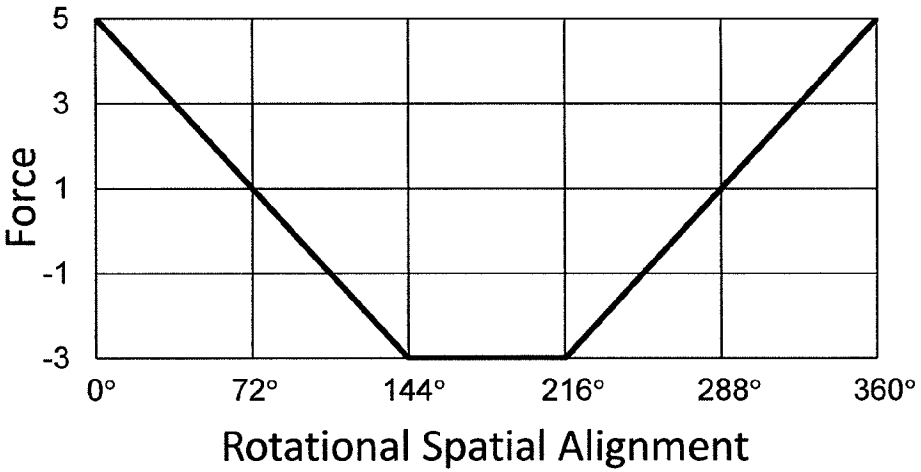
FIGS. 21K and 21L depict exemplary correlation functions of the cyclic implementations of the Roberts 5a and Roberts 5b codes depicted in FIGS. 20K and 20L.
Figure 21L:
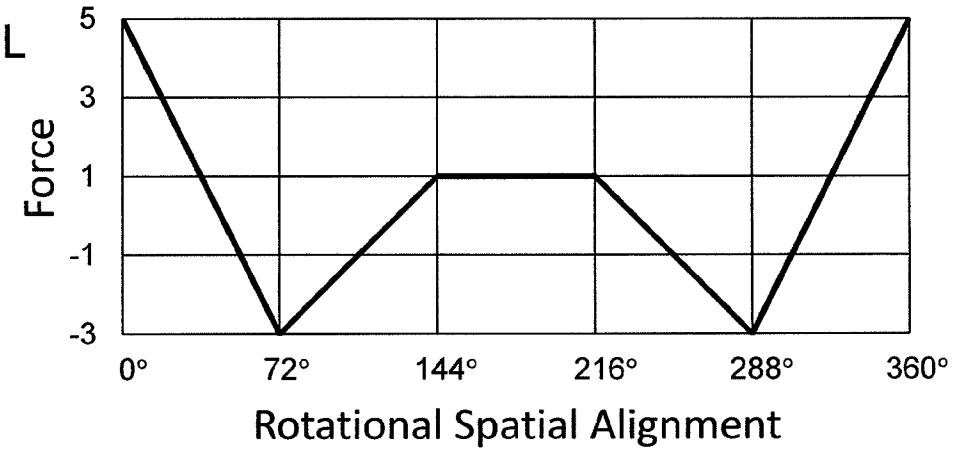
Figure 20K:
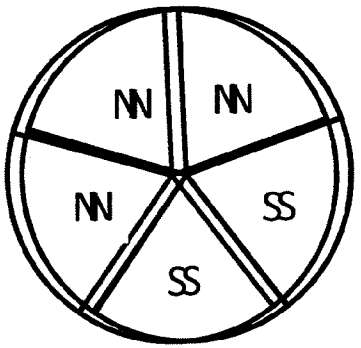
FIGS. 20K and 20L depict exemplary cyclic implementations of the Roberts 5a and Roberts 5b codes.
Figure 20L:
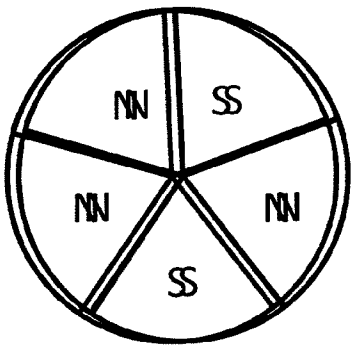

In accordance with the invention, one-dimensional codes other than Barker codes having a code length greater than four (i.e., N>4) can define magnetic structures that produce canceling magnetic forces when the structures are misaligned. As such, these codes define zero and non-zero side lobes when the codes are misaligned. Such codes are referred to as Roberts codes, where code wrap families of Roberts codes can be produced using the wrapping techniques previously described for Barker codes. Table 4 presents Roberts 5 a and Roberts 5b cod e wrap families each having a polarity ratio of 2/3, whereas a Barker 5 code has a polarity ration of 1/5. The Roberts 5a code family is depicted in FIGS. 20A-20E and the corresponding correlation functions of the code family members are depicted in FIGS. 21A-21E. The Roberts 5b code family is depicted in FIGS. 20E-20J and the corresponding correlation functions of the code family members are depicted in FIGS. 21F-21J. Cyclic implementations of Roberts 5a and 5b codes are depicted in FIGS. 20K and 20L, respectively. Roberts 5a codes have a cyclic correlation function of 5, 1, −3, −3, 1 and Roberts 5b codes have a cyclic correlation function of 5, −3, 1, 1, −3, such as depicted in FIGS. 21K and 21L, respectively.

TABLE 4

Roberts 5 Code Wrap Families

| Code | Wrap | Pattern | Side lobes | Type | Comments |
|---|---|---|---|---|---|
| Roberts 5a | 0 | +++−− | **2**, −1, −2, −1 | 1 | 5/2 ratio<br>5/2 attract ratio<br>S1Delta = 3<br>S2Delta = 6 |
| | 1 | −+++− | 0, −1, −2, **1** | 1 | 5/2 ratio<br>5/1 attract ratio<br>S1Delta = 5<br>S1Delta = 6 |
| | 2 | −−+++ | **2**, −1, −2, −1 | 1 | R5a reversed |
| | 3 | +−−++ | 0, −3, 0, **1** | 1 | R5aw4 reversed<br>5/3 ratio<br>5/1 attract ratio<br>S1Delta = 5<br>S2Delta = 8 |
| | 4 | ++−−+ | 0, −3, 0, **1** | 1 | R5aw5 reversed<br>5/3 ratio<br>5/1 attract ratio<br>S1Delta = 5<br>S2Delta = 8 |
| Roberts 5b | 0 | ++−+− | −2, **1**, 0, −1 | 1 | 5/2 ratio<br>5/1 attract ratio<br>S1Delta = 7<br>S1Deltat = 4 |
| | 1 | −++−+ | −2, −1, **2**, −1 | 1 | 5/2 ratio<br>5/2 attract ratio<br>S1Delta = 7<br>S1Deltat = 6 |
| | 2 | +−++− | −2, −1, **2**, −1 | 1 | R5bw1 reversed |
| | 3 | −+−++ | −2, **1**, 0, −1 | 1 | R5b reversed |
| | 4 | +−+−+ | **−4**, 3, −2, **1** | Alt | Uniformly alternating polarity - discard |

When implemented linearly, certain Roberts 5 codes have greater than a 2/1 main lobe to maximum side lobe ratios and all have greater than a 2/1 main lobe to maximum stable attach (or attract) side lobe except for the case of the discarded uniformly alternating polarity code, where a stable attract side lobe is at a relative alignment position where two magnetic structures will maintain their alignment. When implemented cyclically, Roberts 5a codes have constant repel region from 144° to 216°, where the magnets will tend to rotate to at least one of the +1 off peak positions if not the peak force alignment position. In contrast, due to opposing repel forces on either side of a constant attract force 'plateau', cyclically implemented Roberts 5b codes will tend to stay at any alignment position from 144° to 216°, where overcoming the repel forces to a position within 72° of the peak force alignment position will result in the magnetic structures aligning in the peak force alignment position.

Table 5 presents Roberts 6 code wrap families of which several codes are discarded.

TABLE 5

Roberts 6 Code Wrap Families

| Code | Wrap | Pattern | Side lobes | Type | Comments |
|---|---|---|---|---|---|
| Roberts 6a | 0 | +++++− | 3, 2, 1, 0, −1 | 1 | 6/3 ratio<br>6/3 attract ratio<br>S1Delta = 3<br>S2Delta = 4 |
| | 1 | −+++++ | 3, 2, 1, 0, −1 | 1 | R6aw1 reversed |
| | 2 | +−++++ | **1**, **2**, **1**, 0, **1** | 2 | 6/2 ratio<br>6/2 attract ratio<br>S1Delta = 5<br>S2Delta = 6 |

TABLE 5-continued

Roberts 6 Code Wrap Families

| Code | Wrap | Pattern | Side lobes | Type | Comments |
|---|---|---|---|---|---|
| | 3 | ++−+++ | **1**, 0, **1**, **2**, **1** | 2 | 6/2 ratio<br>6/2 attract ratio<br>S1Delta = 5<br>S2Delta = 4 |
| | 4 | +++−++ | **1**, 0, **1**, **2**, **1** | 2 | R6aw4 reversed |
| | 5 | ++++−+ | **1**, **2**, **1**, **0**, **1** | 2 | R6aw2 reversed |
| Roberts 6b | 0 | ++++−− | **3**, 0, −1, −2, −1 | 1 | Barker 3<br>Discard |
| | 1 | −++++− | 1, 0, −1, −2, 1 | 1 | 6/2 ratio<br>6/1 attract ratio<br>S1Delta = 5<br>S2Delta = 6 |
| | 2 | −−++++ | **3**, 0, −1, −2, −1 | 1 | R6b reversed<br>Discard |
| | 3 | +−−+++ | 1, −2, −1, 0, 1 | 1 | 6/2 ratio<br>6/1 attract ratio<br>S1Delta = 5<br>S2Delta = 8 |
| | 4 | ++−−++ | 1, −4, −1, 2, 1 | Alt | Uniformly alternating<br>Discard |
| | 5 | +++−−+ | 1, −2, −1, 0, 1 | 1 | R6bw3 reversed |
| Roberts 6c | 0 | +++−+− | −1, **2**, −1, 0, −1 | 1 | 6/2 ratio<br>6/2 attract ratio<br>S1Delta = 7<br>S1Deltat = 4 |
| | 1 | −+++−+ | −1, 0, −1, **2**, −1 | 1 | 6/2 ratio<br>6/2 attract ratio<br>S1Delta = 7<br>S1Deltat = 4 |
| | 2 | +−+++− | −1, 0, −1, **2**, −1 | 1 | R6cw1 reversed |
| | 3 | −+−+++ | −1, **2**, −1, 0, −1 | 1 | R6c reversed |
| | 4 | +−+−++ | −3, **2**, −1, 0, **1** | 1 | 6/3 ratio<br>6/2 attract ratio<br>S1Delta = 9<br>S1Deltat = 4 |
| | 5 | ++−+−+ | −3, **2**, −1, 0, **1** | 1 | R6cw4 reversed |
| Roberts 6d | 0 | ++−++− | −1, −2, 3, 0, −1 | 1 | 2 Barker 3 modulos<br>Discard |
| | 1 | −++−++ | −1, −2, **3**, 0, −1 | 1 | R6d reversed<br>Discard |
| | 2 | +−++−+ | −3, 0, **3**, −2, **1** | 1 | 6/3 ratio<br>6/2 attract ratio<br>S1Delta = 9<br>S2Delta = 6 |
| | 3 | ++−++− | −1, −2, **3**, 0, −1 | 1 | Same as R6d<br>Discard |
| | 4 | −++−++ | −1, −2, **3**, 0, −1 | 1 | R6d reversed<br>Discard |
| | 5 | +−++−+ | −3, 0, **3** −2, **1** | 1 | Same as R6w2 |
| Roberts 6e | 0 | +++−−− | **3**, 0, −3, −2, −1 | Alt | Alternating groups of 3<br>Discard |
| | 1 | −+++−− | **1**, −2, −3, 0, **1** | 1 | Complementary symbols<br>Discard |
| | 2 | −−+++− | **1**, −2, −3, 0, **1** | 1 | R6e1 reversed<br>Discard |
| | 3 | −−−+++ | **3**, 0, −3, −2, −1 | 1 | R6e0 reversed<br>Discard |
| | 4 | +−−−++ | **1**, −2, −3, 0, **1** | 1 | Complementary symbols<br>Discard |
| | 5 | ++−−−+ | **1**, −2, −3, 0, **1** | 1 | R6e4 reversed<br>Discard |
| Roberts 6f | 0 | ++−−+− | −1, −2, **1**, 0, −1 | 1 | 6/2 ratio<br>6/1 attract ratio<br>S1Delta = 7<br>S2Delta = 8 |
| | 1 | −++−−+ | −1, −4, **1**, 2, −1 | 1 | 6/4 ratio<br>6/2 attract ratio<br>S1Delta = 7<br>S2Delta = 10 |

TABLE 5-continued

Roberts 6 Code Wrap Families

| Code | Wrap | Pattern | Side lobes | Type | Comments |
|---|---|---|---|---|---|
| | 2 | +−++−− | −1, −2, **1**, 0, −1 | 1 | 6/2 ratio<br>6/1 attract ratio<br>S1Delta = 7<br>S2Delta = 8 |
| | 3 | −+−++− | −3, 0, **1**, −2, 1 | 1 | 6/3 ratio<br>6/1 attract ratio<br>S1Delta = 9<br>S2Delta = 6 |
| | 4 | −−+−++ | −1, 0, **1**, −2, **1** | 1 | 6/2 ratio<br>6/1 attract ratio<br>S1Delta = 7<br>S2Delta = 6 |
| | 5 | +−−+−+ | −3, 0, **1**, −2, **1** | 1 | 6/3 ratio<br>6/1 attract ratio<br>S1Delta = 9<br>S2Delta = 6 |

Correlation functions corresponding to linear implementations of the Roberts 6a code wrap family are provided in FIGS. 22A-22F. A code such as the Roberts 6a wrap 3 code might be used for a latch or slide that would align at either a positive side lobe or at the main lobe by overcoming the negative side lobe force from one direction or the other. A correlation function of a cyclic implementation of a Roberts 6a code is provided in FIG. 22G, which would enable a knob having a constant force over a 240° range that would ramp up to 3× that force when aligned at the peak force position.

Correlation functions corresponding to linear implementations of the Roberts 6b code wrap family are provided in FIGS. 23A-23F. The Roberts 6b wrap 0 and Roberts 6b wrap 2 codes are the same as Barker 3 codes implemented with + + and − − symbols so they were discarded as not being new codes. However, if implemented in a sparse array the correlation function may still be useful. The Roberts 6b wrap 4 code was also discarded as merely being a uniformly alternating polarity code of 1, −1, 1 implemented with + + and − − symbols. The Roberts 6b wrap 1 code might be used, for example, for a drawer slide mechanism where when opened an attachment force is provided (+1) to keep the drawer open, but applying a slight closing force that overcomes a repel force (−2) would cause the drawer to close and then snap shut when transitioning from the innermost (+1) positive lobe to the main lobe +6. A correlation function of a cyclic implementation of a Roberts 6b code is provided in FIG. 23G, where a peak force (+6) will reduce to a repel force (−2) by turning a structure clockwise or counterclockwise 120° but, when let go, the structure would rotate back to the peak force alignment position.

Correlation functions corresponding to linear implementations of the Roberts 6c code wrap family are provided in FIGS. 24A-24F. The Roberts 6c wrap 0 code might enable a mechanism where a first object will automatically align in three positions relative to another object given applied forces that overcome negative side lobe forces. A correlation function of a cyclic implementation of a Roberts 6c code is provided in FIG. 24G, which includes stable attach alignments at the positive off peak lobe positions (+2) and the main lobe alignment position (+6) with repel forces between the stable attach alignment positions.

Correlation functions corresponding to linear implementations of the Roberts 6d code wrap family are provided in FIGS. 25A-25F. All but three linear implementations of the code were discarded given they correspond to two repeating code modulos of a Barker 3 code. The correlation function of the Roberts 6d wrap 2 code provided in FIG. 25C can be compared to correlation function of the code of FIG. 20J, which is provided in FIG. 21J, to understand how the addition of a magnet in the middle of the structure causes cancellation so as to increase the peak to maximum off peak ratio from 5/4 to 6/3. The peak attract to maximum off peak attract ratio also changed from 5/3 to 6/3. A correlation function of a cyclic implementation of a Roberts 6d code is provided in FIG. 25G, which corresponds to the cyclic correlation function of two Barker 3 code modulos, and was therefore discarded.

Correlation functions corresponding to linear implementations of the Roberts 6e code wrap family are provided in FIGS. 26A-26F. The Roberts 6e wrap 0 and 3 codes are alternating polarity patterns and the Roberts 6e wrap 1, 2, 4, and 5 codes are merely an alternating code with complementary symbols. As such, all the linear implementations of the code were discarded. A correlation function of a cyclic implementation of a Roberts 6e code is provided in FIG. 26G, which corresponds to alternating pole behavior, and therefore the cyclic implementation of the code was discarded.

Correlation functions corresponding to linear implementations of the Roberts 6f code wrap family are provided in FIGS. 27A-27F. The Roberts 6f code wrap family has main lobe to maximum attract side lobe ratios of 6/1 or 6/2. It should be noted that the Roberts 6f wrap 1 and Roberts 6f wrap 4 codes are symmetrical and have even polarity. A correlation function of a cyclic implementation of a Roberts 6f code is provided in FIG. 27G. This behavior is similar to the cyclic implementation of a Roberts 5b code except there is a single +2 side lobe position instead of a constant force plateau over a range of positions. The remaining possible length 6 pattern of six alternating poles was ignored.

Table 6 presents Roberts 7 codes for which the linear and cyclic correlation functions and various comparison factors can be determined for corresponding code wrap families such as disclosed above. The Roberts 7 code wrap families can be compared to the Barker 7 code wrap family provided in Table 3. The correlation functions of linear implementations of the Barker 7 code wrap family members are depicted in FIGS. 28A-28G. A correlation function of a cyclic Barker 7 code implementation was depicted previously in FIG. 14.

TABLE 6

Roberts Length 7 Codes

| Code | Description | Polarity Pattern | Comment |
|---|---|---|---|
| R7a | One negative pole | ++++++− | |
| R7b | Two consecutive negative poles | +++++−− | |
| R7c | Negative pole from negative pole by one positive pole and four positive poles | ++++−+− | |
| R7d | Negative pole from negative pole by two and three positive poles | +++−++− | |
| R7e | Three consecutive negative poles | ++++−−− | |
| Barker 7 | Two consecutive negative poles from negative pole by one positive pole and three positive poles. | +++−−+− | Provided to show complete code search process. Discard |
| R7f | Two consecutive negative poles from negative pole by two positive poles and two positive poles. | ++−−++− | |

TABLE 6-continued

Roberts Length 7 Codes

| Code | Description | Polarity Pattern | Comment |
|---|---|---|---|
| R7g | Negative pole from (negative pole from negative pole) by two positive poles and one positive pole. | ++−+−+− | Code wrap family includes alternating pole case. |

Correlation functions corresponding to linear implementations of the Roberts 7a code wrap family are provided in FIGS. 29A-29G. The Roberts 7a wrap 0 and wrap 1 codes could, for example, enable a self-closing drawer. A correlation function of a cyclic implementation of a Roberts 7a code is provided in FIG. 29H.

Correlation functions corresponding to linear implementations of the Roberts 7b code wrap family are provided in FIGS. 30A-30G. A correlation function of a cyclic implementation of a Roberts 7b code is provided in FIG. 30H.

Correlation functions corresponding to linear implementations of the Roberts 7c code wrap family are provided in FIGS. 31A-31G. A correlation function of a cyclic implementation of a Roberts 7c code is provided in FIG. 31H.

Correlation functions corresponding to linear implementations of the Roberts 7d code wrap family are provided in FIGS. 32A-32G. A correlation function of a cyclic implementation of a Roberts 7d code is provided in FIG. 32H.

Correlation functions corresponding to linear implementations of the Roberts 7e code wrap family are provided in FIGS. 33A-33G. A correlation function of a cyclic implementation of a Roberts 7e code is provided in FIG. 33H.

Correlation functions corresponding to linear implementations of the Roberts 7f code wrap family are provided in FIGS. 34A-34G. A correlation function of a cyclic implementation of a Roberts 7f code is provided in FIG. 34H.

Correlation functions corresponding to linear implementations of the Roberts 7g code wrap family are provided in FIGS. 35A-35G. The Roberts 7g wrap 6 code is merely an alternating polarity pattern and was discarded. A correlation function of a cyclic implementation of a Roberts 7g code is provided in FIG. 35H.

FIGS. 36A-36H depict what could be described as a group of codes that exhibit a first class of magnetic behavior. The codes are very similar in that each consists of a group of M magnetic sources having a first polarity in between single (L=1) outermost sources each having a second polarity, where the code length N of the codes goes from 5 to 12. Each of their correlation functions has a peak force of N and a largest off peak of 1 at their outermost alignment positions. From left to right, each correlation function has a first transition portion having a −3/2 slope, a second transition portion having a linear slope corresponding to (M−1)/(M−1), and a third transition portion having a linear slope of 5/1.

FIGS. 37A-37H depict what could be described as a group of codes that exhibit a second class of magnetic behavior. The codes are very similar in that each consists of a group of M magnetic sources having a first polarity in between L=2 outermost sources each having a second polarity, where the code length N of the codes goes from 5 to 12. Each of their correlation functions has a peak force of N and an off peak force of 1 at their outermost alignment positions but also has a slightly greater off peak force of L at the next position (e.g., position 2). It should be noted that FIG. 37B depicts the correlation function of an alternating polarity pattern, which was discarded but provided for comparison. From left to right, the correlation function has three transition portions having 1/1, −3M/M, and 5M/M slopes, respectively. Interestingly, by removing a magnet from the middle as in FIG. 37A a second and third transition portions become second, third, and fourth transition portions having slopes of −3M/M, (L−M)/(L−M), and 5M/M, respectively. Similarly, when magnetic sources of the same polarity are added between the two outermost pairs of magnetic sources such as in FIGS. 37C-37H, the second and third transition portions of FIG. 37B become second, third, and fourth transition portions having −3L/L, (M−L)/(M−L), and 5L/L slopes, respectively.

FIGS. 38A-38F depict what could be described as a group of codes that exhibit a third class of magnetic behavior. The codes are very similar in that each consists of a group of M magnetic sources having a first polarity in between L=3 outermost sources on each side having a second polarity, where the code length N of the codes goes from 7 to 12. Each of their correlation functions has a peak force of N and an off peak force of 1 at their outermost alignment positions but also has a slightly greater off peak force of 3 two code shifts inward (e.g., position 3). It should be noted that FIG. 38C depicts the correlation function of an alternating polarity pattern, which was discarded but provided for comparison. From left to right, the correlation function has three transition portions having 2/2, −3M/M, and 5M/M slopes, respectively. As magnet sources are removed from the middle, the second and third transition portions of FIG. 38C become second, third, and fourth transition portions having slopes of −3M/M, (L−M)/(L−M), and 5M/M, respectively. As magnets are added, as depicted in FIGS. 38D-38F, the second and third transition portions of FIG. 38C become second, third, and fourth transition portions having slopes of −3L/L, (M−L)/(M−L), and −5L/L, respectively.

One skilled in the art will recognize based on these teachings herein that various other classes of magnetic behaviors can be defined and corresponding formulas produced enabling the magnetic structure designer to achieve desired force behaviors.

Table 7 presents Roberts Length 8 codes for which the linear and cyclic correlation functions and various comparison factors can be determined for corresponding code wrap families such as disclosed above.

TABLE 7

Roberts Length 8 Codes

| Code | Description | Polarity Pattern | Comment |
|---|---|---|---|
| R8a | One negative pole | +++++++− | |
| R8b | Two consecutive negative poles | ++++++−− | |
| R8c | Negative pole from negative pole by one and five positive poles | +++++−+− | |
| R8d | Negative pole from negative pole by two and four positive poles | ++++−++− | |
| R8e | Negative pole from negative pole by three and three positive poles | +++−+++− | Same as two Barker 4a modulos Discard |
| R8f | Three consecutive negative poles | +++++−−− | |
| R8g | Two consecutive negative poles from negative pole by one and four positive poles | ++++−+−− | |
| R8h | Two consecutive negative poles from negative pole by two and three positive poles | +++−−++− | |
| R8i | Four consecutive negative poles | ++++−−−− | Alternating polarity pattern with four same polarity elements for each symbol. Discard |
| R8j | Three consecutive negative poles from negative pole by one and three positive poles | +++−−−+− | |
| R8k | Three consecutive negative poles from negative pole by two and two positive poles | ++−−−++− | |
| R8l | Two consecutive negative poles from negative pole positive pole negative pole group by one and two positive poles | ++−−+−+− | |
| Alternating | Negative pole from negative pole positive pole negative pole positive pole negative pole group by one and one positive pol | +−+−+−+− | Discard |
| R8m | Two consecutive negative poles from two consecutive negative poles by one and three positive poles | +++−−+−− | |
| R8n | Two consecutive negative poles from two consecutive negative poles by two and two positive poles | ++−−++−− | Alternating polarity pattern with two same polarity elements for each symbol. Discard |

Table 8 presents Roberts Length 9 codes for which the linear and cyclic correlation functions and various comparison factors can be determined for corresponding code wrap families such as disclosed above.

TABLE 8

Roberts Length 9 Codes

| Code | Description | Polarity Pattern | Comment |
|---|---|---|---|
| R9a | One negative pole | ++++++++− | |
| R9b | Two negative poles | +++++++−− | |
| R9c | Negative pole separated from a negative pole by one positive pole and six positive poles | ++++++−++− | |
| R9d | Negative pole separated from a negative pole by two positive pole and five positive poles | +++++−++− | |
| R9e | Negative pole separated from a negative pole by three positive pole and four positive poles | ++++−+++− | |
| R9f | Three negative poles | ++++++−−− | Same as Barker 3 with three same polarity elements for each symbol. |
| R9g | Two negative poles separated from a negative pole by one positive pole and five positive poles | +++++−−+− | |
| R9h | Two negative poles separated from a negative pole by two positive poles and four positive poles | ++++−−++− | |
| R9i | Two negative poles separated from a negative pole by three positive poles and three positive poles | +++−−+++− | |
| R9j | One negative pole from negative pole positive pole negative pole group by one and four positive poles | ++++−+−+− | |
| R9k | One negative pole from negative pole positive pole negative pole group by two and three positive poles | +++−++−+− | |
| R9l | Four consecutive negative poles | +++++−−−− | |
| R9m | Three consecutive negative poles from one negative pole by one and four positive poles | ++++−−−+− | |
| R9n | Three consecutive negative poles from one negative pole by two and three positive poles | ++++−−−++− | |
| R9o | Two consecutive negative poles from negative pole positive pole negative pole group by three and one positive poles. | +++−−+−+− | |
| R9p | Two consecutive negative poles from negative pole positive pole negative pole group by two and two positive poles. | ++−−++−+− | |
| R9q | One negative pole from negative pole positive pole negative pole positive pole negative pole group by one and two positive poles | ++−+−+−+− | |
| R9r | Two negative poles from two negative poles by one and four positive poles | ++++−−+−− | |
| R9s | Two negative poles from two negative poles by two and three positive poles | +++−−++−− | |

Based on the teachings of Tables 4 through 8, one skilled in the art will recognize that all possible polarity patterns that involve cancellation of forces for off-peak alignments of complementary magnetic structures can be determined for any given number of elements (or code length N), for example, such codes can be determined by a computer program that implements a search algorithm. Moreover, for any such code, a code wrap family having auto-correlation and cross-correlation functions and comparison factors can be determined as described in relation to Tables 2 and 3.

Figures 39A, 39B:
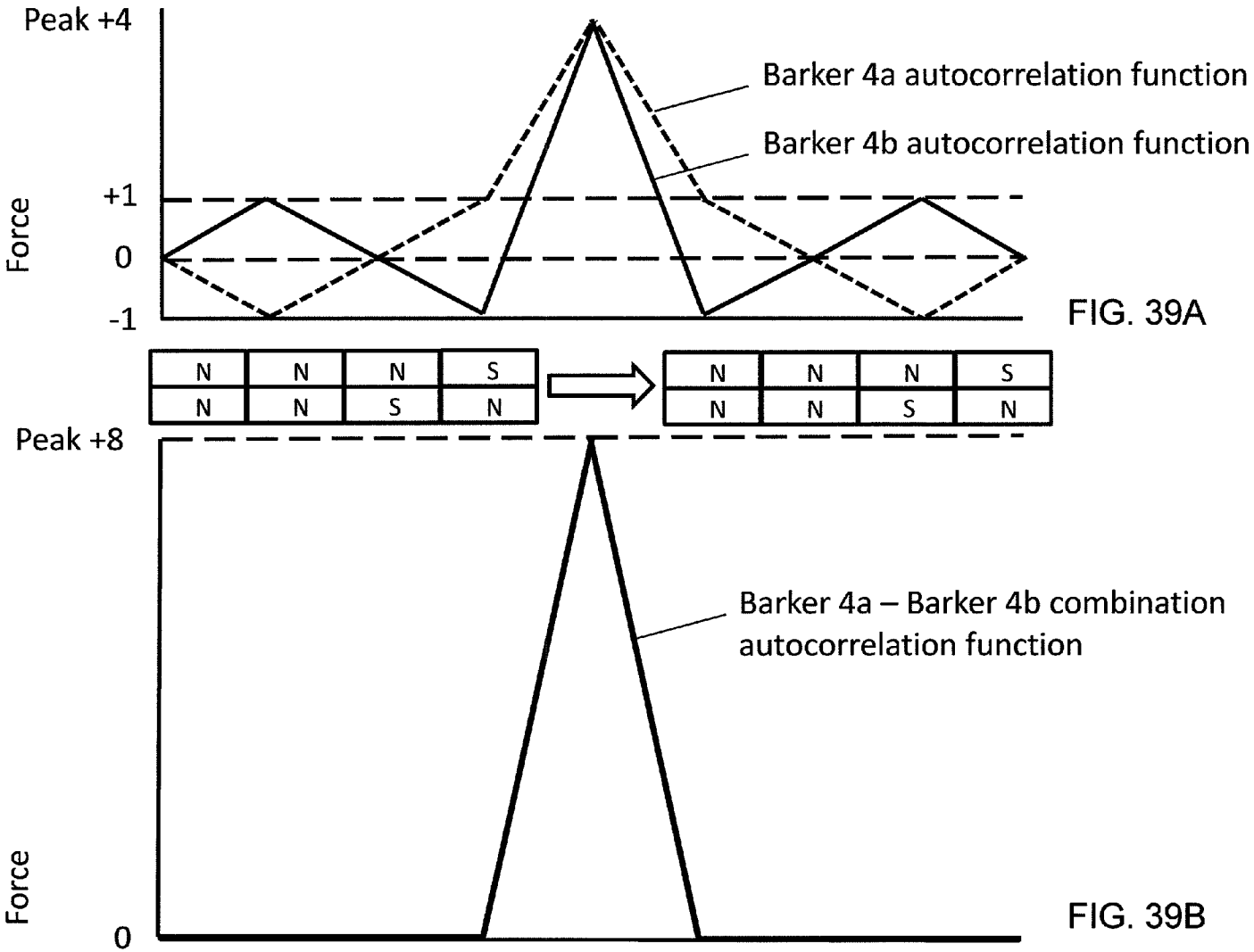
FIG. 39A depicts the Barker 4a and Barker 4b spatial force autocorrelation functions on the same plot.
FIG. 39B depicts an exemplary spatial force function of magnetic structure that is a combination of two linear complementary structures having polarity patterns in accordance with a Barker 4a code oriented parallel to a Barker 4b code where the respective positive and negative side lobes cancel as the structure moves across a complementary coded structure.

In accordance with another embodiment of the invention, combinations of two or more one-dimensional codes having the same code length N can be configured such that their correlation functions combine into a composite correlation function. FIG. 39A depicts the Barker 4a and Barker 4b spatial force autocorrelation functions on the same plot. As can be seen, the 1 side lobes of the Barker 4a autocorrelation function coincide with the −1 side lobes of the Barker 4b autocorrelation function, and vice versa. When a magnetic structure having two parallel rows of magnetic elements coded in accordance with the Barker 4a and 4b codes, respectively, the main lobes and side lobes add such that all the positive and negative side lobes cancel each other such that all side lobes of the combination autocorrelation function are zero side lobes. FIG. 39B depicts an exemplary spatial force function of two linear complementary structures having polarity patterns in accordance with a Barker 4a code parallel to a Barker 4b code where the respective positive and negative side lobes cancel.

Figure 39D:
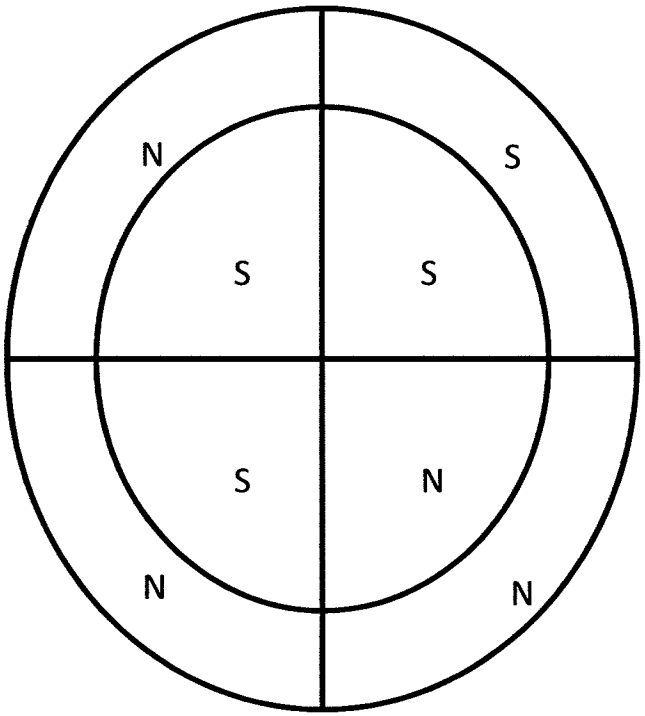
FIG. 39D depicts an exemplary cyclic magnetic structure like that of FIG. 18C except the polarity pattern of the innermost magnetic elements has been exchanged with the complementary polarity pattern.
Figure 39C:
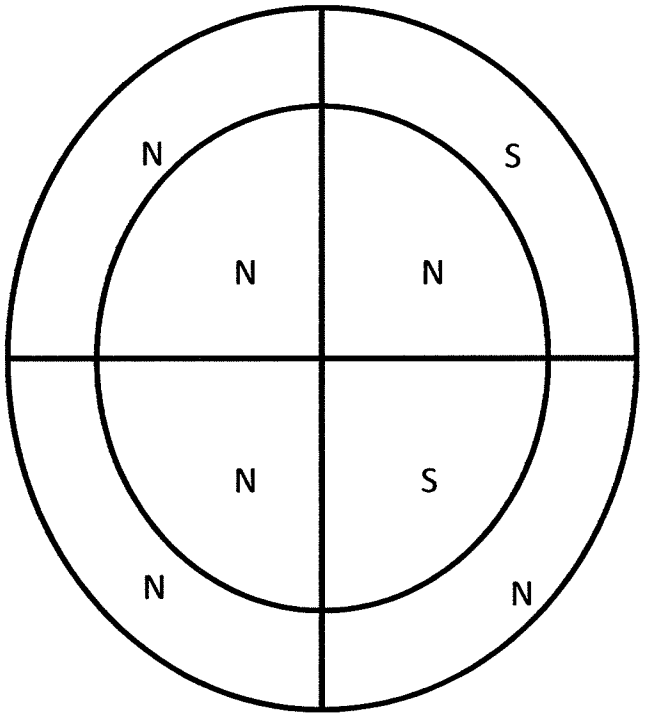
FIG. 39C depicts a exemplary cyclic magnetic structure that is a combination of Barker 4a and Barker 4b codes.

Generally, members of a one or more code wrap families of a given code length can be combined to produce complementary magnetic structures having desirable magnetic properties. Combinations can be selected to have no positive side lobes, to produce a specific type of magnetic behavior, to change the peak to maximum off-peak ratio, to produce constant side lobes, etc. For example, the side lobes of a Roberts 5a code (2, −1, −2, −1) combined with the side lobes of a Roberts 5b wrap 1 code (−2, −1, 2, −1) produce a combined autocorrelation function of (0, −2, 0, −2), where the two length 5 codes each being of type 1 combine to produce type 2 magnetic behavior. A combination of two Roberts 5b codes, a Roberts 5a wrap 2 code, and a Roberts 5a wrap 4 code produces complementary magnetic structures where all side lobes are −2 and the peak is 20, which is 10 to 1 peak to maximum off-peak ratio. As such, in accordance with the present invention two or more one-dimensional codes having different polarity patterns but the same code length can be combined to meet a criteria In accordance with another embodiment of the invention, combinations of one-dimensional codes can be combined by exchanging at least one one-dimensional code of a code combination with its complementary code. FIG. 39C and FIG. 39D provide an example of this technique. FIG. 39C depicts a cyclic implementation of the Barker 4a-Barker 4b code combination presented in FIG. 39A. In FIG. 39D, the innermost Barker 4 code is exchanged with its complementary pattern. One skilled in the art will recognize that in the near field, the magnetic behaviors of complementary magnetic structures in accordance with the combinations have substantially the same behavior but in the far field look substantially different since the structure of FIG. 39C has mostly North polarity elements where the structure of FIG. 39D has the same number of North polarity elements as South polarity elements.

Figure 40A:
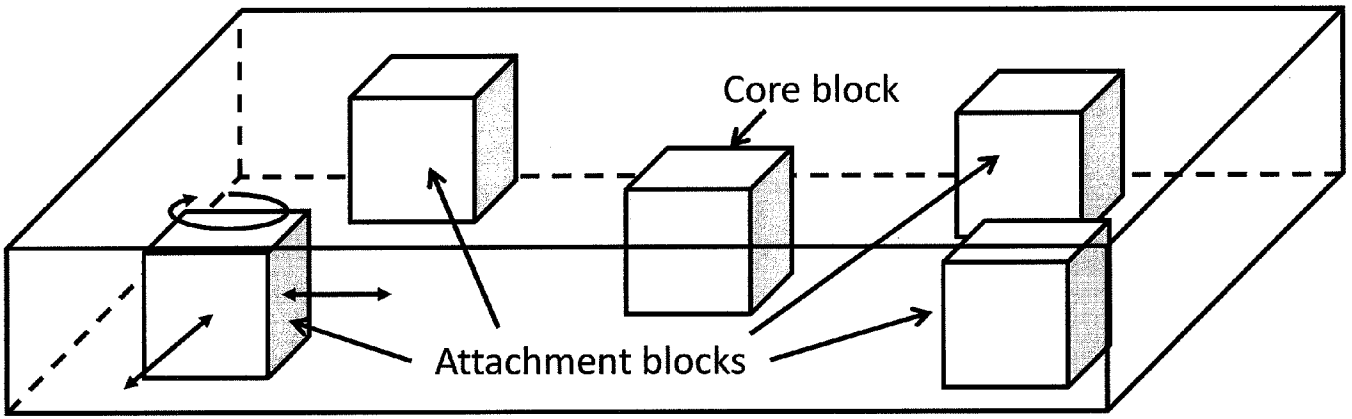
FIGS. 40A and 40B depict an exemplary self-assembling toy before self-assembly and after self-assembly.
Figure 40B:
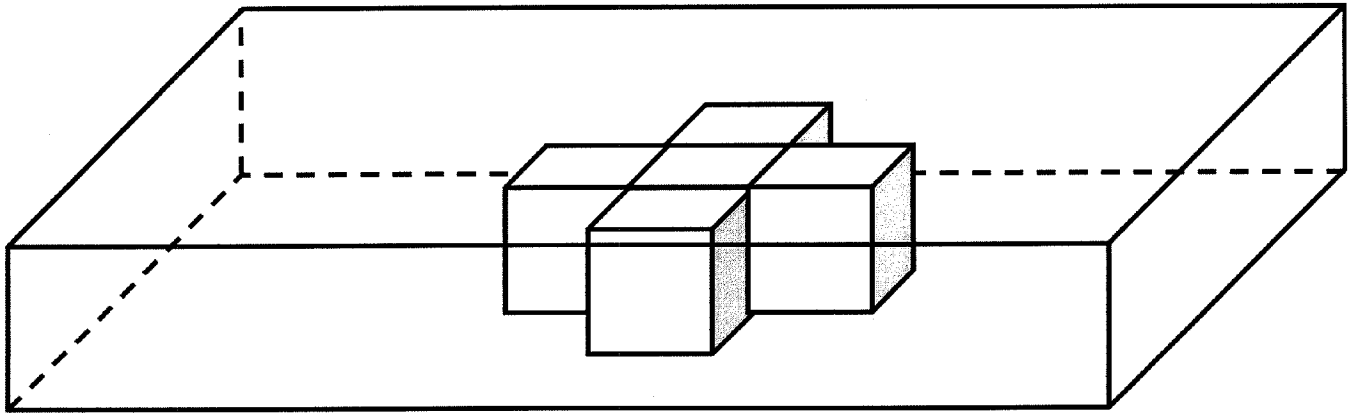

FIGS. 40A and 40B depict an exemplary self-assembling toy before self-assembly and after self-assembly.

Figure 41A:
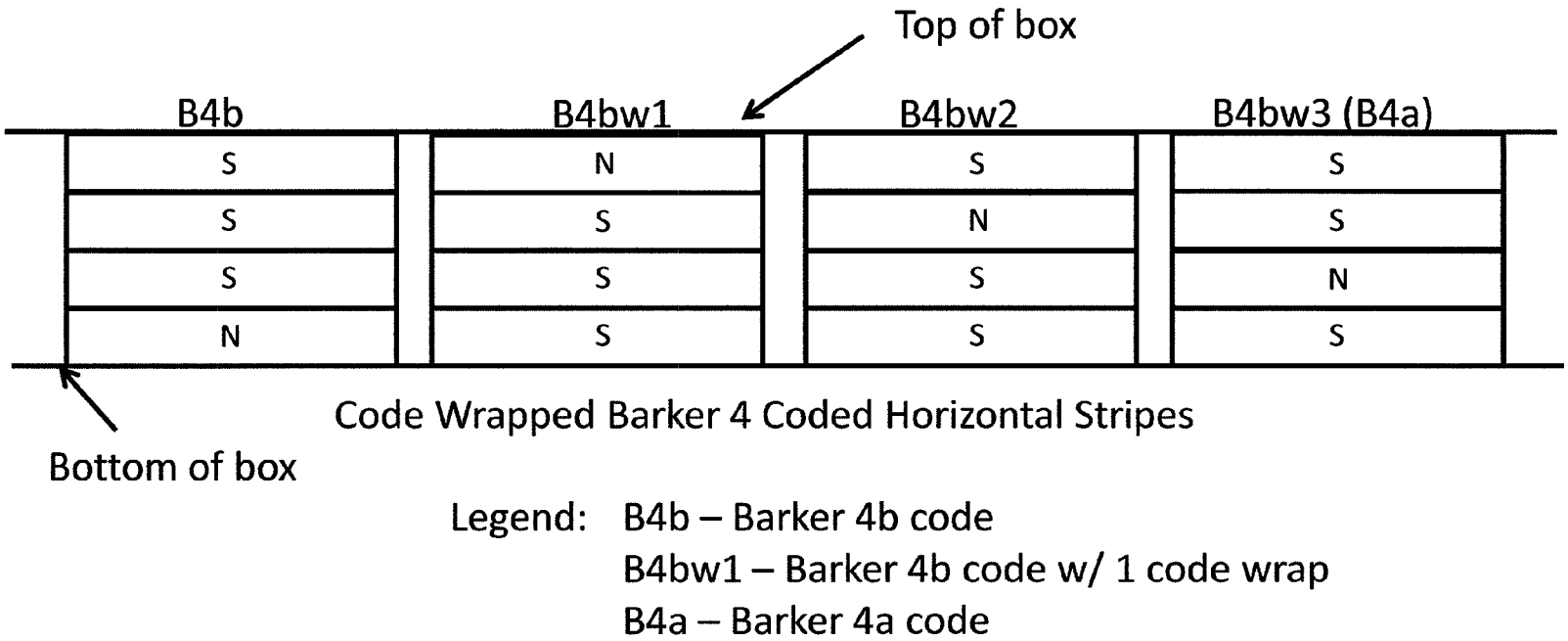
FIG. 41A depicts four magnetic structures constrained in one dimension having polarity patterns in accordance with the Barker 4 code wrap family.

FIG. 41A depicts four magnetic structures constrained in one dimension having polarity patterns in accordance with the Barker 4 code wrap family. A core block has four sides each having magnetic structures coded in accordance with one of the Barker 4b code wrap family members (i.e., B4b, B4bw1, B4bw2, B4bw3), which can be in any order. The other four attachment blocks each have at least one side having a magnetic structure coded with a complementary code of one of the Barker 4b code wrap family members (i.e., B4b', B4bw1', B4bw2', B4bw3'). The four attachment blocks will ignore each other when their respective magnetic structures interact but will magnetically attach to their corresponding magnetic structure having the appropriate complementary code on the core block when the box in which the blocks are located is shaken such that they come into close proximity with their partners. The blocks can rotate and translate within the box but the coded structures are constrained by the box where the coded patterns are always perpendicular to the top and bottom of the box.

FIG. 41B depicts use of a "+ −" and "− +" symbols to provide centering characteristics to the parts of the self-assembly toy.

FIG. 41C depicts use of a Barker 3 code and complementary Barker 3 code as symbols to provide centering characteristics to the part of the self-assembly toy.

When magnetic structures coded in accordance with a given Barker wrap family are constrained in the dimension of the codes (e.g., vertically in FIGS. 41A-41C, where the objects having the codes can rotate and translate within a box but where the code is always perpendicular to the top and bottom of the box), the family will have a peak cross-correlation that is the same as the constant autocorrelation side lobes of the same Barker code in a cyclic implementation. As such, each member of a Barker 4 code wrap family will have auto correlation peak of 4 and a peak cross correlation of 0 with every other family member, a Barker 5 code family and Barker 13 code family will have a peak autocorrelation of 5 and 13, respectively, and each have a peak cross correlation of 1, and a Barker 3, Barker 7, and Barker 11 code families will have a peak autocorrelation of 3, 7, and 11, respectively, and will each have a peak cross correlation of −1.

The basic concept of constraining a code family enables the use of codes that would have undesirable cross-correlation characteristics if not constrained. As such, male-female type connectors that provide such constraints can be used to design parts that discriminate such that part A will only attach to part A', B to B', and so forth. Such magnetic structures can include a magnetic repel bias such that a given part (e.g., A) will attach to its complementary structure (e.g., A') but will repel every other part (e.g., B, B', C, C', etc.). By constraining magnetic structures in two dimensions, codes can be employed in two dimensions such as in FIG. 41C.

While particular embodiments of the invention have been described, it will be understood, however, that the invention is not limited thereto, since modifications may be made by those skilled in the art, particularly in light of the foregoing teachings.

The invention claimed is:

1. A field emission system, comprising:

a first field emission structure; and a second field emission structure, said first and second field emission structures each comprising an array of field emission sources each having positions and polarities relating to a spatial force function that corresponds to forces produced by aligned field emission sources of the first and second field emission structures at different spatial alignments within a field domain, said spatial force function being in accordance with a code modulo of a code that defines an irregular polarity pattern, said irregular polarity pattern being at least one of an asymmetric polarity pattern or an uneven polarity pattern, said code modulo having a length equal to the length of said code, said code defining at least one peak force per code modulo corresponding to one or more spatial alignments of a plurality of the field emission sources of said first field emission structure and a plurality of the field emission sources of said second field emission structure, a peak force being a spatial force produced when all aligned field emission sources produce an attractive force or all aligned field emission sources produce a repellant force, said code also defining a plurality of off peak forces per code modulo corresponding to a plurality of spatial missalignments of said first and second field emission structures, an off peak force being a spatial force resulting from cancellation of at least one attractive force produced by aligned field emission sources of said first and second field emission structures by at least one repellant force produced by aligned field emission sources of said first and second field emission structures.

2. The field emission system of claim 1, wherein said code is one of a pseudorandom code, a deterministic code, or a designed code.

3. The field emission system of claim 1, wherein said code is one of a one dimensional code, a two dimensional code, a three dimensional code, or a four dimensional code.

4. The field emission system of claim 1, wherein each field emission source of each said array of field emission sources has a first vector direction or a second vector direction, said second vector direction being opposite said first vector direction.

5. The field emission system of claim 1, wherein at least one off peak force of said plurality of off peak forces is a zero side lobe.

6. The field emission system of claim 1, wherein each said array of field emission sources comprises one of a one-dimensional array, a two-dimensional array, or a three-dimensional array.

7. The field emission system of claim 1, wherein said polarities of the field emission sources comprise at least one of North-South polarities or positive-negative polarities.

8. The field emission system of claim 1, wherein at least one of said field emission sources comprises a magnetic field emission source or an electric field emission source.

9. The field emission system of claim 1, wherein at least one of said field emission sources comprises a permanent magnet, an electromagnet, an electret, a magnetized ferromagnetic material, a portion of a magnetized ferromagnetic material, a soft magnetic material, or a superconductive magnetic material.

10. The field emission system of claim 1, wherein at least one said first and second field emission structures comprises at least one of a back keeper layer, a front saturable layer, an active intermediate element, a passive intermediate element, a lever, a latch, a swivel, a heat source, a heat sink, an inductive loop, a plating nichrome wire, an embedded wire, or a kill mechanism.

11. The field emission system of claim 1, wherein at least one of said first and second field emission structures comprises a planer structure, a conical structure, a cylindrical structure, a curve surface, a stepped surface.

12. A field emissions method, comprising:

defining a spatial force function corresponding to the relative alignment of a first array of field emission sources of a first field emission structure and a second array of field emission sources of a second field emission structure within a field domain, said spatial force function being in accordance with a code modulo of a code that defines an irregular polarity pattern, said irregular polarity pattern being at least one of an asymmetric polarity pattern or an uneven polarity pattern, said code modulo having a length equal to the length of said code, said code defining at least one peak force per code modulo corresponding to one or more spatial alignments of a plurality of the field emission sources of said first field emission structure and a plurality of the field emission sources of said second field emission structure, said peak force being a spatial force produced when all aligned field emission sources produce an attractive force or all aligned field emission sources produce a repellant force, said code also defining a plurality of off peak forces per code modulo corresponding to a plurality of spatial missalignments of said first and second field emission structures, said off peak force being a spatial force resulting from cancellation of at least one attractive force produced by aligned field emission sources of said first and second field emission structures by at least one repellant force produced by aligned field emission sources of said first and second field emission structures; and establishing, in accordance with said spatial force function, a position and polarity of each field emission source of said first array of field emission sources and said second array of field emission sources.

13. The method of claim 12, wherein said code is one of a pseudorandom code, a deterministic code, or a designed code.

14. The method of claim 12, wherein said code is one of a one dimensional code, a two dimensional code, a three dimensional code, or a four dimensional code.

15. The method of claim 12, wherein each field emission source of each said array of field emission sources has a first vector direction or a second vector direction, said second vector direction being opposite said first vector direction.

16. The method of claim 12, wherein at least one off peak force of said plurality of off peak forces is a zero side lobe.

17. The method of claim 12, wherein each said array of field emission sources comprises one of a one-dimensional array, a two-dimensional array, or a three-dimensional array.

18. The method of claim 12, wherein at least one of said field emission sources comprises a magnetic field emission source or an electric field emission source.

19. The method of claim 12, wherein at least one of said field emission sources comprises a permanent magnet, an electromagnet, an electret, a magnetized ferromagnetic material, a portion of a magnetized ferromagnetic material, a soft magnetic material, or a superconductive magnetic material.

20. A field emission system, comprising:

a first field emission structure; and a second field emission structure, said first and second field emission structures each having arrays of field emission sources having an irregular polarity pattern defined in accordance with a code modulo of a code, said irregular polarity pattern being at least one of an asymmetrical polarity pattern or an uneven polarity pattern, said code modulo having a length equal to the length of said code, said code defining at least one peak force and a plurality of off peak forces corresponding to a plurality of alignments of said first and second field emission structures per code modulo, said peak force being a spatial force produced when all aligned field emission sources produce an attractive force or all aligned field emission sources produce a repellant force, said off peak force being a spatial force that results from cancellation of at least one attractive force by at least one repellant force.

* * * * *